US007349847B2

(12) United States Patent
Hirose et al.

(10) Patent No.: US 7,349,847 B2
(45) Date of Patent: Mar. 25, 2008

(54) SPEECH SYNTHESIS APPARATUS AND SPEECH SYNTHESIS METHOD

(75) Inventors: Yoshifumi Hirose, Soraku-gun (JP); Natsuki Saito, Katano (JP); Takahiro Kamai, Soraku-gun (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/352,380

(22) Filed: Feb. 13, 2006

(65) Prior Publication Data

US 2006/0136213 A1 Jun. 22, 2006

Related U.S. Application Data

(63) Continuation of application No. PCT/JP2005/017285, filed on Sep. 20, 2005.

(30) Foreign Application Priority Data

Oct. 13, 2004 (JP) ..... 2004-299365
Jul. 7, 2005 (JP) ..... 2005-198926

(51) Int. Cl.
*G10L 13/08* (2006.01)
*G10L 13/00* (2006.01)

(52) U.S. Cl. ..... 704/260; 704/258

(58) Field of Classification Search ..... None
See application file for complete search history.

(56) References Cited

U.S. PATENT DOCUMENTS 5,704,006 A 12/1997 Iwahashi
6,240,384 B1 * 5/2001 Kagoshima et al. ..... 704/220
6,405,169 B1 * 6/2002 Kondo et al. ..... 704/258
6,516,298 B1 * 2/2003 Kamai et al. ..... 704/260
6,529,874 B2 * 3/2003 Kagoshima et al. ..... 704/269
6,826,531 B2 * 11/2004 Fukada ..... 704/258
7,039,588 B2 * 5/2006 Okutani et al. ..... 704/258
2003/0004723 A1 1/2003 Chihara
2005/0137870 A1 * 6/2005 Mizutani et al. ..... 704/264
2005/0137871 A1 * 6/2005 Capman et al. ..... 704/268
2005/0149330 A1 * 7/2005 Katae ..... 704/267

FOREIGN PATENT DOCUMENTS

JP 07-319495 12/1995
JP 7-319495 12/1995

(Continued)

*Primary Examiner*—David Hudspeth
*Assistant Examiner*—Matthew J Sked
(74) *Attorney, Agent, or Firm*—Wenderoth, Lind & Ponack, L.L.P.

(57) ABSTRACT

A speech synthesis apparatus appropriately transforms a voice characteristic of speech. The speech synthesis apparatus includes an element storing unit in which speech elements are stored, and a function storing unit in which transformation functions are stored, an adaptability judging unit which derives a degree of similarity by comparing a speech element stored in the element storing unit with an acoustic characteristic of the speech element used for generating a transformation function stored in the function storing unit. The speech synthesis apparatus also includes a selecting unit and voice characteristic transforming unit which transforms, for each speech element stored in the element storing unit, based on the degree of similarity derived by the adaptability judging unit, a voice characteristic of the speech element by applying one of the transformation functions stored in the function storing unit.

13 Claims, 31 Drawing Sheets

FOREIGN PATENT DOCUMENTS

| | | |
|---|---|---|
| JP | 08-083098 | 3/1996 |
| JP | 08-248994 | 9/1996 |
| JP | 09-258779 | 10/1997 |
| JP | 10-097267 | 4/1998 |
| JP | 11-085194 | 3/1999 |
| JP | 2002-182682 | 6/2002 |
| JP | 2002-215198 | 7/2002 |
| JP | 2002-215199 | 7/2002 |
| JP | 2003-005775 | 1/2003 |
| JP | 2003-066982 | 3/2003 |
| JP | 2004-279436 | 10/2004 |

* cited by examiner

FIG. 25A

Base point database A

| Phoneme | Duration length | Base point 1 | Base point 2 |
|---|---|---|---|
| : | : | : | : |
| o | 80 | 3000 | 4300 |
| m | 50 | 2500 | 4250 |
| e | 100 | 2600 | 4100 |
| : | : | : | : |

511

FIG. 25B

Base point database B

| Phoneme | Duration length | Base point 1 | Base point 2 |
|---|---|---|---|
| : | : | : | : |
| o | 70 | 3100 | 4400 |
| m | 40 | 2400 | 4200 |
| e | 90 | 2700 | 4000 |
| : | : | : | : |

512

SPEECH SYNTHESIS APPARATUS AND SPEECH SYNTHESIS METHOD

CROSS REFERENCE TO RELATED APPLICATION

This is a continuation of PCT Patent Application No. PCT/JP2005/017285 filed on Sep. 20, 2005, designating the United States of America.

BACKGROUND OF THE INVENTION (1) Field of the Invention

The present invention is a speech synthesis apparatus which synthesizes speech using speech elements, and a speech synthesis method thereof, and, in particular, to a speech synthesis apparatus which transforms voice characteristics of the speech elements, and a speech synthesis method thereof.

(2) Description of the Related Art

Conventionally, there is proposed a speech synthesis apparatus which performs voice characteristic transformation (e.g., see Patent Reference 1: Japanese Laid-Open Patent Application No. 7-319495, paragraphs 0014 to 0019, Patent Reference 2: Japanese Laid-Open Patent Application No. 2003-66982, paragraphs 0035 to 0053, and Patent Reference 3: Japanese Laid-Open Patent Application No. 2002-215198).

The speech synthesis apparatus disclosed in the patent reference 1 has speech element sets, each of which has a different voice characteristic, and performs voice characteristic transformation by switching the speech element sets.

FIG. 1 is a block diagram showing a structure of the speech synthesis apparatus disclosed in the patent reference 1.

This speech synthesis apparatus includes a synthesis unit data information table 901, an individual code book storing unit 902, a likelihood calculating unit 903, a plurality of individual-specific synthesis unit databases 904, and a voice characteristic transforming unit 905.

The synthesis unit data information table 901 holds data elements (synthesis unit data) respectively relating to synthesis units to be speech synthesized. Each synthesis unit data has a synthesis unit data ID for uniquely identifying the synthesis unit. The individual code book storing unit 902 holds information which indicates identifiers of all the speakers (individual identification ID) and characteristics of the speaker's voice. The likelihood calculating unit 903 selects a synthesis unit data ID and an individual identification ID by referring to the synthesis unit data information table 901 and the individual code book storing unit 902, based on standard parameter information, synthesis unit names, phonetic environmental information, and target voice characteristic information.

Each of the individual-specific synthesis unit databases 904 holds a different speech element set which has a unique voice characteristic. Also, the individual-specific synthesis unit database is associated with an individual identification ID.

The voice characteristic transforming unit 905 obtains the synthesis unit data ID and individual identification ID selected by the likelihood calculating unit 903. The voice characteristic transforming unit 905 then generates a speech waveform by obtaining speech elements corresponding to the synthesis unit data indicated by the synthesis unit data ID from the individual-specific synthesis unit database 904 identified by the individual identification ID.

On the other hand, the speech synthesis apparatus disclosed in the patent reference 2 transforms a voice characteristic of an ordinary synthesized speech using a transformation function for performing the voice transformation.

FIG. 2 is a block diagram showing a structure of the speech synthesis apparatus disclosed in the patent reference 2.

This speech synthesis apparatus includes a text input unit 911, an element storing unit 912, an element selecting unit 913, a voice characteristic transforming unit 914, a waveform synthesizing unit 915, and a voice characteristic transformation parameter input unit 916.

The text input unit 911 obtains text information indicating the details of words to be synthesized or phoneme information, and prosody information indicating accents and intonation of an overall speech. The element storing unit 912 holds a set of speech elements (synthesis speech unit). The element selecting unit 913, based on the phoneme information and prosody information obtained by the text input unit 911, selects optimum speech elements from the element storing unit 912, and outputs the selected speech elements. The voice characteristic transformation parameter input unit 916 obtains a voice characteristic parameter indicating a parameter relating to the voice characteristic.

The voice characteristic transforming unit 914 performs voice characteristic transformation on the speech elements selected by the element selecting unit 913, based on the voice characteristic parameter obtained by the voice characteristic transformation parameter input unit 916. Accordingly, a linear or non-linear frequency transformation is performed on the speech elements. The waveform synthesizing unit 915 generates a speech waveform based on the speech elements whose voice characteristics are transformed by the voice characteristic transforming unit 914.

FIG. 3 is an explanatory diagram for explaining transformation functions used for the voice transformation of the respective speech elements performed by the voice characteristic transforming unit 914 disclosed in the patent reference 2. Here, a horizontal axis (Fi) in FIG. 3 indicates an input frequency of a speech element inputted to the voice characteristic transforming unit 914, and a vertical axis (Fo) in FIG. 3 indicates an output frequency of the speech element outputted by the voice characteristic transforming unit 914.

The voice characteristic transforming unit 914 outputs the speech element selected by the speech element selecting unit 913 without performing voice transformation in the case where a transformation function f101 is used as a voice characteristic parameter. Also, the voice transforming unit 914 transforms and outputs, in the case where a transformation function f102 is used as a voice characteristic parameter, the input frequency of the speech element selected by the speech selecting unit 913 linearly; and transforms and outputs, in the case where a transformation function f103 is used as a voice characteristic parameter, the input frequency of the speech element selected by the element selecting unit 913 non-linearly.

In addition, a speech synthesis apparatus (voice characteristic transformation apparatus) disclosed in the patent reference 3 determines a group to which a phoneme whose voice characteristic is to be transformed belongs, based on an acoustic characteristic of the phoneme. The speech synthesis apparatus then transforms the voice characteristic of the phoneme using a transformation function set for the group to which the phoneme belongs.

SUMMARY OF THE INVENTION

However, the speech synthesis apparatuses disclosed in the patent references 1 to 3 have a problem that an appropriate voice characteristic transformation cannot be performed.

In other words, the speech synthesis apparatus disclosed in the patent reference 1 cannot perform consecutive voice characteristic transformations and generate a speech waveform of a voice characteristic which does not exist in each individual-specific synthesis unit database 904 because it transforms the voice characteristic of the synthesized speech by switching the individual-specific synthesis unit databases 904.

Also, the speech synthesis apparatus disclosed in the patent reference 2 cannot perform an optimum transformation on each phoneme because it performs voice characteristic transformation on the overall input sentence indicated in the text information. In addition, the speech synthesis apparatus disclosed in the patent reference 2 selects speech elements and a voice characteristic transformation in series and independently. Therefore, there is a case where a formant frequency (output frequency Fo) exceeds Nyquist frequency fn by the transformation function f102 as shown in FIG. 3. In such a case, the speech synthesis apparatus of the patent reference 2 forcibly corrects and restrains the formant frequency so as to be less than the Nyquist frequency fn. Consequently, it cannot transform a phoneme into an optimum voice characteristic.

Further, the speech synthesis apparatus disclosed in the patent reference 3 applies a same transformation function to all phonemes in the same group. Therefore, distortion may be generated in the transformed speech. In other words, a grouping of each phoneme is performed based on the judgment about whether or not an acoustic characteristic of each phoneme satisfies a threshold set for each group. In such a case, when a transformation function of a group is applied to a phoneme which sufficiently satisfies the threshold set for the group, the voice characteristic of the phoneme is appropriately transformed. However, when a transformation function of a group is applied to the phoneme whose acoustic character is near the threshold of a group, distortion is caused in the transformed voice characteristic of the phoneme.

Accordingly, in light of the aforementioned problem, an object of the present invention is to provide a speech synthesis apparatus which can appropriately transform a voice characteristic and a speech synthesis method thereof.

In order to achieve the aforementioned object, a speech synthesis apparatus according to the present invention is a speech synthesis apparatus which synthesizes speech using speech elements so as to transform a voice characteristic of the speech. The speech synthesis apparatus includes: an element storing unit in which speech elements are stored; a function storing unit in which transformation functions for respectively transforming voice characteristics of the speech elements are stored; a similarity deriving unit which derives a degree of similarity by comparing an acoustic characteristic of one of the speech elements stored in the element storing unit with an acoustic characteristic of a speech element used for generating one of the transformation functions stored in the function storing unit; and a transforming unit which applies, based on the degree of similarity derived by the similarity deriving unit, one of the transformation functions stored in the function storing unit to a respective one of the speech elements stored in the element storing unit, and to transform the voice characteristic of the speech element. For example, the similarity deriving unit derives a degree of similarity that is higher the more the acoustic characteristic of the speech element stored in the element storing unit resembles the acoustic characteristic of the speech element used for generating the transformation function, and the transforming unit applies, to the speech element stored in the element storing unit, a transformation function generated using a speech element having the highest degree of similarity. Also, the acoustic characteristic is at least one of a cepstrum distance, a formant frequency, a fundamental frequency, a duration length and power.

Accordingly, the voice characteristic of a speech is transformed using transformation functions so that the voice characteristic can be transformed continuously. Also, a transformation function is applied for each speech element based on the degree of similarity so that an optimum transformation for each speech element can be performed. In addition, the voice characteristic can be appropriately transformed without performing forcible modification for restraining the formant frequencies in a predetermined range after the transformation as in the conventional technology.

Here, the speech synthesis apparatus further includes a generating unit which generates prosody information indicating a phoneme and a prosody corresponding to a manipulation by a user, wherein the transforming unit may include: a selecting unit which complementarily selects, based on the degree of similarity, a speech element and a transformation function respectively from the element storing unit and the function storing unit, the speech element and the transformation function corresponding to the phoneme and prosody indicated in the prosody information; and an applying unit which applies the selected transformation function to the selected speech element.

Accordingly, a speech element and a transformation function corresponding to a phoneme and a prosody indicated in the prosody information are selected based on the degree of similarity. Therefore, a voice characteristic can be transformed for a desired phoneme and prosody by changing the details of the prosody information. Further, a voice characteristic of a speech element can be transformed more appropriately because the speech element and the transformation function are complementarily selected based on the degree of similarity.

Further, the speech synthesis apparatus further includes a generating unit which generates prosody information indicating a phoneme and a prosody corresponding to a manipulation by a user, wherein the transforming unit may include: a function selecting unit which selects, from the function storing unit, a transformation function corresponding to the phoneme and prosody indicated in the prosody information; an element selecting unit which selects, based on the degree of similarity, from the element storing unit, a speech element corresponding to the phoneme and prosody indicated in the prosody information for the selected transformation function; and an applying unit which applies the selected transformation function to the selected speech element.

Accordingly, a transformation function corresponding to the prosody information is firstly selected, and a speech element is selected for the transformation function based on the degree of similarity. Therefore, for example, even in the case where the number of transformation functions stored in the function storing unit is small, a voice characteristic can be appropriately transformed if the number of speech elements stored in the element storing unit is large.

Also, the speech synthesis apparatus further includes a generating unit which generates prosody information indicating a phoneme and a prosody corresponding to a manipulation by a user, wherein the transforming unit includes: an element selecting unit which selects, from the element storing unit, a speech element corresponding to the phoneme and prosody indicated in the prosody information; a function selecting unit which selects, based on the degree of similarity, from the function storing unit, a transformation function corresponding to the phoneme and prosody indicated in the prosody information for the selected speech element selected; and an applying unit which applies the selected transformation function to the selected speech element.

Accordingly, a speech element corresponding to the prosody information is firstly selected, and a transformation function is selected for the speech element based on the degree of similarity. Therefore, for example, even in the case where the number of speech elements stored in the element storing unit is small, a voice characteristic can be appropriately transformed if the number of transformation functions stored in the function storing unit is large.

Here, the speech synthesis apparatus further includes a voice characteristic designating unit which receives a voice characteristic designated by the user, wherein the selecting unit may select a transformation function for transforming a voice characteristic of the speech element into the voice characteristic received by the voice characteristic designating unit.

Accordingly, a transformation function for transforming a speech element into a voice characteristic designated by a user is selected so that the speech element can be appropriately transformed into a desired voice characteristic.

Here, the similarity deriving unit may derive a dynamic degree of similarity based on a degree of similarity between a) an acoustic characteristic of a series that is made up of the speech element stored in the element storing unit and speech elements before and after the speech element, and b) an acoustic characteristic of a series that is made up of the speech element used for generating the transformation function and speech elements before and after the speech element.

Accordingly, a transformation function generated using a series that is similar to the acoustic characteristic shown by the overall series of the element storing unit is applied to the speech element included in the series of the element storing unit so that a voice characteristic of the overall series can be maintained.

Also, in the element storing unit, speech elements which make up a speech of a first voice characteristic are stored, and in the function storing unit, the following are stored in association with one another for each speech element of the speech of the first voice characteristic: the speech element; a standard representative value indicating an acoustic characteristic of the speech element; and a transformation function for the standard representative value. The speech synthesis apparatus further includes a representative value specifying unit which specifies, for each speech element of the speech of the first voice characteristic stored in the element storing unit, a representative value indicating an acoustic characteristic of the speech element, the similarity deriving unit is operable to derive a degree of similarity by comparing the representative value indicated by the speech element stored in the element storing unit with the standard representative value of the speech element used for generating the transformation function stored in the function storing unit, and the transforming unit includes: a selecting unit which selects, for each speech element stored in the element storing unit, from among the transformation functions stored in the function storing unit by being associated with a speech element that is same as the current speech element, a transformation function that is associated with a standard representative value having the highest degree of similarity with the representative value of the current speech element; and a function applying unit which applies, for each speech element stored in the element storing unit, the transformation function selected by the selecting unit to the speech element, and to transform the speech of the first voice characteristic into speech of a second voice characteristic. For example, the speech element is a phoneme.

Accordingly, in the case where a transformation function is selected for a phoneme of a speech of the first voice characteristic, a transformation function in associated with the standard representative value that is the closest to the representative value indicated by the acoustic characteristic of the phoneme is selected instead of selecting the transformation function that is previously set for the phoneme despite the acoustic characteristics of the phoneme as in the conventional example. Therefore, even in the case of the same phoneme, while a spectrum (acoustic characteristic) of the phoneme varies depending on the context and emotions, the present invention can perform voice transformation on the phoneme having the spectrum continuously using optimum transformation function so that the voice characteristic of the phoneme can be appropriately transformed. In other words, a high-quality, voice-transformed speech can be obtained for insuring the validity of the transformed spectrum.

Also, in the present invention, the acoustic characteristics are indicated, in compact, by a representative value and a standard representative value. Therefore, when a transformation function is selected from the function storing unit, an appropriate transformation function can be selected easily and quickly without performing a complicated operational processing. For example, in the case where the acoustic characteristic is shown by a spectrum, it is necessary to compare a spectrum of a phoneme of the first voice characteristic with a spectrum of the phoneme in the function storing unit using complicated processing such as a pattern matching. In contrast, such processing load can be reduced in the present invention. Further, a standard representative value is stored in the function storing unit as an acoustic characteristic, so that a storing memory of the function storing unit can be reduced more than in the case where the spectrum is stored as the acoustic characteristic.

Here, the speech synthesis apparatus may further include a speech synthesizing unit which obtains text data, generates the speech elements indicating the same details as the text data, and stores the speech elements into the element storing unit.

In this case, the speech synthesis apparatus may include: an element representative value storing unit in which each speech element which makes up the speech of the first voice characteristic and a representative value of the acoustic characteristic of the speech element are stored in association with one another; an analyzing unit which obtains and analyzes the text data; and a selection storing unit which selects, based on an analysis result acquired by the analyzing unit, the speech element corresponding to the text data from the element representative value storing unit, and stores, into the element storing unit, the selected speech element and the representative value of the selected speech element by being associated with one another, and the representative value specifying unit specifies, for each speech element stored in the element storing unit, a representative value stored in association with the speech element.

Accordingly, the text data can be appropriately transformed to the speech of the second voice characteristic through the speech of the first voice characteristic.

Also, the speech synthesis apparatus may further include: a standard representative value storing unit in which the following is stored for each speech element of the speech of the first voice characteristic: the speech element; and a standard representative value indicating an acoustic characteristic of the speech element; a target representative value storing unit in which the following is stored for each speech element of the speech of the second voice characteristic: the speech element; and a target representative value showing an acoustic characteristic of the speech element; and a transformation function generating unit which generates, the transformation function corresponding to the standard representative value, based on the standard representative value and target representative value corresponding to the same speech element that are respectively stored in the standard representative value storing unit and the target representative value storing unit.

Accordingly, the transformation function is generated based on the standard representative value indicating an acoustic characteristic of the first voice characteristic and a target representative value indicating an acoustic characteristic of the second voice characteristic. Therefore, the first voice characteristic can be reliably transformed by preventing a degradation of voice characteristic due to a forcible voice transformation.

Here, the representative value and standard representative value indicating the acoustic characteristics may be values of formant frequencies at a time center of the phoneme.

In particular, since formant frequencies are stable in the time center of a vowel, the first voice characteristic can be appropriately transformed into the second voice characteristic.

Further, the representative value and standard representative value indicating the acoustic characteristics may be respectively average values of the formant frequencies of the phoneme.

In particular, since the average value of the formant frequency in a voiceless consonant appropriately shows an acoustic characteristic, the first voice characteristic can be appropriately transformed into the second voice characteristic.

Note that, the present invention can be realized not only as a speech synthesis apparatus, but also as a method for synthesizing speech, a program for causing a computer to synthesize speech based on the method, and as a recording medium on which the program is stored.

FURTHER INFORMATION ABOUT TECHNICAL BACKGROUND TO THIS APPLICATION

The disclosures of Japanese Patent Applications No. 2004-299365 filed on Oct. 13, 2004 and No. 2005-198926 filed on Jul. 7, 2005, and PCT Patent Application No. PCT/3P2005/017285 filed on Sep. 20, 2005, each of which includes a specification, drawings and claims, are incorporated herein by references in their entirety.

BRIEF DESCRIPTION OF THE DRAWINGS

These and other objects, advantages and features of the invention will become apparent from the following description thereof taken in conjunction with the accompanying drawings that illustrate a specific embodiment of the invention. In the drawings:

FIG. 25A is an explanatory diagram for explaining information stored in a base point database A according to the fourth embodiment of the present invention;

FIG. 25B is an explanatory diagram for explaining information stored in a base point database B according to the fourth embodiment of the present invention;

DESCRIPTION OF THE PREFERRED EMBODIMENTS

Hereafter, embodiments of the present invention are described with reference to drawings.

First Embodiment

Figure 1:
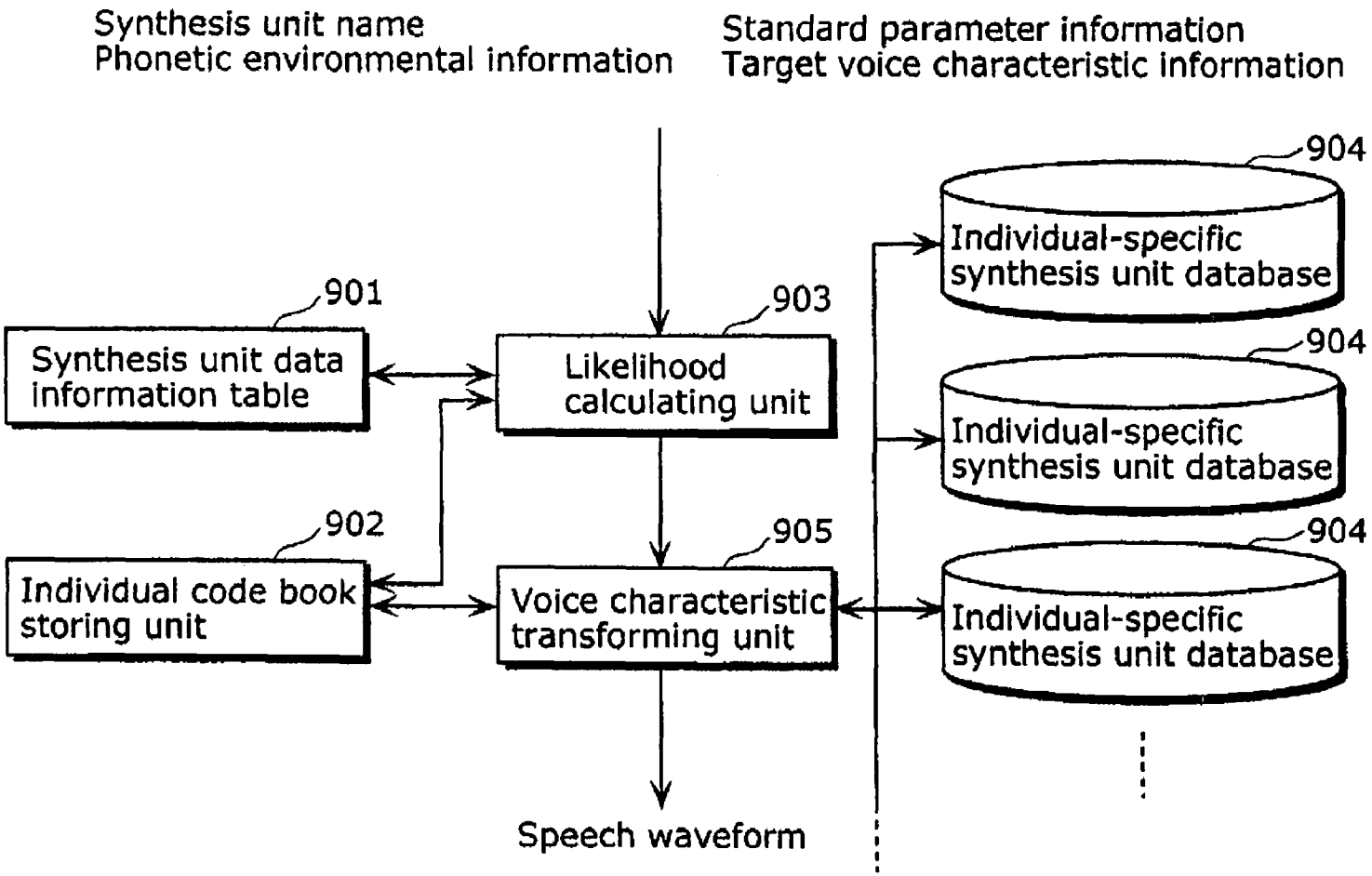
FIG. 1 PRIOR ART
FIG. 1 is a block diagram showing a structure of a speech synthesis apparatus disclosed in the patent reference 1.
Figure 2:
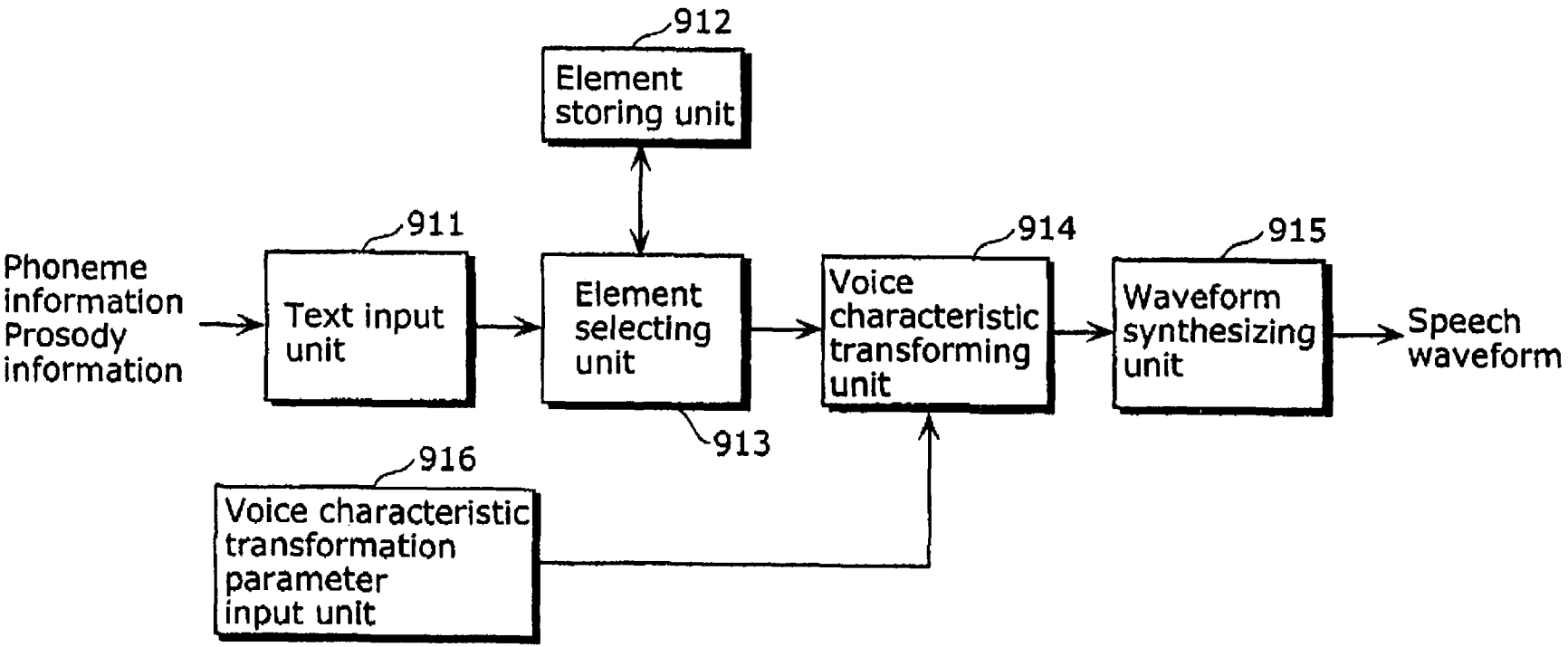
FIG. 2 PRIOR ART
FIG. 2 is a block diagram showing a structure of a speech synthesis apparatus disclosed in the patent reference 2.
Figure 3:
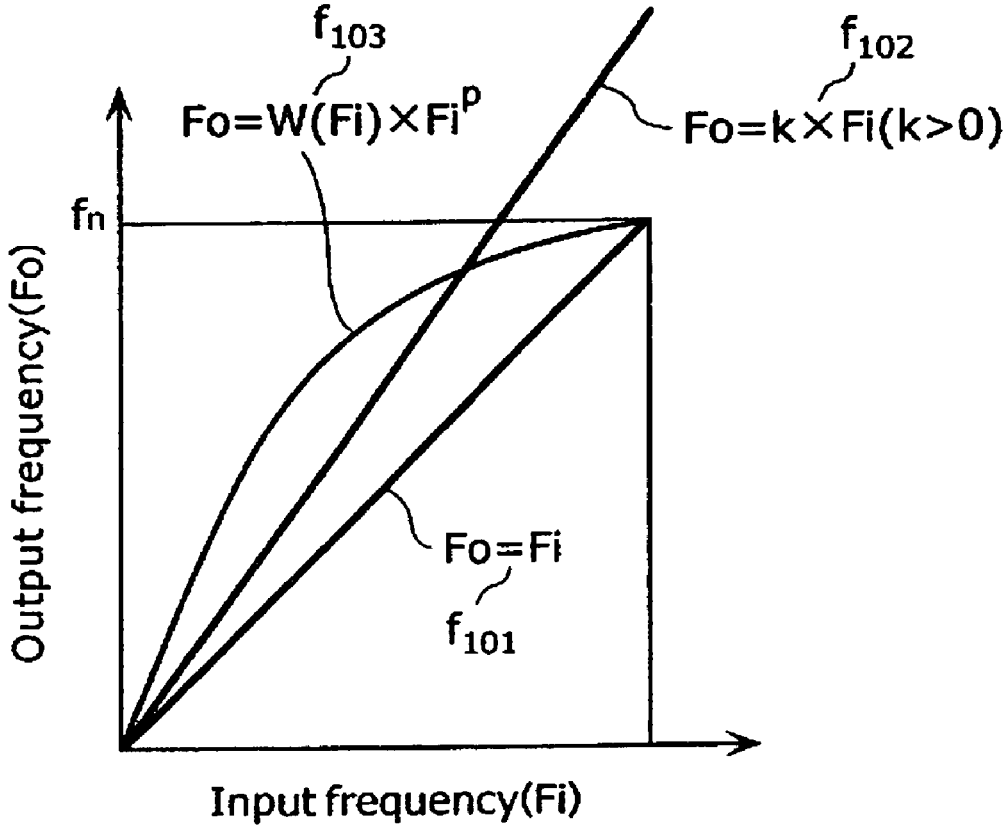
FIG. 3 PRIOR ART
FIG. 3 is an explanatory diagram for explaining a transformation function used for a voice characteristic transformation of a speech element performed by a voice characteristic transforming unit disclosed in the patent reference 2.
Figure 4:
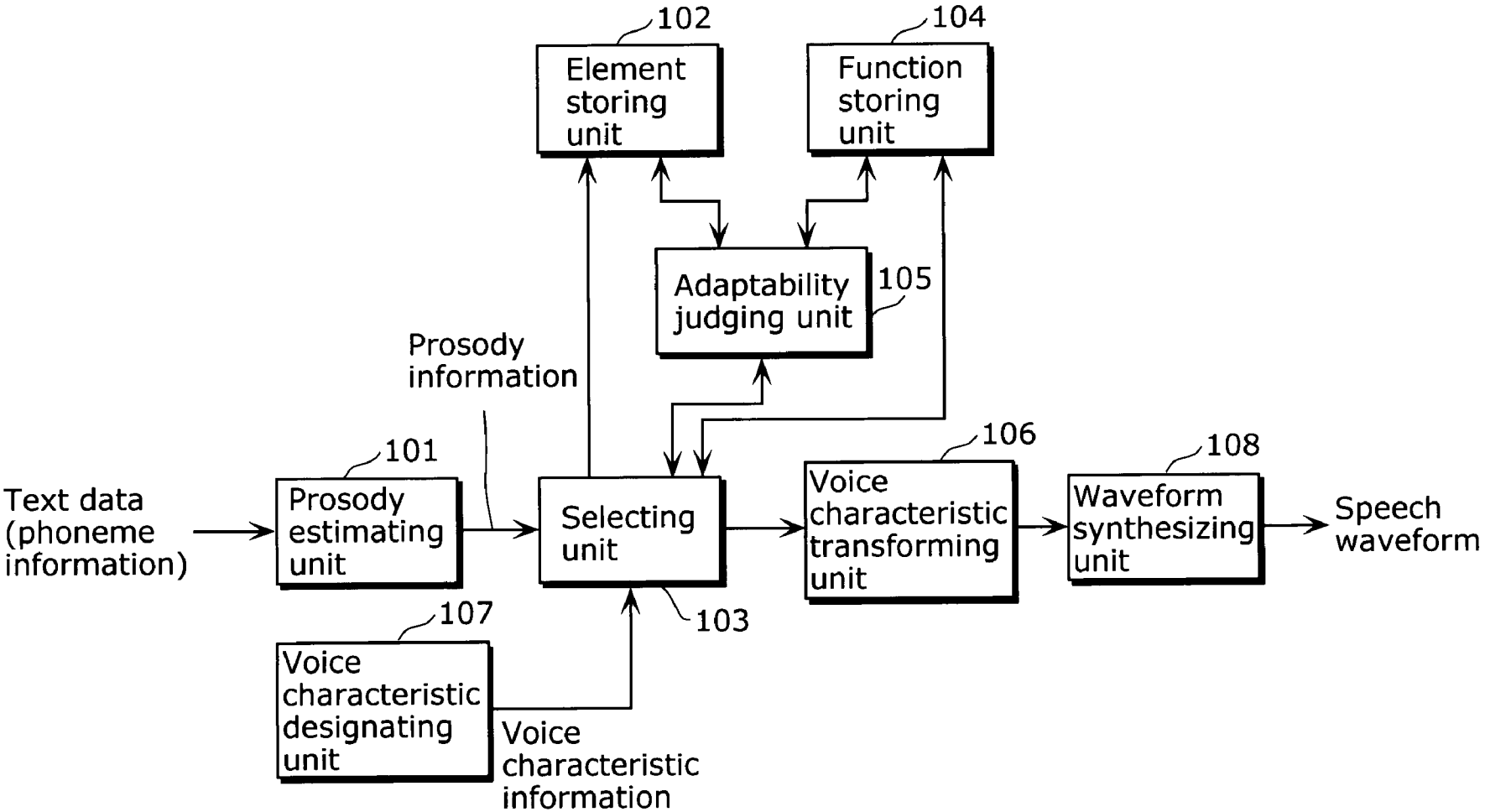
FIG. 4 is a block diagram showing a structure of a speech synthesis apparatus according to a first embodiment of the present invention.

FIG. 4 is a block diagram showing a structure of a speech synthesis apparatus according to the first embodiment of the present invention.

The speech synthesis apparatus according to the present embodiment can appropriately transform a voice characteristic, and includes, as constituents, a prosody predicting (estimating) unit 101, an element storing unit 102, a selecting unit 103, a function storing unit 104, an adaptability judging unit 105, a voice characteristic transforming unit 106, a voice characteristic designating unit 107 and a waveform synthesizing unit 108.

The element storing unit 102 is configured as an element storing unit, and holds information indicating plural types of speech elements. The speech elements are stored by a unit-by-unit basis such as a phoneme, a syllable and a mora, based on the speech recorded in advance. Note that, the element storing unit 102 may hold the speech elements as a speech waveform or as an analysis parameter.

The function storing unit 104 is configured as a function storing unit, and holds transformation functions for performing voice characteristic transformation on the respective speech elements stored in the element storing unit 102.

These transformation functions are associated with voice characteristics that are transformible by the transformation functions. For example, a transformation function is associated with a voice characteristic showing an emotion such as "anger", "pleasure" and "sadness". Also, a transformation function is associated with a voice characteristic showing a speech style and the like, such as "DJ-like" or "announcer-like".

A unit for applying a transformation function to is, for example, a speech element, a phoneme, a syllabus, a mora, an accent phrase and the like.

A transformation function is generated using, for example, a modification ratio or a difference value of a formant frequency, a modification ratio or a difference value of power, a modification ratio or a difference value of a fundamental frequency, and the like. Also, a transformation function may be a function that modifies each of the formant, power, fundamental frequency and the like, at the same time.

Further, a range of speech elements that can be applied to a transformation function is previously set in the transformation function. For example, when the transformation function is applied to a predetermined speech element, the adaptation result is learned and it is set so that the predetermined speech element is included in the adaptation range of the transformation function.

Furthermore, for the transformation function of the voice characteristic indicating an emotion such as "anger", a consecutive transformation of voice characteristic can be realized by interpolating the voice characteristic by changing the variation.

The prosody predicting unit 101 is configured as a generating unit, and obtains text data generated, for example, based on a manipulation by a user. The prosody predicting unit 101 then, based on the phoneme information indicating each phoneme in the text data, predicts, for each phoneme, prosodic characteristics (prosody) such as a phoneme environment, a fundamental frequency, a duration length and power, and generates prosody information indicating the phoneme and the prosody. The prosody information is treated as a target of synthesized speech to be outputted in the end. The prosody predicting unit 101 outputs the prosody information to the selecting unit 103. Note that, the prosody predicting unit 101 may obtain morpheme information, accent information and syntax information other than the phoneme information.

The adaptability judging unit 105 is configured as a similarity deriving unit, and judges a degree of adaptability between a speech element stored in the element storing unit 102 and a transformation function stored in the function storing unit 104.

The voice characteristic designating unit 107 is configured as a voice characteristic designating unit, obtains a voice characteristic of the synthesized speech designated by the user, and outputs voice characteristic information indicating the voice characteristic. The voice characteristic indicates, for example, the emotion such as "anger", "pleasure" and "sadness", the speech style such as "DJ-like" and "announcer-like", and the like.

The selecting unit 103 is configured as a selecting unit, and selects an optimum speech element from the element storing unit 102 and an optimum transformation function from the function storing unit 104 based on the prosody information outputted from the prosody predicting unit 101, the voice characteristic outputted from the voice characteristic designating unit 107 and the adaptability judged by the adaptability judging unit 105. In other words, the selecting unit 103 complementary selects the optimum speech element and transformation function based on the adaptability.

The voice characteristic transforming unit 106 is configured as an applying unit, and applies the transformation function selected by the selecting unit 103 to the speech element selected by the selecting unit 103. In other words, the voice characteristic transforming unit 106 generates a speech element of the voice characteristic designated by the voice characteristic designating unit 107 by transforming the speech element using the transformation function. In the present embodiment, a transforming unit is made up of the voice characteristic transforming unit 106 and the selecting unit 103.

The waveform synthesizing unit 108 generates and outputs a speech waveform from the speech element transformed by the voice characteristic transforming unit 106. For example, the waveform synthesizing unit 108 generates a speech waveform by a waveform connection type speech synthesis method and an analysis synthesis type speech synthesis method.

In such speech synthesis apparatus, in the case where the phoneme information included in the text data indicates a series of phonemes and prosodies, the selecting unit 103 selects a series of speech elements (speech element series) corresponding to the phoneme information from the element storing unit 102, and selects a series of transformation functions (transformation function series) corresponding to the phoneme information from the function storing unit 104. The voice characteristic transforming unit 106 then processes each of the speech elements and the transformation functions included respectively in the speech element series and the transformation function series that are selected by the selecting unit 103. The waveform synthesizing unit 108 also generates and outputs a speech waveform from the series of speech elements transformed by the voice characteristic transforming unit 106.

Figure 5:
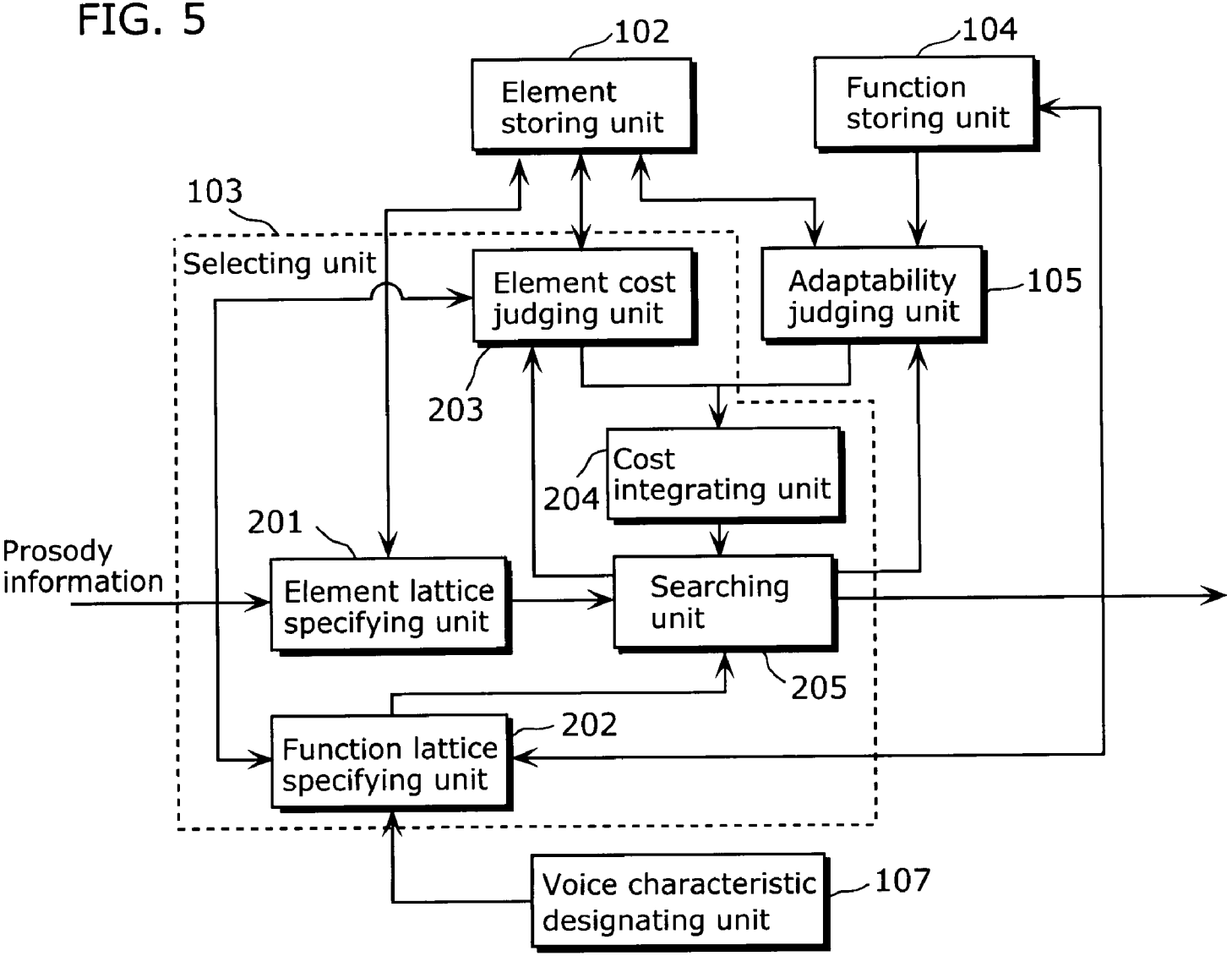
FIG. 5 is a block diagram showing a structure of a selecting unit according to the first embodiment of the present invention.

FIG. 5 is a block diagram showing a structure of the selecting unit 103.

The selecting unit 103 includes an element lattice specifying unit 201, a function lattice specifying unit 202, an element cost judging unit 203, a cost integrating unit 204 and a searching unit 205.

The element lattice specifying unit 201 specifies, based on the prosody information outputted by the prosody predicting unit 101, some candidates for the speech element to be selected in the end, from among the speech elements stored in the element storing unit 102.

For example, the element lattice specifying unit 201 specifies, all as candidates, speech elements indicating the same phoneme included in the prosody information. Or, the element lattice specifying unit 201 specifies, as candidates, speech elements whose degree of similarity between the phoneme and prosody included in the prosody information is within the predetermined threshold (e.g., a difference of fundamental frequencies is within 20 Hz, etc.).

The function lattice specifying unit 202 specifies, based on the prosody information and the voice characteristic information outputted from the voice characteristic designating unit 107, some candidates for the transformation functions to be selected in the end, from among the transformation functions stored in the function storing unit 104.

For example, the function lattice specifying unit 202 specifies the phoneme included in the prosody information as a target to be applied and the transformation function, as a candidate, which is transformible to the voice characteristic (e.g., a voice characteristic of "anger") indicated in the voice characteristic information.

The element cost judging unit 203 judges an element cost of the speech element candidate specified by the element lattice specifying unit 201 and the prosody information.

For example, the element cost judging unit 203 judges the element cost using, as a likelihood, the degree of similarity between the prosody predicted by the prosody predicting unit 101 and a prosody of the speech element candidates, and a smoothness near the connection boundary when the speech elements are connected.

The cost integrating unit 204 integrates the degree of adaptability judged by the adaptability judging unit 105 and the element cost judged by the element cost judging unit 203.

The searching unit 205 selects a speech element and a transformation function so as to have the minimum value of the cost calculated by the cost integrating unit 204, from among the speech element candidates specified by the element lattice specifying unit 201 and the transformation function candidates specified by the function lattice specifying unit 202.

Hereafter, the selecting unit 103 and the adaptability judging unit 105 are described in detail.

Figure 6:
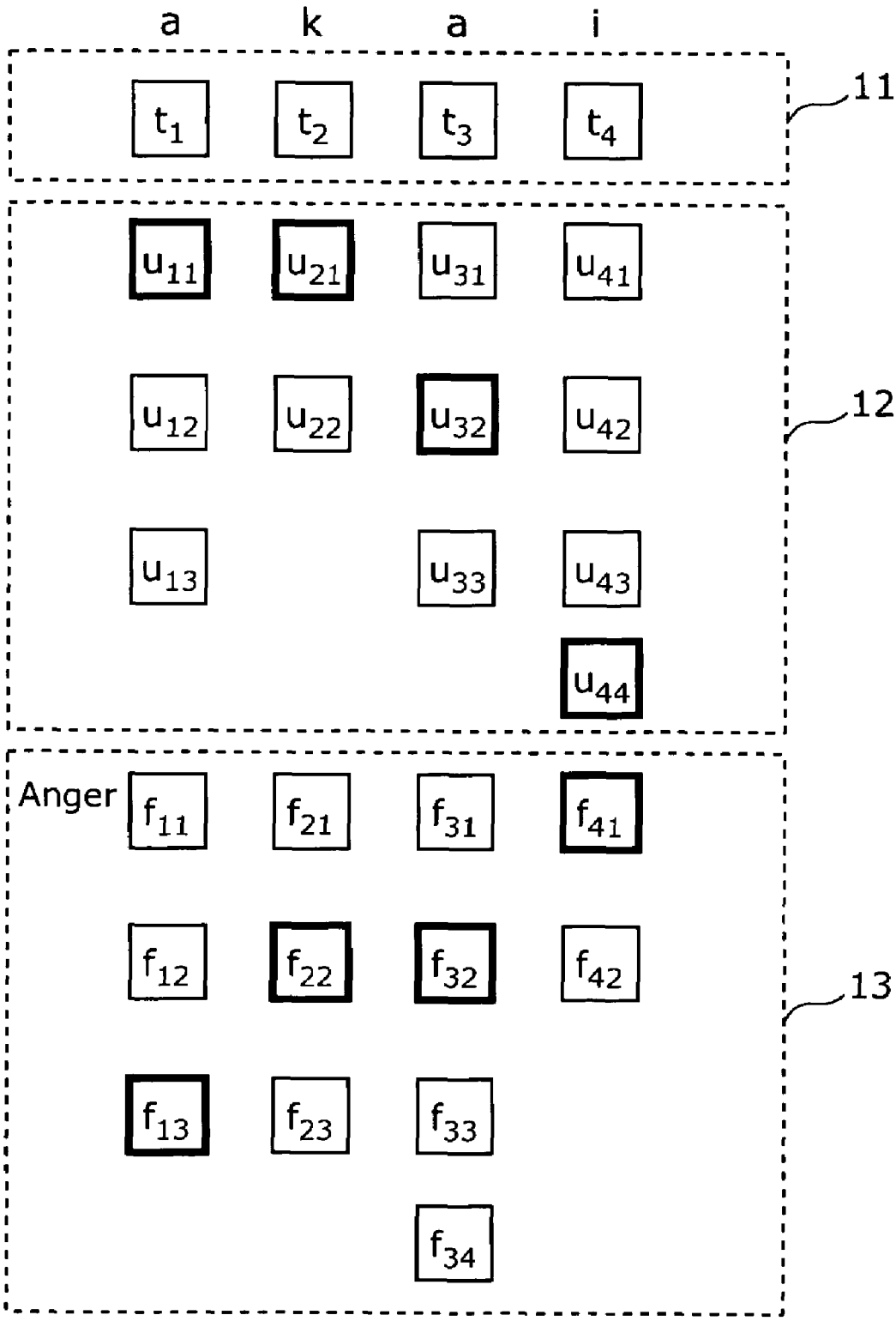
FIG. 6 is an explanatory diagram for explaining an operation of an element lattice specifying unit and a function lattice specifying unit according to the first embodiment of the present invention.

FIG. 6 is an explanatory diagram for explaining operations of the element lattice specifying unit 201 and the function lattice specifying unit 202.

For example, the prosody predicting unit 101 obtains text data (phoneme information) indicating "akai", and outputs a prosody information set 11 including phonemes and prosodies included in the phoneme information. The prosody information set 11 includes: prosody information $t_1$ indicating a phoneme "a" and a prosody corresponding to the phoneme "a"; prosody information $t_2$ indicating a phoneme "k" and a prosody corresponding to the phoneme "k"; prosody information $t_3$ indicating a phoneme "a" and a prosody corresponding to the phoneme "a"; and prosody information $t_4$ indicating a phoneme "i" and a prosody corresponding to the phoneme "i".

The element lattice specifying unit 201 obtains the prosody information set 11 and specifies the speech element candidate set 12. The speech element candidate set 12 includes: speech element candidates $u_{11}$, $u_{12}$, and $u_{13}$ for the phoneme "a"; speech element candidates $u_{21}$ and $u_{22}$ for the phoneme "k"; speech element candidates $u_{31}$, $u_{32}$ and $u_{33}$ for the phoneme "a"; and speech element candidates $u_{41}$, $u_{42}$, $u_{43}$ and $u_{44}$ for the phoneme "i".

The function lattice specifying unit 202 obtains the prosody information set 11 and the voice characteristic information, and specifies the transformation function candidate set 13 that is, for example, associated with the voice characteristic of "anger". The transformation function candidate set 13 includes: transformation function candidates $f_{11}$, $f_{12}$ and $f_{13}$ for the phoneme "a"; transformation function candidates $f_{21}$, $f_{22}$ and $f_{23}$ for the phoneme "k"; transformation function candidates $f_{31}$, $f_{32}$, $f_{33}$ and $f_{34}$ for the phoneme "a"; and transformation function candidates $f_{41}$ and $f_{42}$ for the phoneme "i".

The element cost judging unit 203 calculates the element cost ucost $(t_i, u_{ij})$ indicating the likelihood of the speech element candidates specified by the element lattice specifying unit 201. The element cost $(t_i, u_{ij})$ is a cost judged by the degree of similarity between the prosody information $t_i$ and speech element candidates $u_{ij}$ that should be included in the phonemes predicted by the prosody predicting unit 101.

Here, the prosody information $t_i$ shows a phoneme environment, a fundamental frequency, a duration length, power and the like of the i-th phoneme in the phoneme information predicted by the prosody predicting unit 101. Also, the speech element candidate $u_{ij}$ is the j-th speech element candidate of the i-the phoneme.

For example, the element cost judging unit 203 calculates an element cost which is obtained by integrating an agreement degree of the prosody environment, a fundamental frequency error, a duration length error, a power error, a connection distortion generated when speech elements are connected to each other, and the like.

The adaptability judging unit 105 calculates a degree of adaptability fcost ($u_{ij}$, $f_{ik}$) between the speech element candidate $u_{ij}$ and the transformation function candidate $f_{ik}$. Here, the transformation function candidate $f_{ik}$ is the k-th transformation function candidate for the i-th phoneme. This degree of adaptability fcost ($u_{ij}$, $f_{ik}$) is defined by the following equation 1.

$$f\cos t(u_{ij},f_{ik})=\text{static_cos}\ t(u_{ij},f_{ik})+\text{dynamic_cos}\ t(u_{(i-1)j},u_{ij},u_{(i+1)j},f_{ik}) \quad \text{(equation 1)}$$

Here, static_cost($u_{ij}$, $f_{ik}$) is a static degree of adaptability (a degree of similarity) between the speech element candidate $u_{ij}$ (an acoustic characteristic of the speech element candidate $u_{ij}$) and the transformation function candidate $f_{ik}$ (an acoustic characteristic of the speech element used for generating the transformation function candidate $f_{ik}$). Such static degree of adaptability is, for example, indicated as the degree of similarity between the acoustic characteristic of the speech element used for generating the transformation function candidate, in other words, between the acoustic characteristic predicted that a transformation function can be appropriately adapted (e.g., a formant frequency, a fundamental frequency, power, a cepstrum coefficient, etc.) and the acoustic characteristic of the speech element candidate.

Note that, the degree of static adaptability is not limited to the aforementioned example, but a type of a degree of similarity between a speech element and a transformation function may only be necessary to be used. Also, in the case where the degree of static adaptability is calculated by calculating, in advance, the degree of static adaptability for all speech elements and transformation functions offline and associating each speech element with a transformation function with higher degree of adaptability, only the transformation function that is associated with the speech element may be targeted.

On the other hand, dynamic_cost($u_{(i-1)j}$, $u_{ij}$, $u_{(i+1)j}$, $f_{ik}$) is a degree of dynamic adaptability, and is a degree of adaptability to before-and-after environments of the targeted transformation function candidate $f_{ik}$ and the speech element candidate $u_{ij}$.

Figure 7:
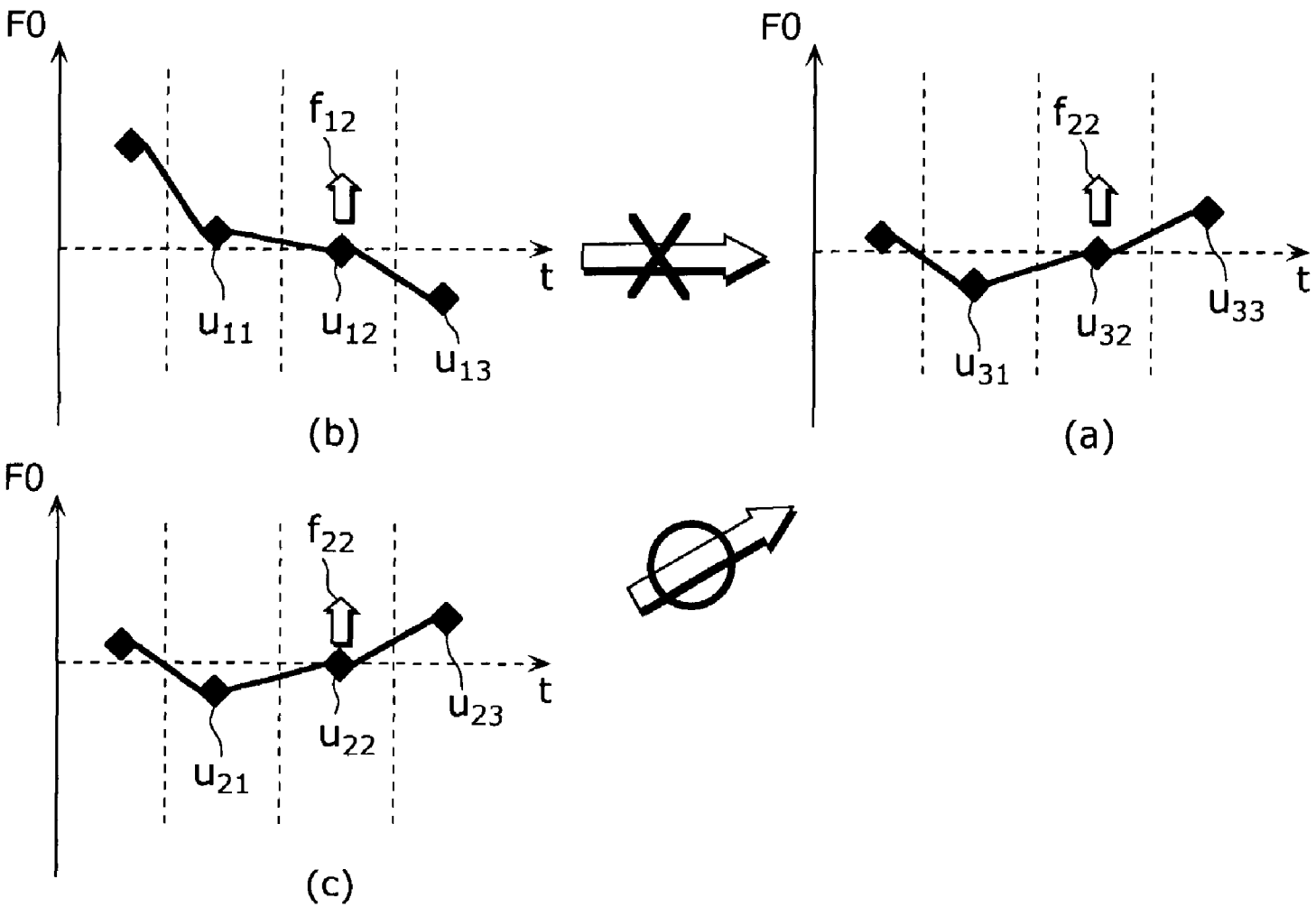
FIG. 7 is an explanatory diagram for explaining a dynamic degree of adaptability in the first embodiment of the present invention.

FIG. 7 is an explanatory diagram for explaining the dynamic degree of adaptability.

The dynamic degree of adaptability is calculated, for example, based on learning data.

A transformation function is learned (generated) from a difference value between the speech elements of ordinary speech and the speech elements vocalized based on an emotion and a speech style.

For example, as shown in (b) of FIG. 7, the learning data indicates that a transformation function $F_{12}$ which raises a fundamental frequency $F_0$ for a speech element candidate $u_{12}$ from among the series of the speech element candidates (series) $u_{11}$, $u_{12}$ and $u_{13}$. Also, as shown in (c) of FIG. 7, the learning data indicates that a transformation function $F_{22}$ which raises the fundamental frequency $F_0$ for the speech element candidate $u_{22}$ from among the series of the speech element candidates (series) $u_{21}$, $u_{22}$ and $u_{23}$. The adaptability judging unit 105 judges a degree of adaptability (degree of similarity) between the before-and-after speech element environment ($u_{31}$, $u_{32}$, $u_{33}$) including $u_{32}$ and the learning data environment ($u_{11}$, $u_{12}$, $u_{13}$ and $u_{21}$, $u_{22}$, $u_{23}$) of the transformation function candidates ($f_{12}$, $f_{22}$), in the case of selecting a transformation function for the speech element candidate $u_{32}$ as shown in (a) of FIG. 7.

As in the case of FIG. 7, the fundamental frequency $F_0$ increases as the time t passes in the environment shown by the learning data in (a). Therefore, the adaptability judging unit 105, as the learning data in (c) shows, judges that the transformation function $f_{22}$ which is learned (generated) in the environment where the fundamental frequency $F_0$ increases has a higher degree of dynamic adaptability (the value of dynamic_cost is small).

Specifically, the speech element candidate $u_{32}$ shown in (a) of FIG. 7 is in the environment where the fundamental frequency $F_0$ increases as the time t passes. Therefore, the adaptability judging unit 105 calculates: so that the degree of dynamic adaptability of the transformation function $f_{12}$ learned in the environment where the fundamental frequency $F_0$ decreases becomes a smaller value; and so that the degree of dynamic adaptability of the transformation function $f_{22}$ learned in the environment where the fundamental frequency $F_0$ increases as shown in (c) becomes a higher value.

In other words, the adaptability judging unit 105 judges that the transformation function $f_{22}$ which further urges an increase of the fundamental frequency $F_0$ in the before-and-after environment has a higher degree of adaptability to the before-and-after environment shown in (a) of FIG. 7 than the transformation function $f_{12}$ which restrains the reduction of the fundamental frequency $F_0$ in the before-and-after environment. That is, the adaptability judging unit 105 judges that the transformation function $f_{22}$ should be selected for the speech element candidate $u_{32}$. On the other hand, if the transformation function $f_{12}$ is selected, the transformation characteristic of the transformation function $f_{22}$ cannot be reflected to the speech element candidate $u_{32}$. Also, it can be said that the dynamic degree of adaptability is a degree of similarity between the dynamic characteristic of the series of speech elements to which the transformation function candidate $f_{ik}$ is applied (the series of speech elements used for generating the transformation function candidate $f_{ik}$) and the dynamic characteristic of the series of speech element candidate $u_{ij}$.

Note that, while the dynamic characteristic of the fundamental frequency $F_0$ is used in FIG. 7, the present invention is not limited to only the above characteristic, but the following may also be used, for example, power, a duration length, a formant frequency, a cepstrum coefficient, and the like. In addition, the dynamic degree of adaptability may be calculated not only by using the power and the like as a single unit, but by combining the fundamental frequency, power, duration length, formant frequency, cepstrum coefficient and the like.

The cost integrating unit 204 calculates an integrated cost manage_cost ($t_i$, $u_{ij}$, $f_{ik}$). This integrated cost is defined by the following equation 2.

$$\text{manage_cos}\ t(t_i,u_{ij},f_{ik})=u\cos t(t_i,u_{ij})+f\cos t(u_{ij},f_{ik}) \quad \text{(Equation 2)}$$

Note that, in the equation 2, the element cost ucost ($t_i$, $u_{ij}$) and the degree of adaptability fcost ($u_{ij}$, $f_{ik}$) are evenly summed to each other. However, they may be summed by respectively adding weights.

The searching unit 205 selects a speech element series U and a transformation function series F, from among the speech element candidates and the transformation function candidates respectively specified by the element lattice specifying unit 201 and the function lattice specifying unit 202, so that a summed value of the integrated cost calculated by the cost integrating unit 204 is the minimum value. For example, as shown in FIG. 6, the searching unit 205 selects the speech element series U ($u_{11}$, $u_{21}$, $U_{32}$, $U_{44}$) and the transformation function series F ($f_{13}$, $f_{22}$, $f_{32}$, $f_{41}$).

Specifically, the searching unit 205 selects the speech element series U and the transformation function series F based on the following equation 3. Here, n indicates the number of phonemes included in the phoneme information.

$$U,F=\mathrm{argmin}\ \Sigma\mathrm{manage_cos}\ t(t_i,u_{ij},f_{ik}) \qquad \text{(Equation 3)}$$

u, f i=1, 2, . . . , n

Figure 8:
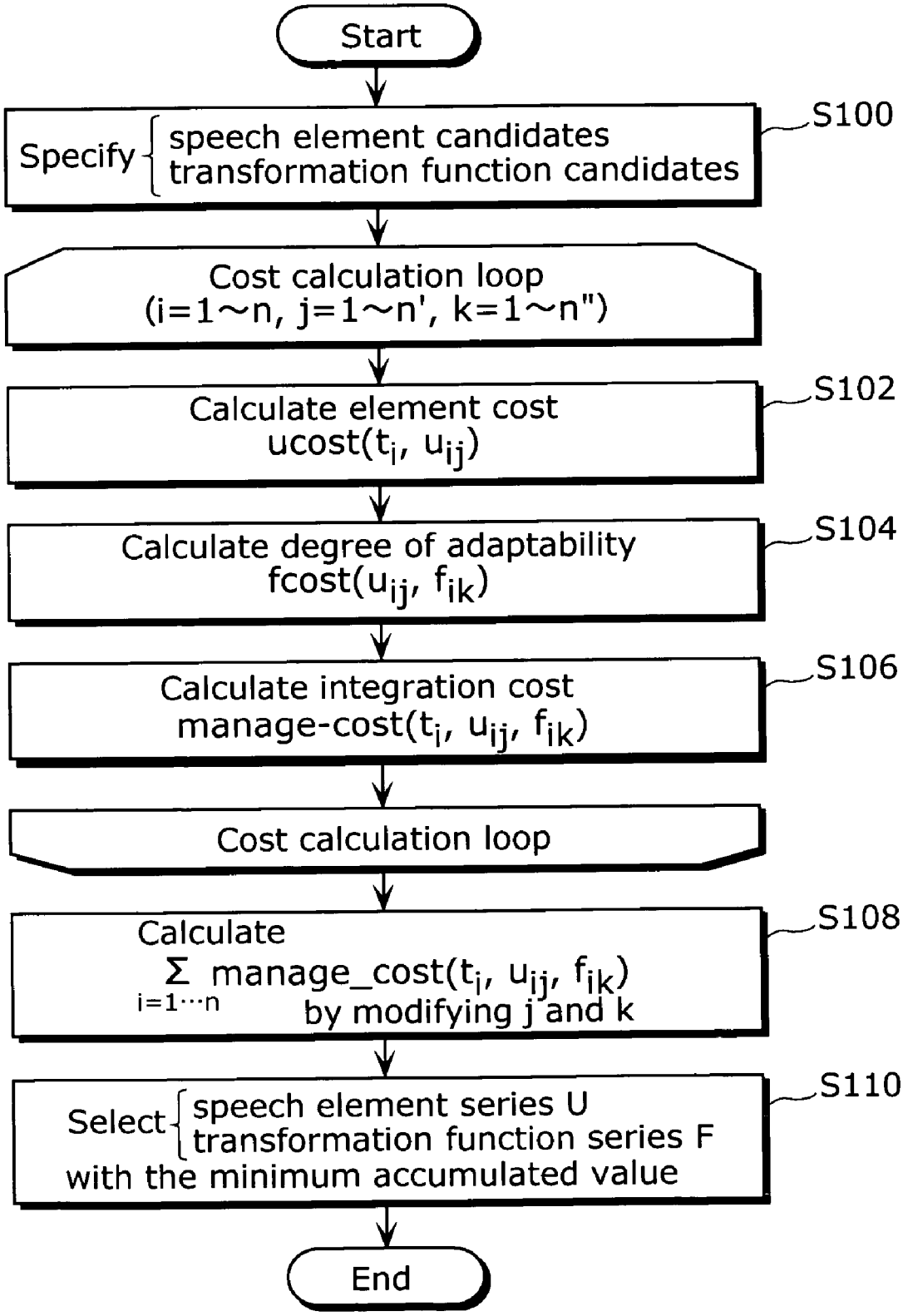
FIG. 8 is a flowchart showing an operation of a selecting unit in the first embodiment of the present invention.

FIG. 8 is a flowchart showing an operation of the selecting unit 103.

First, the selecting unit 103 specifies some speech element candidates and some transformation function candidates (Step S100). Next, the selecting unit 103 calculates an integrated cost manage_cost ($t_i$, $u_{ij}$, $f_{ik}$) for respective combinations of n-prosody information $t_i$, n'-speech element candidates for respective prosody information $t_i$, and *n*"-transformation function candidates for respective prosody information $t_i$ (Steps S102 to S106).

The selecting unit 103 first calculates an element cost ucost ($t_1$, $u_{ij}$) (Step S102) and calculates a degree of adaptability fcost ($u_{ij}$, $f_{ik}$) (Step S104), in order to calculate the integrated cost. The selecting unit 103 then calculates the integrated cost manage_cost ($t_1$, $u_{ij}$, $f_{ik}$) by summing the element cost ucost ($t_1$, $u_{ij}$) and the degree of adaptability fcost ($u_{ij}$, $f_{ik}$) that are calculated in Steps S102 and S104. Such calculation of the integrated cost is performed for each combination of i, j and k by the searching unit 205 of the selecting unit 103 to instruct the element cost judging unit 203 and the adaptability judging unit 105 to modify the i, j and k.

The selecting unit 103 then sums each integrated cost manage_cost ($t_i$, $u_{ij}$, $f_{ik}$) for i=1~n by modifying j and k in the range of n' and n" (Step S108). The selecting unit 103 then selects a speech element series U and a transformation function series F so as to have the minimum summed value (Step S110).

Note that, in FIG. 8, the selecting unit 103 selects the speech element series U and the transformation function series F so as to have the minimum summed value after calculating the cost value in advance. However, the selecting unit 103 may also select the speech element series U and the transformation function series F using a Viterbi algorithm used for a searching problem.

Figure 9:
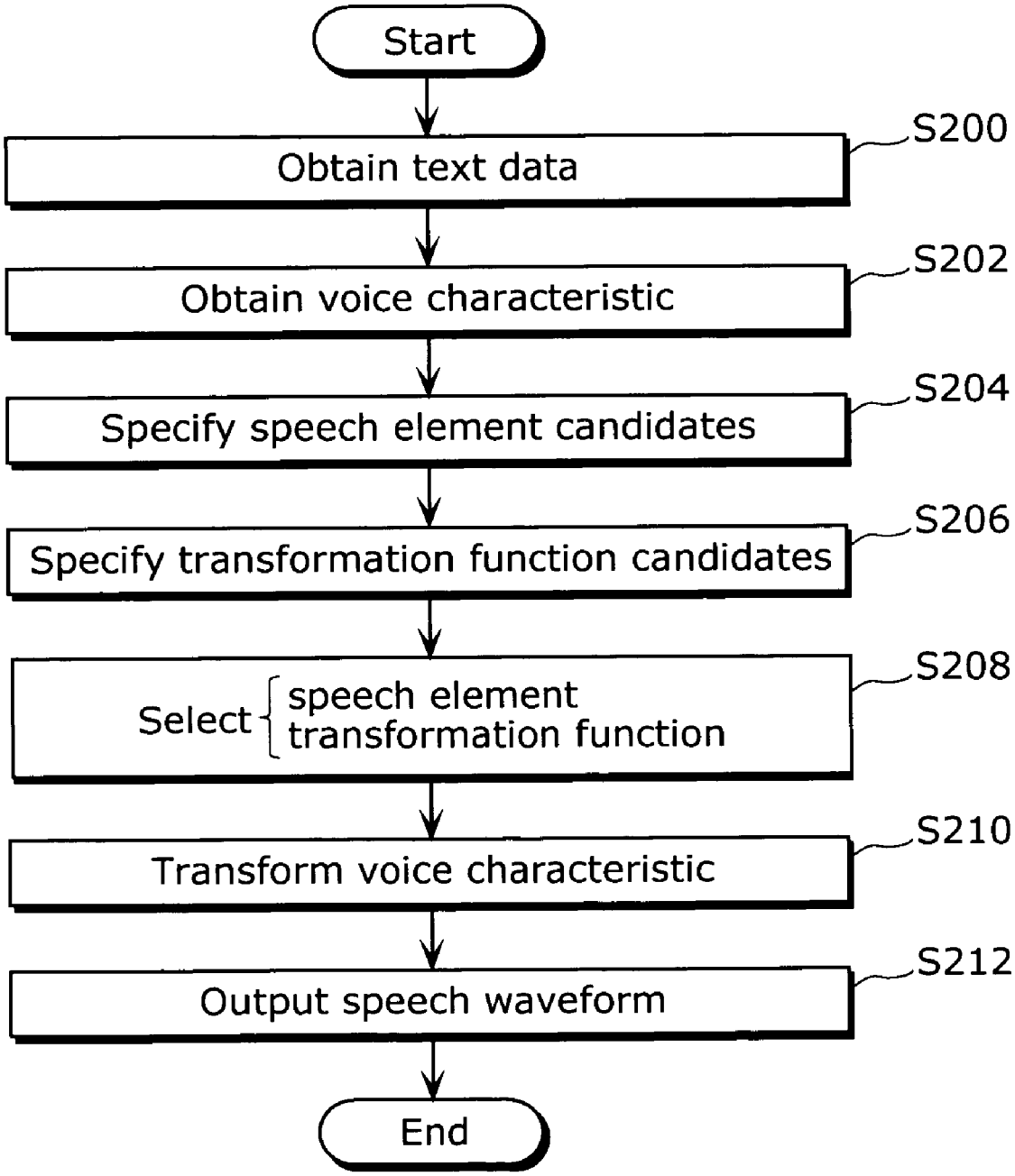
FIG. 9 is a flowchart showing an operation of the speech synthesis apparatus according to the first embodiment of the present invention.

FIG. 9 is a flowchart showing an operation of the speech synthesis apparatus according to the present embodiment.

The prosody predicting unit 101 of the speech synthesis apparatus obtains text data including the phoneme information, and predicts, based on the phoneme information, prosodic characteristics (prosody) such as a fundamental frequency, a duration, power and the like to be included in each phoneme (Step S200). For example, the prosody predicting unit 101 performs prediction using quantification theory I.

Next, the voice characteristic designating unit 107 of the speech synthesis apparatus obtains a voice characteristic of the synthesized speech designated by the user, for example, the voice characteristic of "anger" (Step S202).

The selecting unit 103 of the speech synthesis apparatus, based on the prosody information indicating a prediction result by the prosody predicting unit 101 and the voice characteristic obtained by the voice characteristic designating unit 107, specifies speech element candidates from the element storing unit 102 (Step S204) and specifies the transformation function candidates indicating the voice characteristic of "anger" from the function storing unit 104 (Step S206). The selecting unit 103 then selects a speech element and a transformation function so as to have a minimum integration cost from among the specified speech element candidates and transformation function candidates (Step S208). In other words, in the case where the phoneme information indicates a series of phonemes, the selecting unit 103 selects the speech element series U and the transformation function series F so as to have a minimum summed value of the integration cost.

After that, the voice characteristic transforming unit 106 of the speech synthesis apparatus performs voice characteristic transformation by applying the transformation function series F to the speech element series U selected in Step S208 (Step S210). The waveform synthesizing unit 108 of the speech synthesis apparatus generates and outputs a speech waveform from the speech element series U whose voice characteristic is transformed by the voice characteristic transforming unit 106 (Step S212).

Thus, in the present embodiment, an optimum transformation function is applied to each phoneme element so that the voice characteristic can be appropriately transformed.

Here, the effects in the present embodiment are explained in detail in comparison with the related art (Japanese Laid-Open Patent Application No. 2002-215198).

The speech synthesis apparatus of the related art generates a spectrum envelope transformation table (transformation function) for each category such as a vowel, a consonant and the like, and applies, to a speech element belonging to a category, a spectrum envelope transformation table set for the category.

However, when the spectrum envelope transformation table which represents the category is applied to all speech elements within the category, there are problems caused, for example, that a plurality of formant frequencies become too close to each other in the transformed speech, and that the frequency of the transformed speech exceeds the Nyquist frequency.

In specific, the aforementioned problems are explained with reference to FIG. 10 and FIG. 11.

Figure 10:
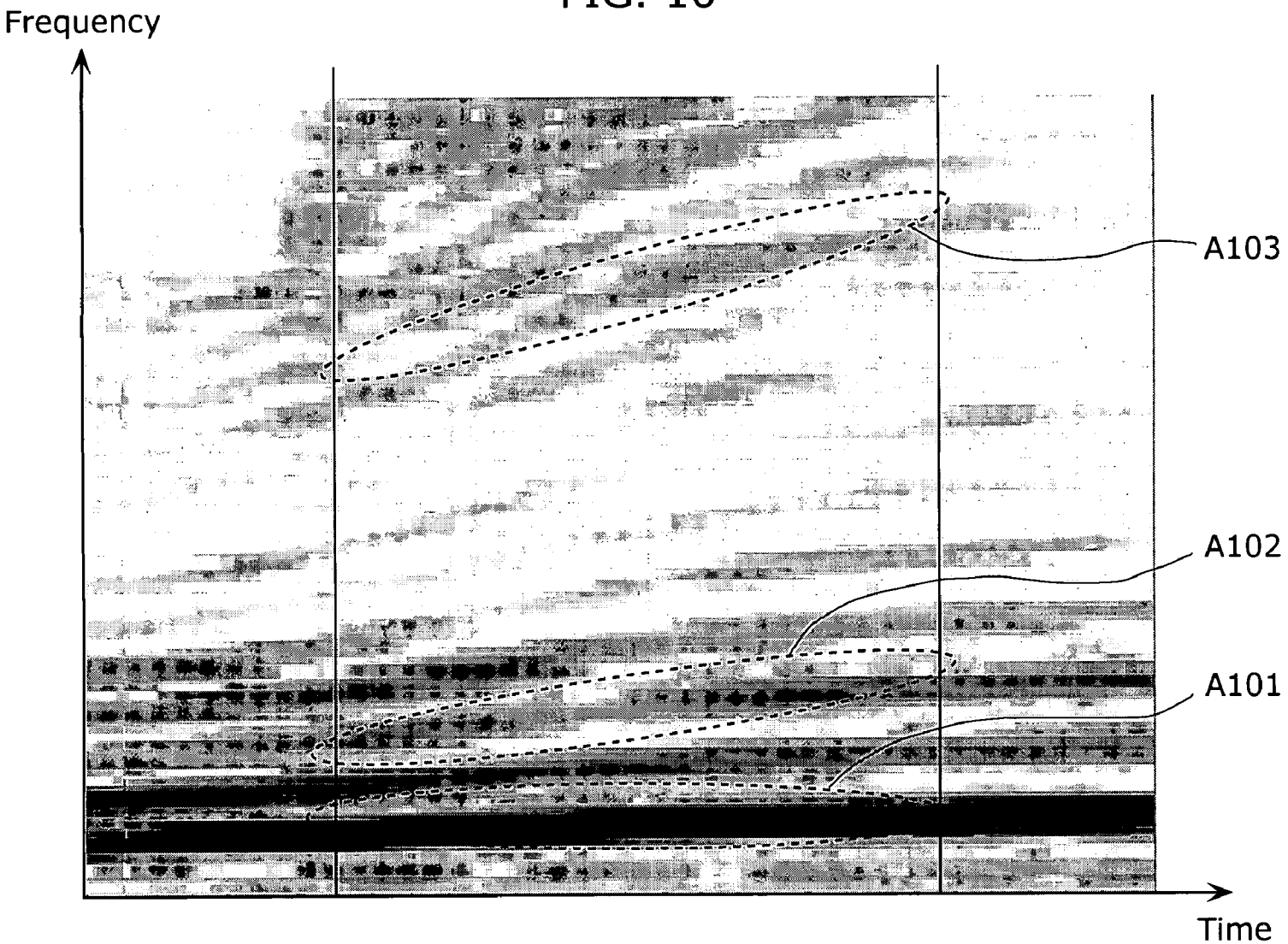
FIG. 10 is a diagram showing a spectrum of speech of a vowel /i/.

FIG. 10 is a diagram showing a speech spectrum of a vowel /i/. In FIG. 10, A101, A102 and A103 indicate portions where spectrum intensity is high (peaks of the spectrum).

Figure 11:
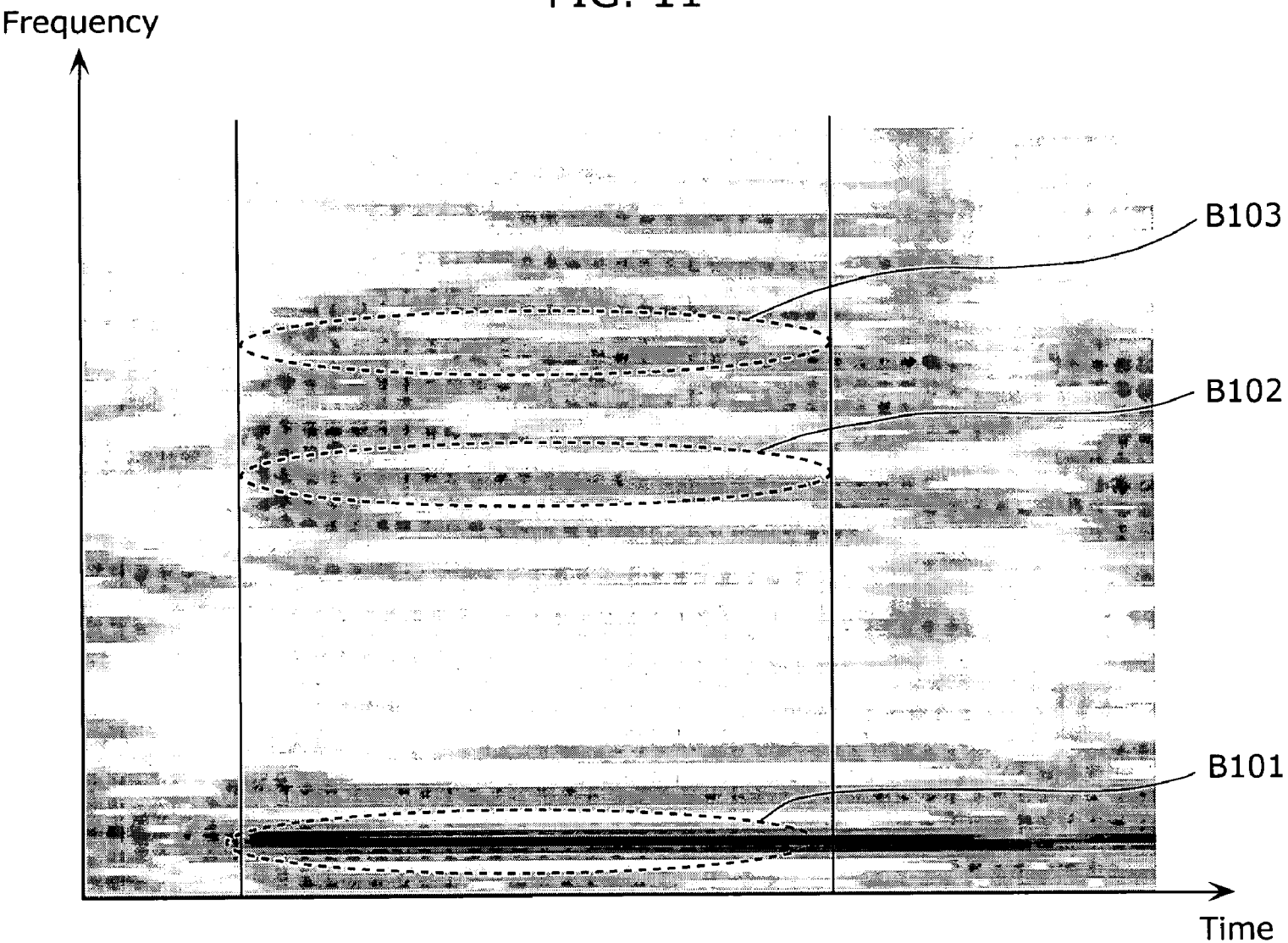
FIG. 11 is a diagram showing a spectrum of another speech of a vowel /i/.

FIG. 11 is a diagram showing another speech spectrum of the vowel /i/.

In FIG. 11 as in the case of FIG. 10, B101, B102 and B103 show portions where spectrum intensity is high.

As shown in such FIG. 10 and FIG. 11, even in the case of the same vowel /i/, a shape of the spectrum may largely differ.

Accordingly, in the case where a spectrum envelope transformation table is generated based on the speech (speech elements) representing the category, if the spectrum envelope transformation table is applied to a speech element whose spectrum largely differs from the spectrum of the representative speech element, a pre-estimated voice characteristic transformation effect may not be obtained.

A more specific example is explained with reference to FIGS. 12A and 12B.

Figure 12A:
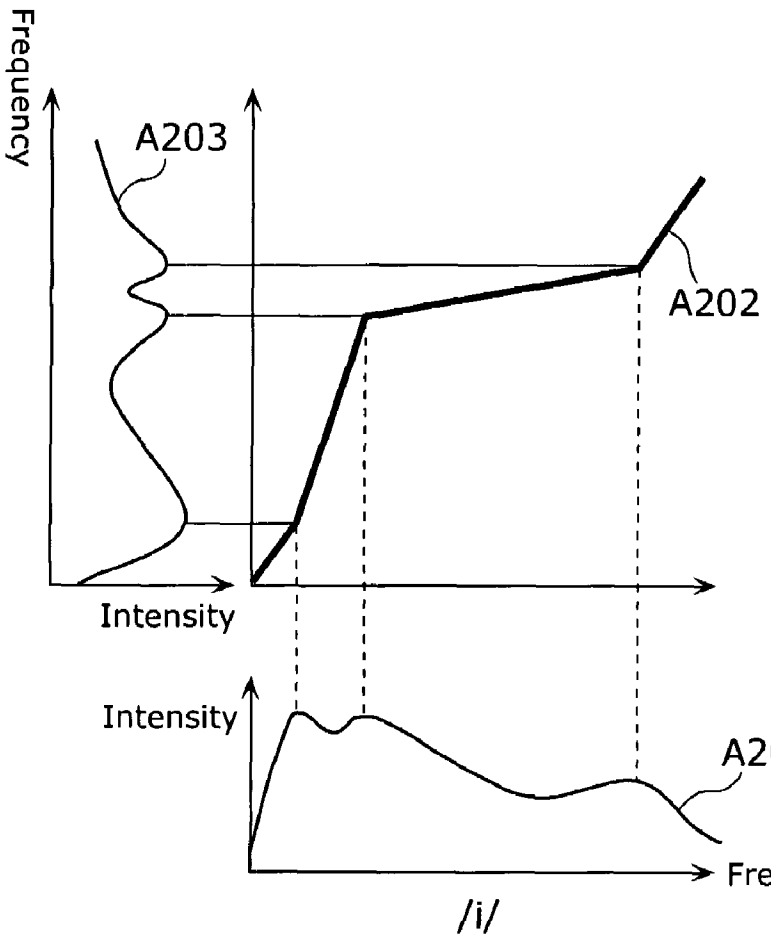
FIG. 12A is a diagram showing an example of applying a transformation function to the spectrum of the vowel /i/.

FIG. 12A is a diagram showing an example where a transformation function is applied to the spectrum of the vowel /i/.

The transformation function A202 is a spectrum envelope transformation table generated for the speech of the vowel /i/ shown in FIG. 10. The spectrum A201 shows a spectrum of the speech element which represents the category (e.g. vowel /i/ shown in FIG. 10).

For example, when the transformation function A202 is applied to the spectrum A201, the spectrum A201 is transformed into the spectrum $A_2O_3$. This transformation function A202 performs transformation for raising the frequency in the intermediate range to a higher level.

However, as shown in FIG. 10 and FIG. 11, even in the case where two speech elements are the same vowel /i/, their spectra may largely differ.

Figure 12B:
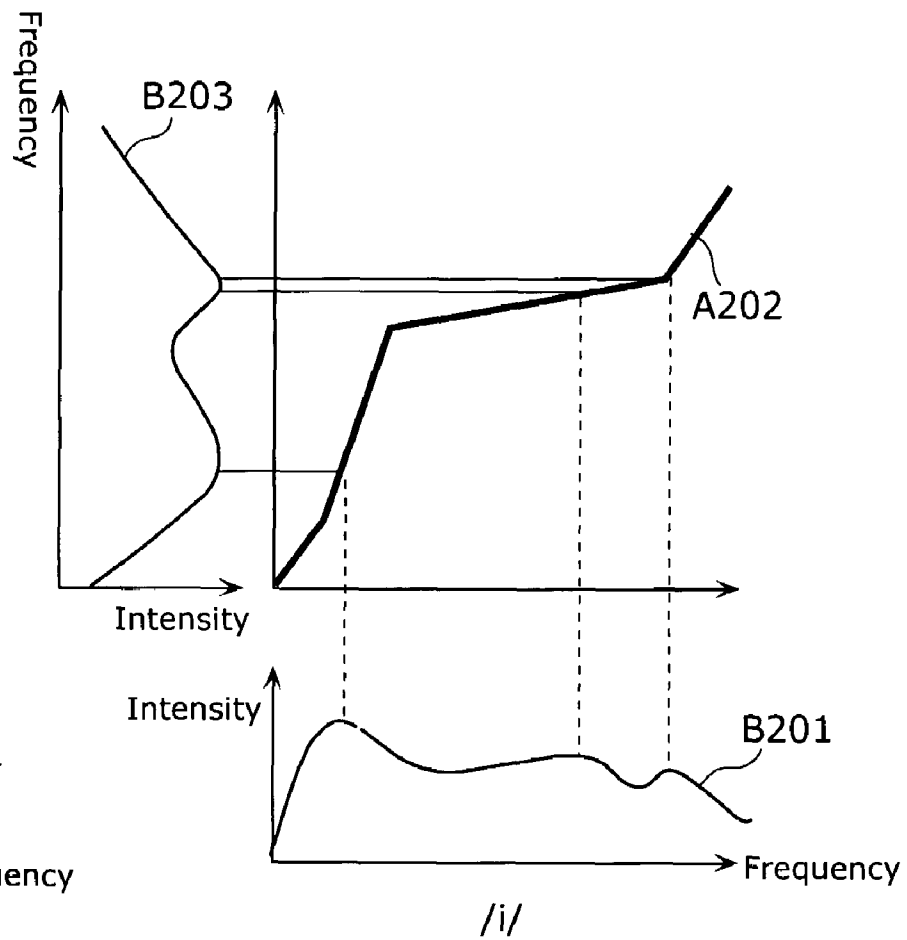
FIG. 12B is a diagram showing an example of applying a transformation function to the another spectrum of the vowel /i/.

FIG. 12B is a diagram showing an example where the transformation function is applied to another spectrum of the vowel /i/.

The spectrum B201 is a spectrum of the vowel /i/ shown in FIG. 11, which largely differs from the spectrum A201 in FIG. 12A.

In the case where the transformation function A202 is applied to the spectrum B201, the spectrum B102 is transformed into the spectrum B203. In other words, in the spectrum B203, the second and third peaks of the spectrum are notably close to each other and form one peak. Thus, in the case where the transformation function A202 is applied to the spectrum B201, the voice transformation effect similar to the voice transformation effect obtained in the case of applying the transformation function A202 to the spectrum A201 cannot be obtained. Further, in the related art, two peaks approach too closely to each other in the transformed spectrum B203 so that the peaks are integrated into one peak. Therefore, there is a problem that a phonemic characteristic is degraded.

On the other hand, in the speech synthesis apparatus according to the present embodiment, compared to an acoustic characteristic of a speech element and an acoustic characteristic of a speech element which is original data of a transformation function, a speech element and a transformation function are associated with each other so that the acoustic characteristics of their binaural speech elements become the closest to each other. The speech synthesis apparatus of the present invention then transforms the voice characteristic of the speech element using a transformation function which is associated with the speech element.

In specific, the speech synthesis apparatus according to the present invention holds transformation function candidates for the vowel /i/, selects, based on the acoustic characteristic of the speech element used for generating a transformation function, an optimum transformation function to the speech element to be transformed, and applies the selected transformation function to the speech element.

Figure 13:
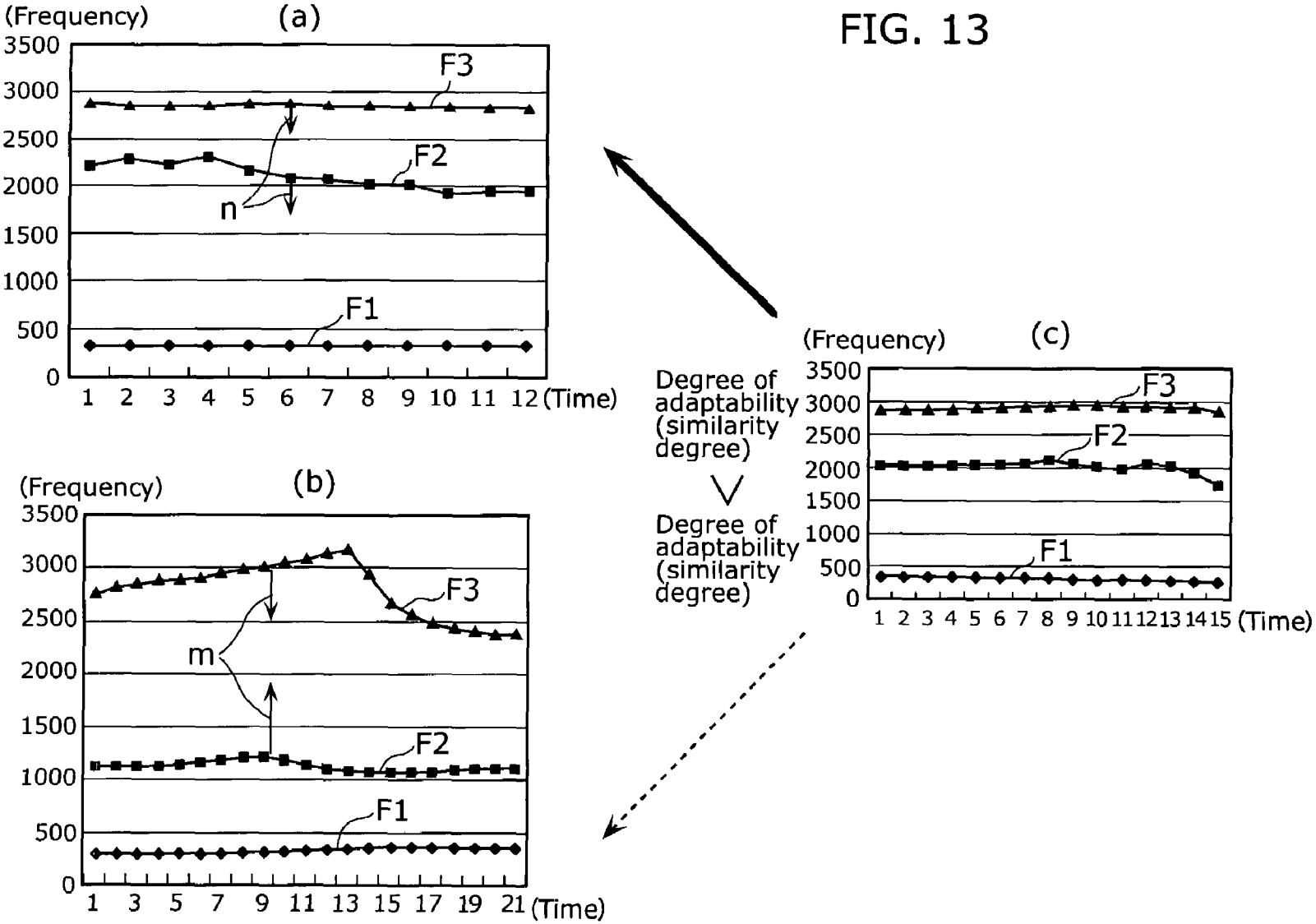
FIG. 13 is an explanatory diagram for explaining that the speech synthesis apparatus according to the first embodiment appropriately selects a transformation function.

FIG. 13 is an explanatory diagram for explaining that the speech synthesis apparatus according to the present embodiment appropriately selects a transformation function. Note that, in (a) of FIG. 13, a transformation function (a transformation function candidate) n and the acoustic characteristic of a speech element used for generating the transformation function candidate n are shown. In (b) of FIG. 13, a transformation function (a transformation function candidate) m and the acoustic characteristic of a speech element used for generating the transformation function candidate m are shown. Additionally, in (c) of FIG. 13, an acoustic characteristic of the speech element to be transformed is shown. Here, in (a), (b) and (c), the acoustic characteristics are shown in graphs using the first formant F1, the second formant F2 and the third formant F3. In the graphs, a horizontal axis indicates time, while a vertical axis indicates frequency.

The speech synthesis apparatus according to the present embodiment, for example, selects, as a transformation function, from the transformation function candidate n shown in (a) and the transformation function candidate m shown in (b), a transformation function candidate whose acoustic characteristic is similar to the speech element to be transformed shown in (c).

Here, the transformation function candidate n shown in (a) is transformed so that the second formant F2 is reduced as much as 100 Hz and the third formant F3 is raised as much as 100 Hz. On the other hand, the transformation function candidate m is transformed so that the second formant F2 is raised as much as 500 Hz and the third formant F3 is reduced as much as 500 Hz.

In such case, the speech synthesis apparatus according to the present embodiment calculates a degree of similarity between the acoustic characteristic of the speech element to be transformed shown in (c) and the acoustic characteristic of the speech element used for generating the transformation function candidate n shown in (a), and calculates a degree of similarity between the acoustic characteristic of the speech element to be transformed shown in (c) and the acoustic characteristic of the speech element used for generating the transformation function candidate m shown in (b). As the result, the speech synthesis apparatus of the present embodiment can judge that, in the frequencies of the second formant F2 and the third formant F3, the acoustic characteristic of the transformation function candidate n is more similar to the acoustic characteristic of the speech element to be transformed than the acoustic characteristic of the transformation function candidate m. Therefore, the speech synthesis apparatus selects the transformation function candidate n as a transformation function and applies the transformation function n to the speech element to be transformed. Herein, the speech synthesis apparatus performs modification of the spectrum envelope in accordance with an amount of movement of each formant.

Here, as in the case of the speech synthesis apparatus of the related art, when a category representative function (e.g., transformation function candidate m shown in (b) of FIG. 13) is applied, not only is the voice characteristic transformation effect not obtained because the second formant and the third formant cross each other, but also the phonemic characteristic cannot be secured.

However, in the speech synthesis apparatus of the present invention, a transformation function is selected using a degree of similarity (a degree of adaptability), and applies, to the speech element to be transformed as shown in (c) of FIG. 13, the transformation function generated based on the speech element that is close to the acoustic characteristic of the speech element to be transformed. Accordingly, in the present embodiment, the problems that, in the transformed speech, formant frequencies approach too close to each other or that the frequencies of the speech exceed the Nyquist frequency can be overcome. Further, in the present embodiment, a transformation function of a speech element that is a generator of the transformation function is applied to a speech element e.g., the speech element having the acoustic characteristic shown in (c) of FIG. 13) that is approximate to the speech element that is a generator of the transformation function (e.g., the speech element having the acoustic characteristic shown in (a) of FIG. 13). Therefore, an effect similar to the voice characteristic transformation effect obtained when the transformation function is applied to the speech element of the generator can be obtained.

Thus, in the present embodiment, an optimum transformation function can be selected for each speech element without being bothered by categories and the like of the speech elements as in the case of the conventional speech synthesis apparatus. Therefore, distortion caused by the voice characteristic transformation can be restrained in minimum.

Also, in the present embodiment, the voice characteristic is transformed using a transformation function so that a sequential voice characteristic transformation is allowed and a speech waveform of the voice characteristic which does not exist in the database (element storing unit 102) can be generated. Further, in the present embodiment, an optimum transformation function is applied for each speech element as described above, so that the formant frequencies of the speech waveform can be limited in an appropriate range without performing any forcible modifications.

In addition, in the present embodiment, the speech element and the transformation function for realizing text data and a voice characteristic designated by the voice characteristic designating unit 107 are complementarily selected at the same time. In other words, in the case where there is no transformation function corresponding to a speech element, the speech element is changed to a different speech element. Also, in the case where there is no speech element corresponding to the transformation function, the transformation function is changed to a different transformation function. Accordingly, the characteristic of the synthesized speech corresponding to the text data and the characteristic of the transformation into the voice characteristic designated by the voice characteristic designating unit 107 can be optimized at the same time, so that a synthesized speech with high quality and desired voice characteristic can be obtained.

Note that, in the present embodiment, the selecting unit 103 selects a speech element and a transformation function based on the result of the integration cost. However, the selecting unit 103 may select a speech element and a transformation function whose static degree of adaptability and dynamic degree of adaptability calculated by the adaptability judging unit 105, or a degree of adaptability of the combination thereof, exceeds a predetermined threshold.

(Variation)

It is explained that the speech synthesis apparatus of the first embodiment selects a speech element series U and a transformation function series F (speech elements and transformation functions) based on one designated voice characteristic.

A speech synthesis apparatus according to the present variation receives designations of voice characteristics, and selects a speech element series U and a transformation function series F based on the voice characteristics.

Figure 14:
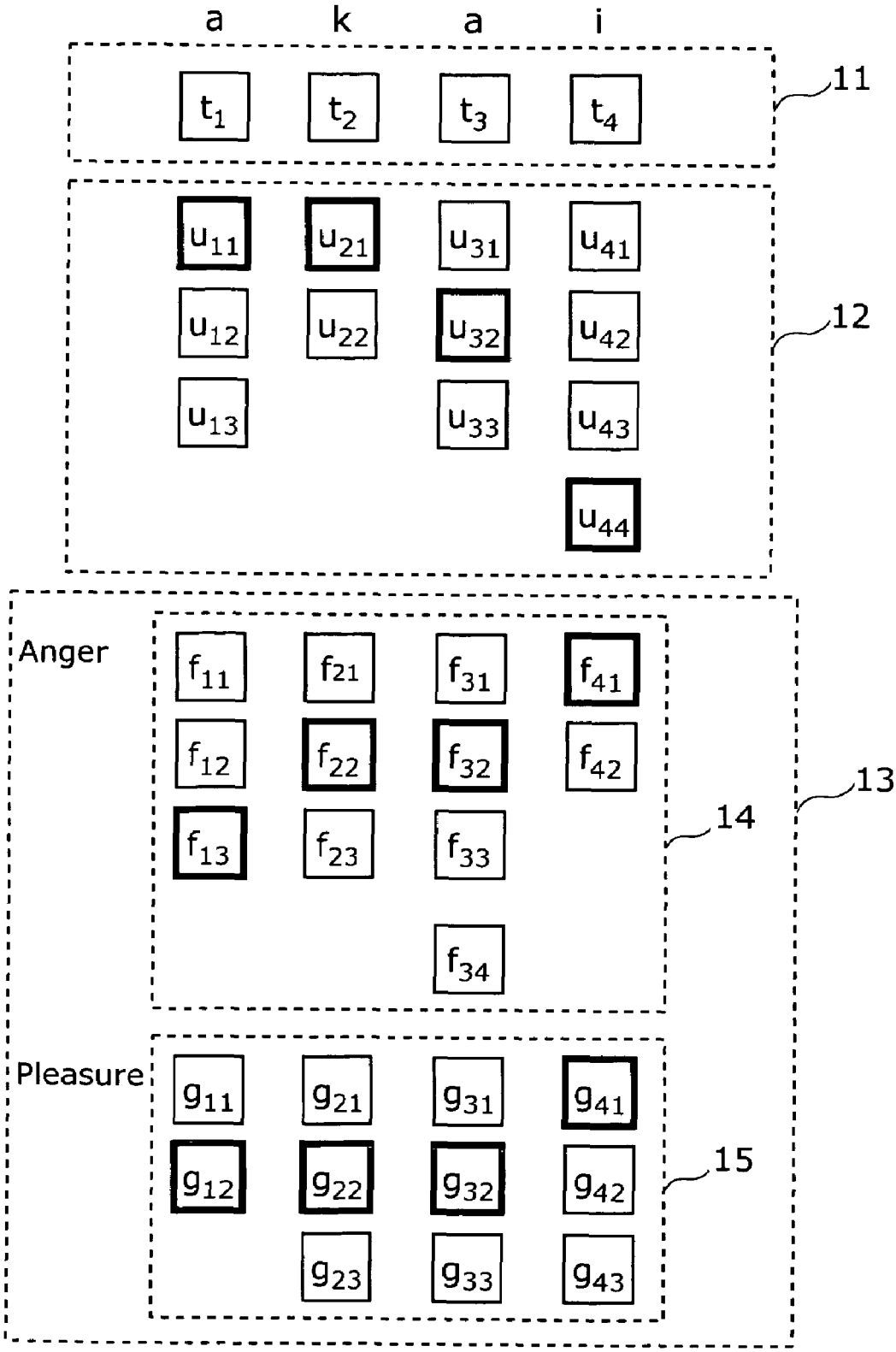
FIG. 14 is an explanatory diagram for explaining operations of an element lattice specifying unit and a function lattice specifying unit according to a variation of the first embodiment of the present invention.

FIG. 14 is an explanatory diagram for explaining operations of the element lattice specifying unit 201 and the function lattice specifying unit 202 according to the present variation.

The function lattice specifying unit 202 specifies transformation function candidates for realizing the voice characteristics designated by the function storing unit 104. For example, when receiving the designations of voice characteristics indicating "anger" and "pleasure", the function lattice specifying unit 202 specifies, from the function storing unit 104, transformation function candidates respectively corresponding to the voice characteristics of "anger" and "pleasure".

For example, as shown in FIG. 14, the function lattice specifying unit 202 specifies a transformation function candidate set 13. This transformation function candidate set 13 includes a transformation function candidate set 14 corresponding to the voice characteristic of "anger" and a transformation function candidate set 15 corresponding to the voice characteristic of "pleasure". The transformation function candidate set 14 includes: transformation function candidates $f_{11}$, $f_{12}$ and $f_{13}$ for a phoneme "a"; transformation function candidates $f_{21}$, $f_{22}$ and $f_{23}$ for a phoneme "k"; transformation function candidates $f_{31}$, $f_{32}$, $f_{33}$ and $f_{34}$ for a phoneme "a"; and transformation function candidates $f_{41}$ and $f_{42}$ for a phoneme "i". The transformation function candidates set 15 includes: transformation function candidates $g_{11}$ and $g_{12}$ for a phoneme "a"; transformation function candidates $g_{21}$, $g_{22}$ and $g_{23}$ for a phoneme "k"; transformation function candidates $g_{31}$, $g_{32}$ and $g_{33}$ for a phoneme "a"; and transformation function candidates $g_{41}$, $g_{42}$ and $g_{43}$ for a phoneme "i".

The adaptability judging unit 105 calculates a degree of adaptability fcost ($u_{ij}$, $f_{ik}$, $g_{ih}$) among a speech element candidate $u_{ij}$, a transformation function candidate $f_{ik}$ and a transformation function candidate $g_{ih}$. Here, the transformation function candidate $g_{ih}$ is the h-th transformation function candidate for the i-th phoneme.

This degree of adaptability fcost ($u_{ij}$, $f_{ik}$, $g_{ih}$) is calculated by the following equation 4.

$$f\cos t(u_{ij},f_{ik},g_{ih})=f\cos t(u_{ij},f_{ik})+f\cos t(u_{ij}*f_{ik},g_{ih}) \quad \text{(Equation 4)}$$

Here, $u_{ij}*f_{ik}$ shown in the equation 4 indicates a speech element after a transformation function $f_{ik}$ has been applied to the element $u_{ij}$.

The cost integrating unit 204 calculates an integration cost manage_cost ($t_i$, $u_{ij}$, $f_{ik}$, $g_{ih}$) using an element selection cost ucost ($t_i$, $u_{ij}$) and a degree of adaptability fcost ($u_{ij}$, $f_{ik}$, $g_{ih}$). This integration cost manage_cost ($t_i$, $u_{ij}$, $f_{ik}$, $g_{ih}$) is calculated by the following equation 5.

$$\text{manage_cos}\,t(t_i,u_{ij},f_{ik},g_{ih})=u\cos t(t_i,u_{ij})+f\cos t(u_{ij},f_{ik},g_{ih}) \quad \text{(Equation 5)}$$

The searching unit 205 selects the speech element series U and transformation function series F and G using the following equation 6.

$$U,F,G=\arg\min \Sigma\text{manage_cos}\,t(t_i,u_{ij},f_{ik},g_{ih}) \quad \text{(Equation 6)}$$

u, f, g i=1, 2, . . . , n

For example, as shown in FIG. 14, the selecting unit 103 selects the speech element series U ($u_{11}$, $u_{21}$, $u_{32}$, $u_{34}$), the transformation function series F ($f_{13}$, $f_{22}$, $f_{32}$, $f_{41}$) and the transformation function series G ($g_{12}$, $g_{22}$, $g_{32}$, $g_{41}$).

Thus, in the present variation, the voice characteristic specifying unit 107 receives the designations of voice characteristics, and calculates a degree of adaptability and an integration cost based on the received voice characteristics. Therefore, both of the voice characteristic of the synthesized speech corresponding to text data and the characteristic of the transformation to the voice characteristics can be optimized.

Note that, in the present variation, the adaptability judging unit 105 calculates the final degree of adaptability fcost ($u_{ij}$, $f_{ik}$, $g_{ih}$) by adding the degree of adaptability fcost ($u_{ij}*f_{ik}$, $g_{ih}$) to the degree of adaptability fcost ($u_{ij}$, $f_{ik}$). However, the final degree of adaptability fcost ($u_{ij}$, $f_{ik}$, $g_{ih}$) may be calculated by adding the degree of adaptability fcost ($u_{ij}$, $g_{ih}$) to the degree of adaptability fcost ($u_{ij}$, $f_{ik}$).

Also, while, in the present variation, the voice characteristic designating unit 107 receives designations of two voice characteristics, three or more designations of voice characteristics may be accepted. Even in such case, in the present variation, the adaptability judging unit 105 calculates a degree of adaptability using the similar method as described above, and applies a transformation function corresponding to each voice characteristic to a speech element.

Second Embodiment

Figure 15:
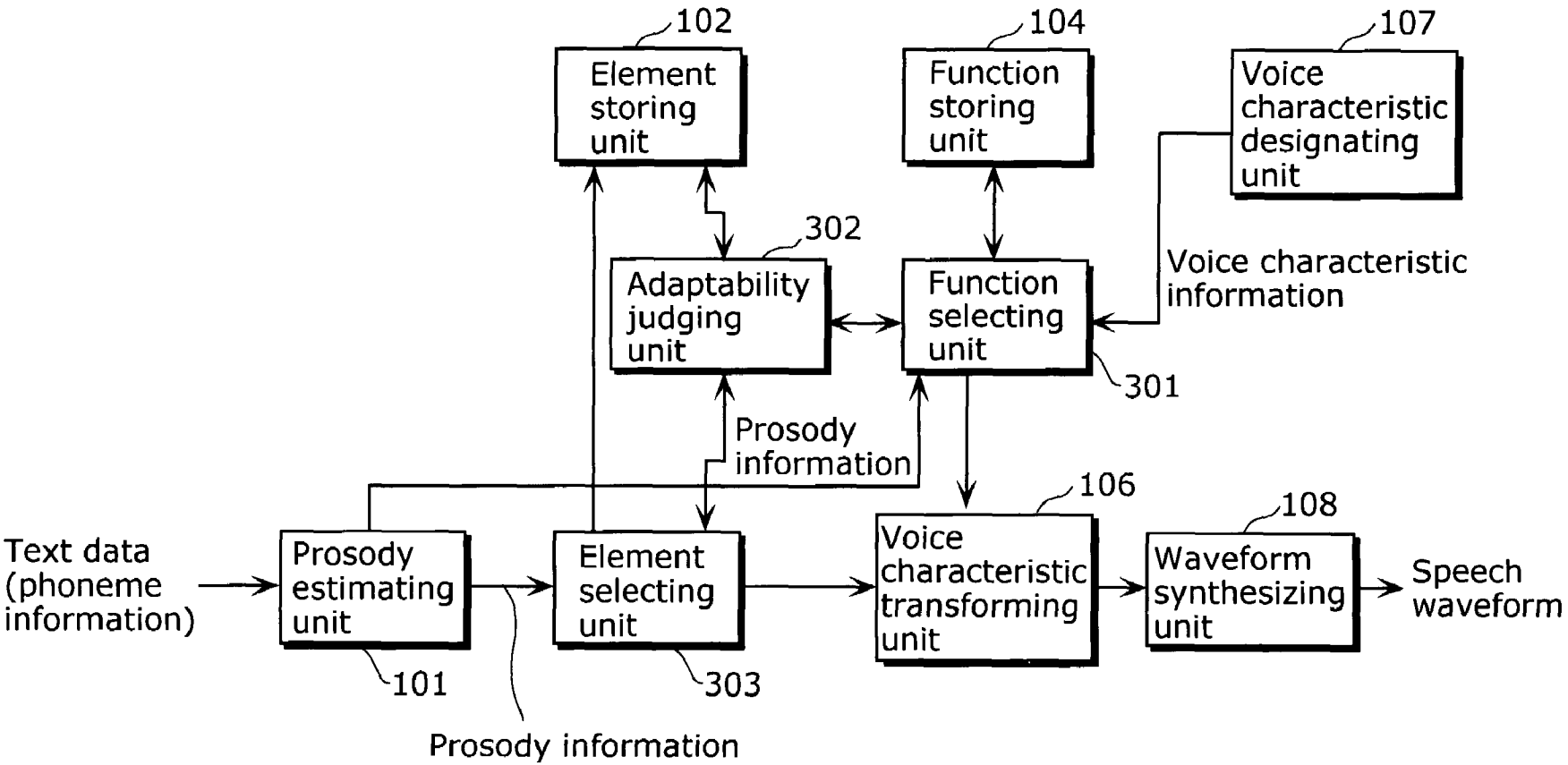
FIG. 15 is a block diagram showing a structure of a speech synthesis apparatus according to a second embodiment of the present invention.

FIG. 15 is a block diagram showing a structure of a speech synthesis apparatus according to the second embodiment of the present invention.

The speech synthesis apparatus of the present embodiment includes a prosody predicting (estimating) unit 101, an element storing unit 102, an element selecting unit 303, a function storing unit 104, an adaptability judging unit 302, a voice characteristic transforming unit 106, a voice characteristic designating unit 107, a function selecting unit 301 and a waveform synthesizing unit 108. Note that, among the constituents of the present embodiment, the constituents that are the same as those of the speech synthesis apparatus of the first embodiment are shown with same labels as the constituents of the first embodiment, and the detailed explanations about them are omitted.

Here, the speech synthesis apparatus of the present embodiment differs from that of the first embodiment in that the function selecting unit 301 first selects transformation functions (transformation function series) based on the voice characteristic and prosody information designated by the voice characteristic designating unit 107, and the element selecting unit 303 selects speech elements (speech element series) based on the transformation functions.

The function selecting unit 301 is configured as a function selecting unit, and selects a transformation function from the function storing unit 104 based on the prosody information outputted by the prosody predicting unit 101 and the voice characteristic information outputted by the voice characteristic designating unit 107.

The element selecting unit 303 is configured as an element selecting unit, and specifies some candidates of the speech elements from the element storing unit 102 based on the prosody information outputted by the prosody predicting unit 101. Further, the element selecting unit 303 selects, from among the specified candidates, a speech element which is most appropriate to the transformation function selected by the function selecting unit 301.

The adaptability judging unit 302 judges a degree of adaptability fcost ($u_{ij}$, $f_{ik}$) between the transformation function that has been selected by the function selecting unit 301 and some speech element candidates specified by the element selecting unit 303, using the similar method executed by the adaptability judging unit 105 in the first embodiment.

The voice characteristic transforming unit 106 applies the transformation function selected by the function selecting unit 301 to the speech element selected by the element selecting unit 303. Consequently, the voice characteristic transforming unit 106 generates a speech element with the voice characteristic designated by the user in the voice characteristic designating unit 107. In the present embodiment, a transforming unit is made up of the voice characteristic transforming unit 106, a function selecting unit 301 and an element selecting unit 303.

The waveform synthesizing unit 108 generates a waveform from the speech element transformed by the speech characteristic transforming unit 106, and outputs the waveform.

Figure 16:
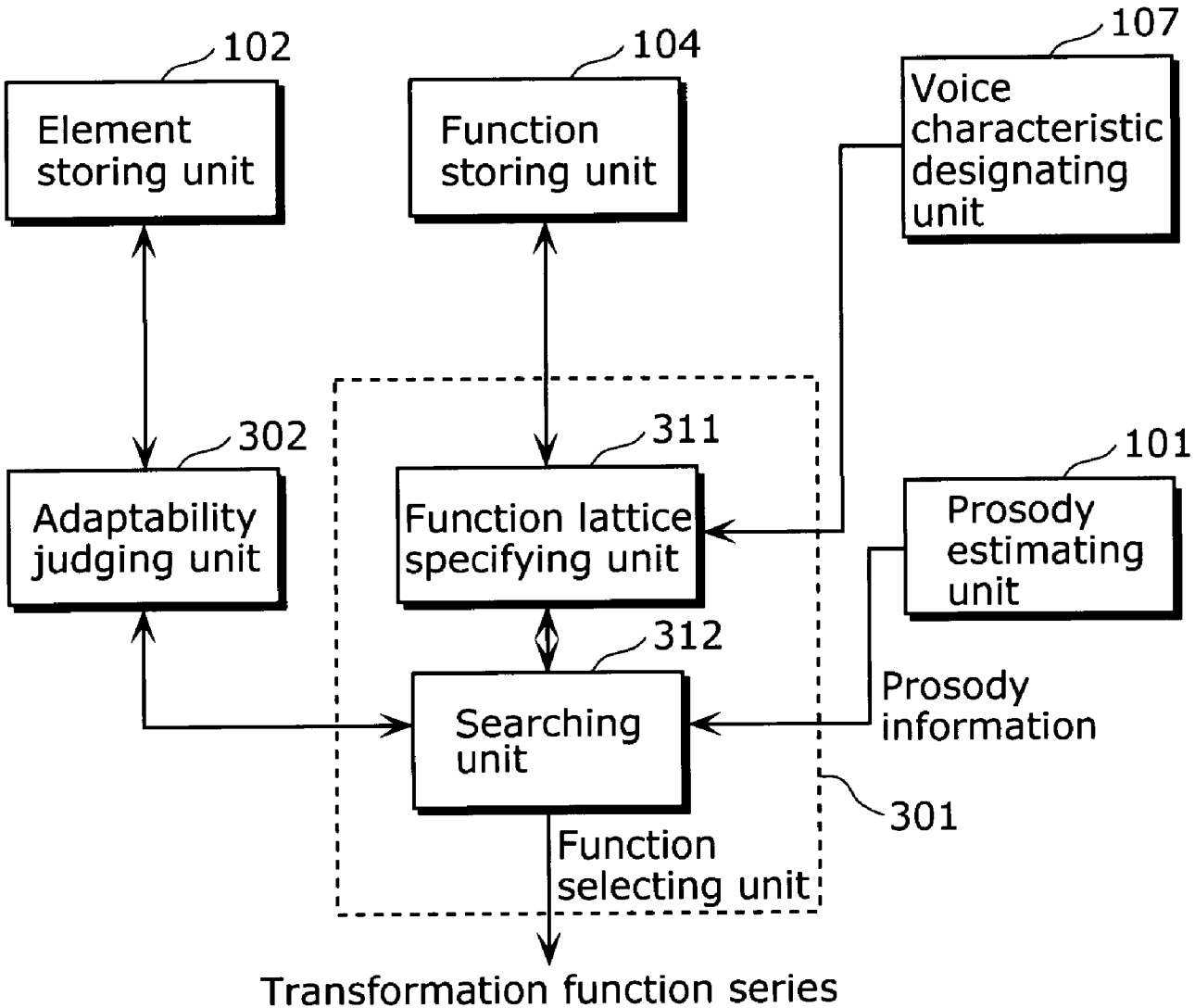
FIG. 16 is a block diagram showing a structure of a function selecting unit according to the second embodiment of the present invention.

FIG. 16 is a block diagram showing a structure of the function selecting unit 301.

The function selecting unit 301 includes a function lattice specifying unit 311 and a searching unit 312.

The function lattice specifying unit 311 specifies, from among the transformation functions stored in the function storing unit 104, some transformation functions as candidates of the transformation functions for transforming to the voice characteristic (designated voice characteristic) indicated in the voice characteristic information.

For example, in the case where a designation of a voice characteristic indicating "anger" is received by the voice characteristic designating unit 107, the function lattice specifying unit 311 specifies, from among the transformation functions stored in the function storing unit 104, as candidates, transformation functions for transforming to the voice characteristic of "anger".

The searching unit 312 selects, from among some transformation function candidates specified by the function lattice specifying unit 311, a transformation function that is appropriate to the prosody information outputted by the prosody predicting unit 101. For example, the prosody information includes a phoneme series, a fundamental frequency, a duration length, power and the like.

In specific, the searching unit 311 selects a transformation function series F ($f_{1k}$, $f_{2k}$, . . . , $f_{nk}$) that is a series of transformation functions which has the maximum degree of adaptability (a degree of similarity between the prosodic characteristics of speech elements used for learning the transformation function candidates $f_{ik}$ and the prosody information $t_i$) between the series of prosody information $t_i$ and the series of transformation function candidates $f_{ik}$, in other words, which satisfies the following equation 7.

$$F = \underset{f}{\operatorname{argmin}} \sum_{i=1,\ldots,n} f\mathrm{cost}(t_i, f_{ik}) = \mathrm{static_cost}(t_i, f_{ik}) + \mathrm{dynamic_cost}(t_{i-1}, t_i, t_{i+1}, f_{ik}) \quad \text{(Equation 7)}$$

Here, in the present embodiment, as shown in the equation 7, the calculation of the degree of adaptability differs from that of the first embodiment shown in the equation 1 in that the items used for calculating a degree of adaptability only include prosody information $t_i$ such as fundamental frequency, duration length and power.

The searching unit 312 then outputs the selected candidates as transformation functions (transformation function series) for transforming into the designated voice characteristic.

Figure 17:
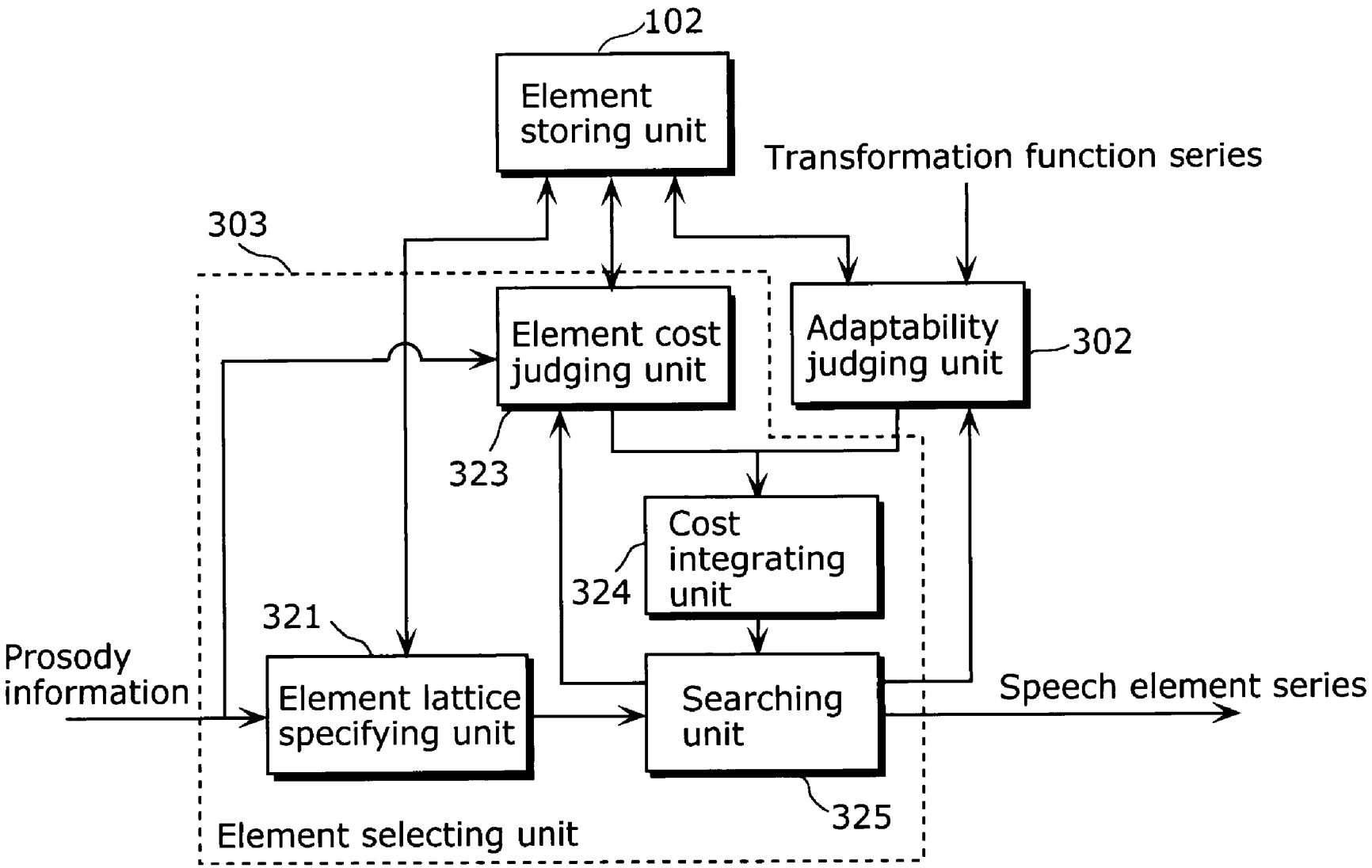
FIG. 17 is a block diagram showing a structure of an element selecting unit according to the second embodiment of the present invention.

FIG. 17 is a block diagram showing a structure of an element selecting unit 303.

The element selecting unit 303 includes an element lattice specifying unit 321, an element cost judging unit 323, a cost integrating unit 324 and a searching unit 325.

Such element selecting unit 303 selects a speech element that most closely matches the prosody information outputted by the prosody predicting unit 101 and the transformation function outputted by the function selecting unit 301.

The element lattice specifying unit 321 specifies some speech element candidates, from among the speech elements stored in the element storing unit 102, based on the prosody information outputted by the prosody predicting unit 101 as in the case of the element lattice specifying unit 201 of the first embodiment.

The element cost judging unit 323 judges an element cost between the speech element candidates specified by the element lattice specifying unit 321 and the prosody information as in the case of the element cost judging unit 203 of the first embodiment. In other words, the element cost judging unit 323 calculates an element cost ucost ($t_i$, $u_{ij}$) which indicates a likelihood of the speech element candidates specified by the element lattice specifying unit 321.

The cost integrating unit 324 calculates an integration cost manage_cost ($t_i$, $u_{ij}$, $f_{ik}$) by integrating the degree of adaptability judged by the adaptability judging unit 302 and the element cost judged by the element cost judging unit 323 as in the case of the cost integrating unit 204 of the first embodiment.

The searching unit 325 selects, from among the speech element candidates specified by the element lattice specifying unit 321, a speech element series U so as to have a minimum summed value of the integration cost calculated by the cost integrating unit 324.

Specifically, the searching unit 325 selects the speech element series U based on the following equation 8.

$$U = \mathrm{argmin}\ \Sigma \mathrm{manage_cos}\ t(t_i, u_{ij}, f_{ik}) \qquad \text{(Equation 8)}$$

u i=1, 2, . . . , n

Figure 18:
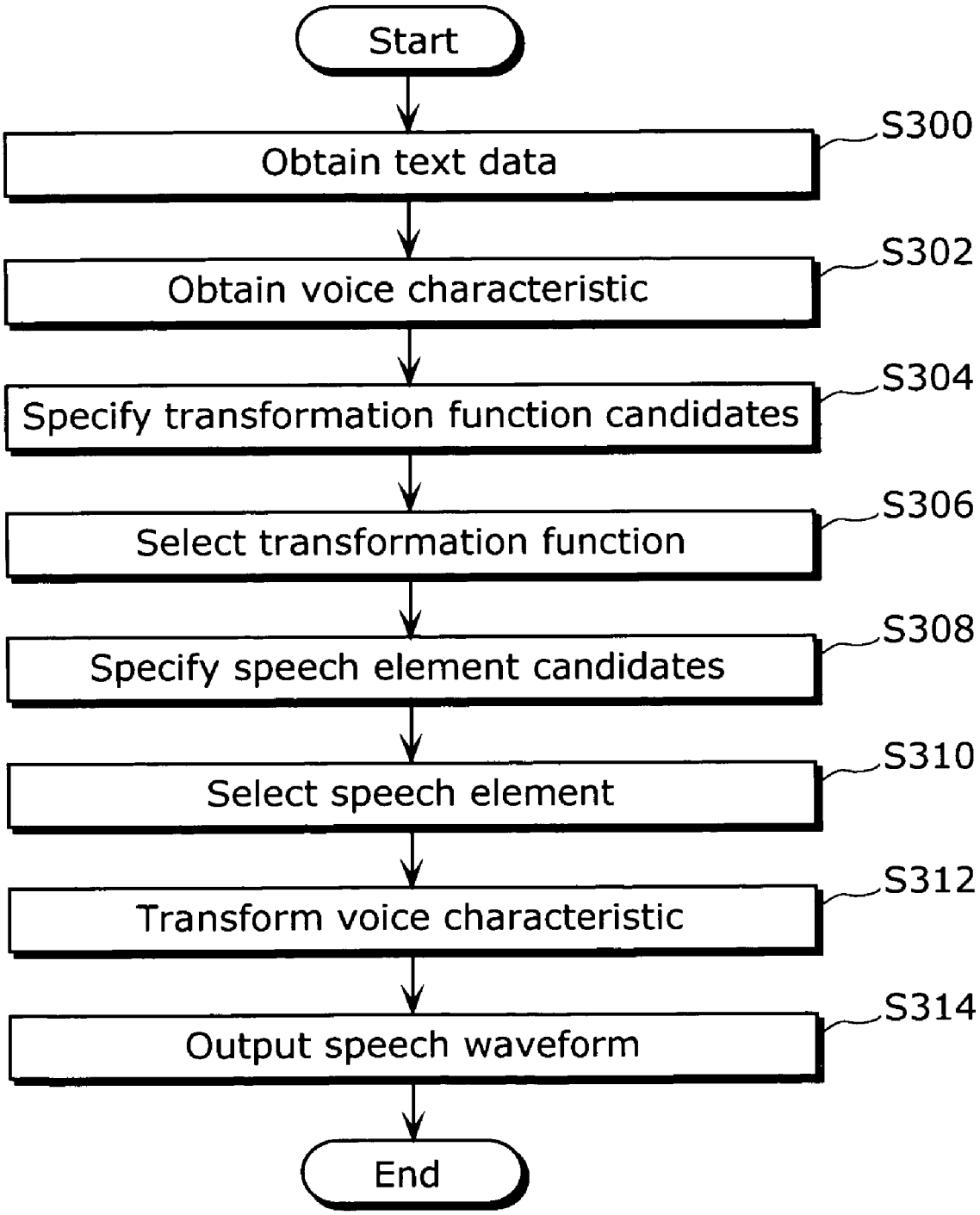
FIG. 18 is a flow chart showing an operation of the speech synthesis apparatus according to the second embodiment of the present invention.

FIG. 18 is a flowchart showing an operation of the speech synthesis apparatus according to the present embodiment.

The prosody predicting unit 101 of the speech synthesis apparatus obtains the text data including the phoneme information, and predicts prosodic characteristics (prosody) such as fundamental frequency, duration length, and power that should be included in each phoneme, based on the phoneme information (Step S300). For example, the prosody predicting unit 101 predicts them using a method of quantification theory I.

Next, the voice characteristic designating unit 107 of the speech synthesis apparatus obtains a voice characteristic of the synthesized speech designated by the user, for example, a voice characteristic of "anger" (Step S302).

The function selecting unit 301 of the speech synthesis apparatus specifies transformation function candidates indicating the voice characteristic of "anger" from the function storing unit 104, based on the voice characteristic obtained by the voice characteristic designating unit 107 (Step S304). The function selecting unit 301 further selects, from among the transformation function candidates, a transformation function which is most appropriate to the prosody information indicating the prediction result by the prosody predicting unit 101 (Step S306).

The element selecting unit 303 of the speech synthesis apparatus specifies some speech element candidates from the element storing unit 102 based on the prosody information (Step S308). The element selecting unit 303 further selects, from among the specified candidates, a speech element which is matching the prosody information and the transformation function selected by the function selecting unit 301 most (Step S310).

Next, the voice characteristic transforming unit 106 of the speech synthesis apparatus performs voice characteristic transformation by applying the transformation function selected in Step S306 to the speech element selected in Step S310 (Step S312).

The waveform synthesizing unit 108 of the speech synthesis apparatus generates a speech waveform from the speech element whose voice characteristic is transformed by the voice characteristic transforming unit 106, and outputs the speech waveform (Step S314).

Thus, in the present embodiment, a transformation function is first selected based on the voice characteristic information and the prosody information, and a speech element that is most appropriate to the selected transformation function is then selected.

As a preferred state for the present embodiment, there is a case where transformation functions cannot be sufficiently secured. In specific, in the case where transformation functions for various voice characteristics are prepared, it is difficult to prepare many transformation functions for respective voice characteristics. Even in such case, even when the number of transformation functions stored in the function storing unit 104 is small, if the number of speech elements stored in the element storing unit 102 is sufficient enough, both of the characteristic of the synthesized speech corresponding to text data and the characteristic of transformation to the voice characteristic designated by the voice characteristic designating unit 107 can be optimized at the same time.

In addition, the amount of calculation can be reduced compared to the case where the speech element and the transformation function are selected at the same time.

Note that, in the present embodiment, the element selecting unit 303 selects a speech element based on the result of the integration cost. However, a speech element may be selected so that the speech element has the static degree of adaptability, dynamic degree of adaptability calculated by the adaptability judging unit 302 or a combination thereof which exceeds a predetermined threshold.

Third Embodiment

Figure 19:
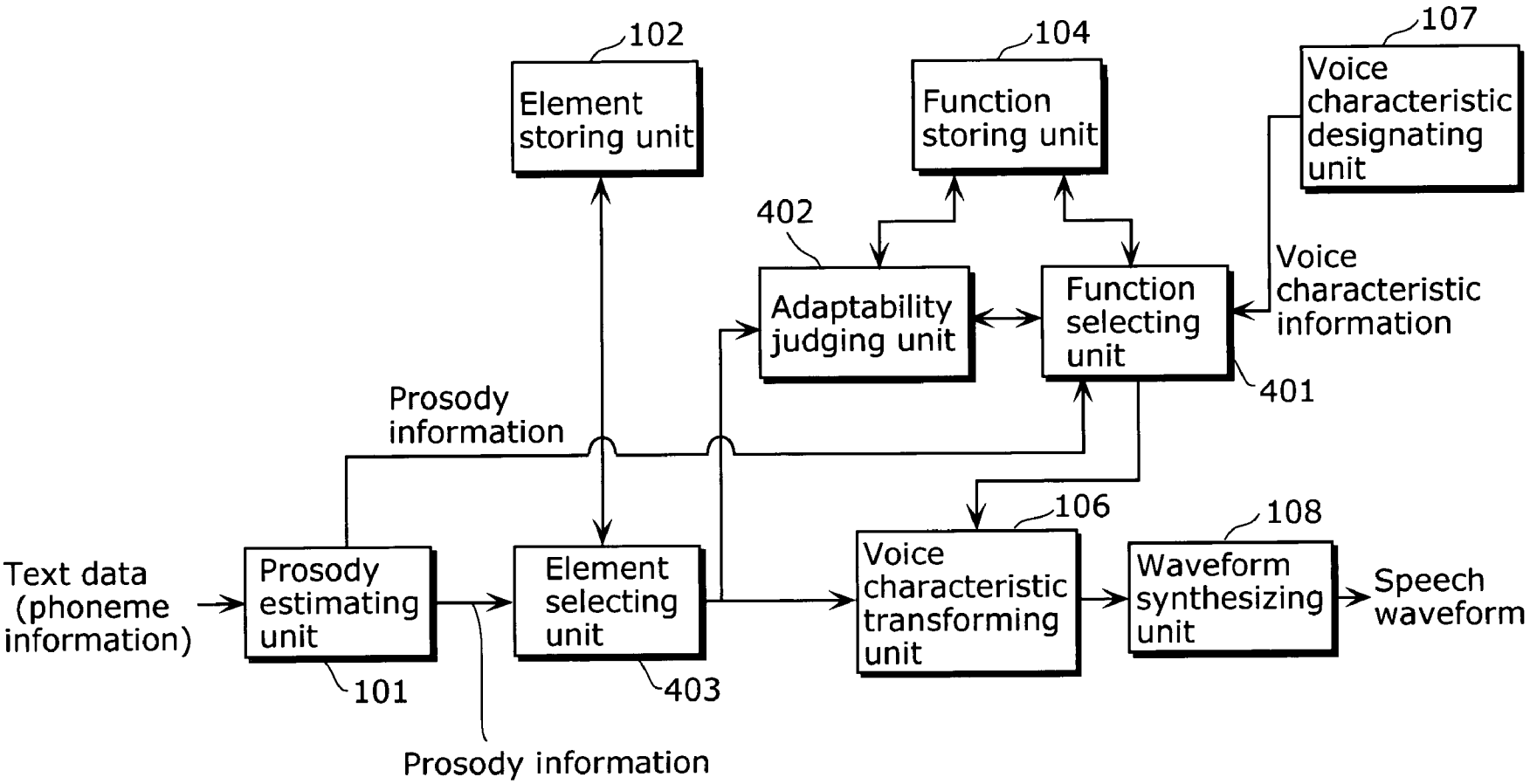
FIG. 19 is a block diagram showing a structure of a speech synthesis apparatus according to a third embodiment of the present invention.

FIG. 19 is a block diagram showing a structure of a speech synthesis apparatus according to the third embodiment of the present invention.

The speech synthesis apparatus of the present embodiment includes a prosody predicting unit 101, an element storing unit 102, an element selecting unit 403, a function storing unit 104, an adaptability judging unit 402, a voice characteristic transforming unit 106, a voice characteristic designating unit 107, a function selecting unit 401, and a waveform synthesizing unit 108. Note that, among the constituents of the present embodiment, the constituents that are the same as those of the speech synthesis apparatus of the first embodiment are shown with the same labels as the constituents of the first embodiment, and the detailed explanations about them are omitted.

Here, the speech synthesis apparatus of the present embodiment differs from that of the first embodiment in that the element selecting unit 403 first selects speech elements (speech element series) based on the prosody information outputted by the prosody predicting unit 101, and the function selecting unit 401 selects transformation functions (transformation function series) based on the speech elements.

The element selecting unit 403 selects, from the element storing unit 102, a speech element that matches the prosody information most outputted by the prosody predicting unit 101.

The function selecting unit 401 specifies some transformation function candidates from the function storing unit 104 based on the voice characteristic information and the prosody information. The function selecting unit 401 further selects, from among the specified candidates, a transformation function that is appropriate to the speech element selected by the element selecting unit 403.

The adaptability judging unit 402 judges a degree of adaptability fcost ($u_{ij}$, $f_{ik}$) between the speech element that has been selected by the element selecting unit 403 and some transformation function candidates specified by the function selecting unit 401 using a method similar to the method used by the adaptability judging unit 105 of the first embodiment.

The voice characteristic transforming unit 106 applies the transformation function selected by the function selecting unit 401 to the speech element selected by the element selecting unit 403. Accordingly, the voice transforming unit 106 generates a speech element with the voice characteristic designated by the voice characteristic designating unit 107.

The waveform synthesizing unit 108 generates a speech waveform from the speech element transformed by the voice characteristic transforming unit 106, and outputs the speech waveform.

Figure 20:
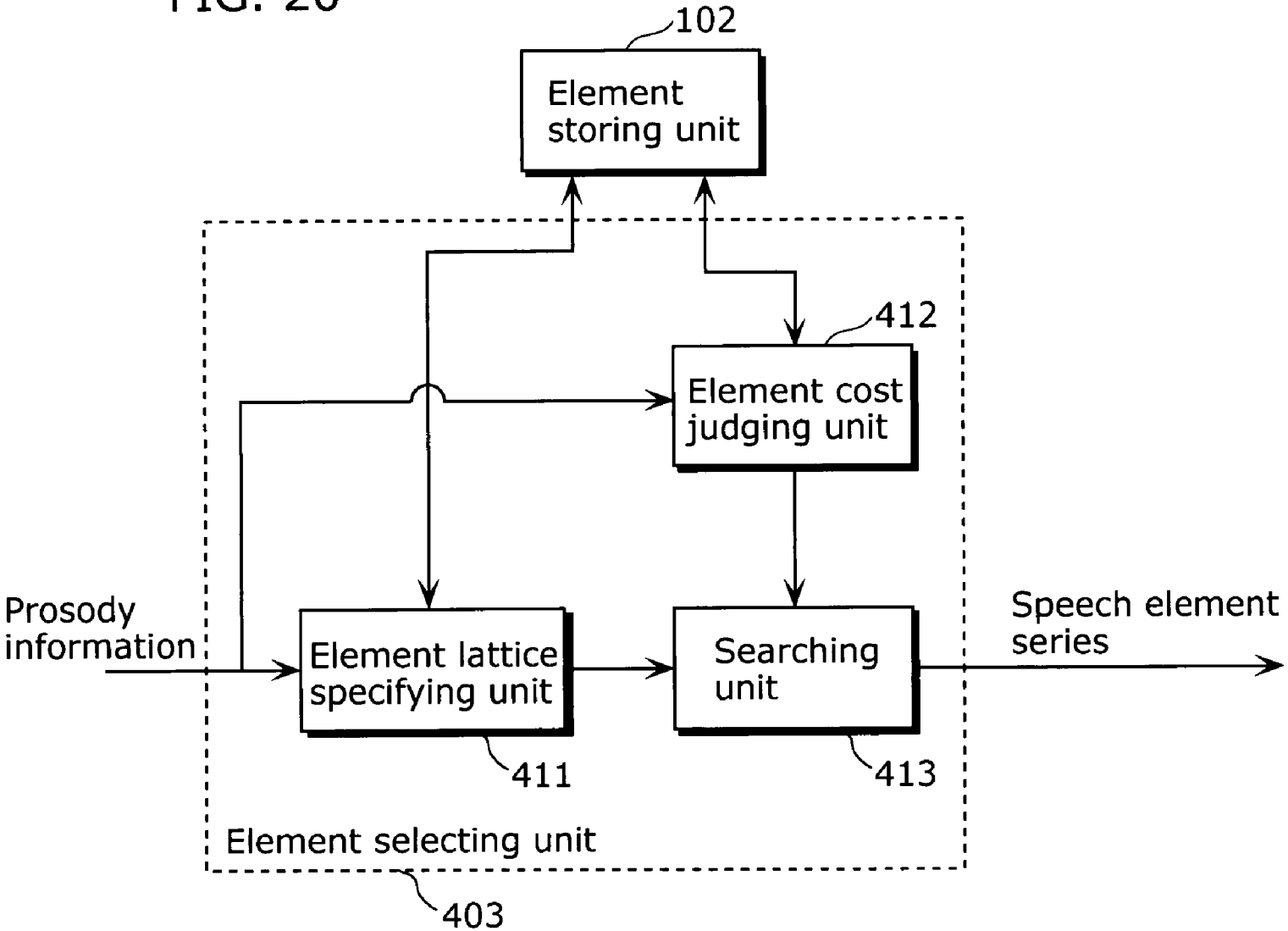
FIG. 20 is a block diagram showing a structure of an element selecting unit according to the third embodiment of the present invention.

FIG. 20 is a block diagram showing a structure of the element selecting unit 403.

The element selecting unit 403 includes an element lattice specifying unit 411, an element cost judging unit 412, and a searching unit 413.

The element lattice specifying unit 411 specifies some speech element candidates from among the speech elements stored in the element storing unit 102, based on the prosody information outputted by the prosody predicting unit 101 as in the case of the element lattice specifying unit 201 of the first embodiment.

The element cost judging unit 412 judges an element cost between the speech element candidates specified by the element lattice specifying unit 411 and the prosody information as in the case of the element cost judging unit 203 of the first embodiment. Specifically, the element cost judging unit 412 calculates an element cost ucost ($t_i$, $u_{ij}$) which indicates a likelihood of the speech element candidates specified by the element lattice specifying unit 411.

The searching unit 413 selects, from among the speech element candidates specified by the element lattice specifying unit 411, a speech element series U so that the speech element series U has a minimum summed value of the element cost calculated by the element cost judging unit 412.

In specific, the searching unit 413 selects the speech element series U based on the following equation 9.

$$U=argmin\ \Sigma u\ \cos\ t(t_i,u_{ij}) \qquad \text{(Equation 9)}$$

u i=1, 2, . . . n

Figure 21:
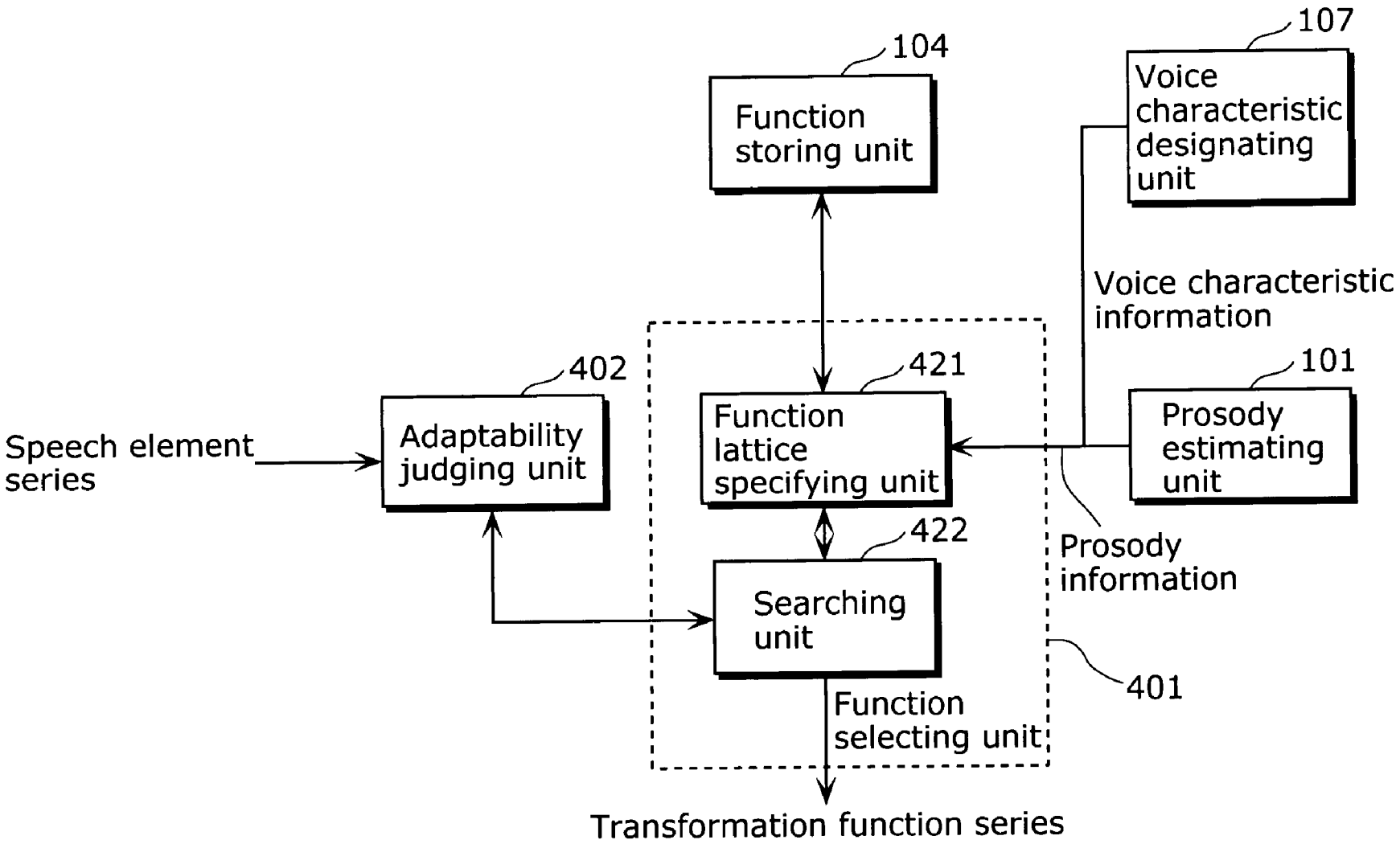
FIG. 21 is a block diagram showing a structure of a function selecting unit according to the third embodiment of the present invention.

FIG. 21 is a block diagram showing a structure of the function selecting unit 401.

The function selecting unit 401 includes a function lattice specifying unit 421 and a searching unit 422.

The function lattice specifying unit 421 specifies, from the function storing unit 104, some transformation function candidates based on the voice characteristic information outputted by the voice characteristic designating unit 107 and the prosody information outputted by the prosody predicting unit 101.

The searching unit 422 selects, from among some transformation function candidates specified by the function lattice specifying unit 421, a transformation function that is most appropriate to the speech element that has been selected by the element selecting unit 403.

Specifically, the searching unit 422 selects a transformation function series F ($f_{1k}$, $f_{2k}$, . . . , $f_{nk}$) that is a series of transformation functions, based on the following equation 10.

$$F=argmin\ \Sigma f\ \cos\ t(u_{ij},f_{ik})$$

f i=1, 2, . . . , n

Figure 22:
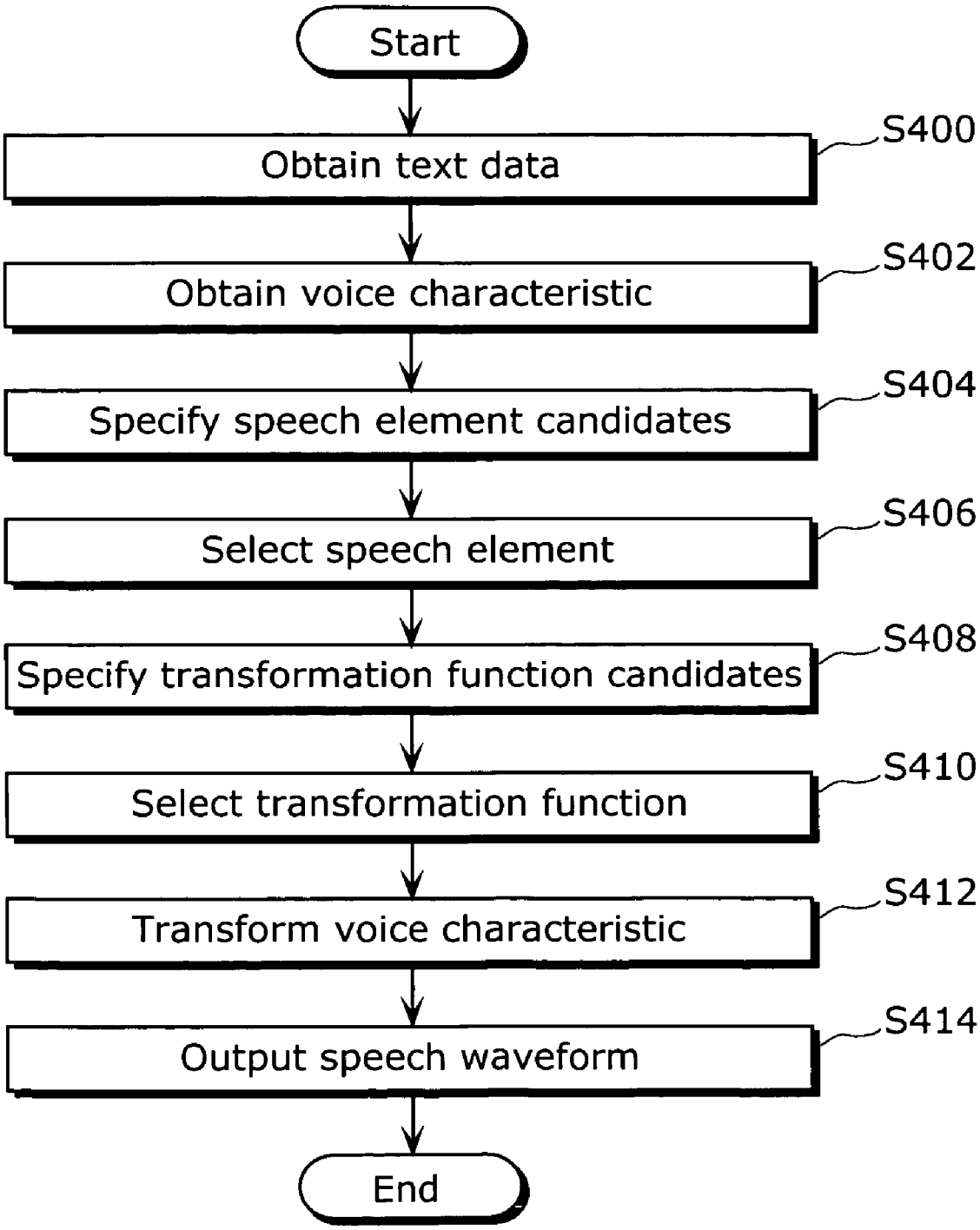
FIG. 22 is a flowchart showing an operation of the speech synthesis apparatus according to the third embodiment of the present invention.

FIG. 22 is a flowchart showing an operation of the speech synthesis apparatus of the present embodiment.

The prosody predicting unit 101 of the speech synthesis apparatus obtains text data including phoneme information, and predicts, based on the phoneme information, prosodic characteristics (prosody) such as fundamental frequency, duration length and power that should be included in each phoneme (Step S400). For example, the prosody predicting unit 101 predicts the prosodic characteristics using a method of quantification theory I.

Next, the voice characteristic designating unit 107 of the speech synthesis apparatus obtains a voice characteristic of the synthesized speech designated by the user, for example, a voice characteristic of "anger" (Step S402).

The element selecting unit 403 of the speech synthesis apparatus specifies some speech element candidates from the element storing unit 102, based on the prosody information outputted by the prosody predicting unit 101 (Step S404). The element selecting unit 401 further selects, from among the specified speech element candidates, a speech element that most closely matches the prosody information (Step S406).

The function selecting unit 401 of the speech synthesis apparatus specifies, from the function storing unit 104, some transformation function candidates indicating the voice characteristic of "anger" based on the voice characteristic information and the prosody information (Step S408). The function selecting unit 401 further selects, from among the transformation function candidates, a transformation function that is most appropriate to the speech element that has been selected by the element selecting unit 403 (Step S410).

Next, the voice characteristic transforming unit 106 of the speech synthesis apparatus applies the transformation function selected in Step S410 to the speech element selected in Step S406 and performs voice characteristic transformation (Step S412). The waveform synthesizing unit 108 of the speech synthesis apparatus generates a speech waveform from the speech element whose voice characteristic is transformed, and outputs the speech waveform (Step S414).

Thus, in the present embodiment, a speech element is first selected based on the prosody information and a transformation function which is most appropriate to the selected speech element is selected. As a preferred state for the present embodiment, for example, there is a case where a sufficient number of speech elements showing a voice characteristic of a new speaker cannot be secured while the sufficient number of transformation functions can be secured. Specifically, when it is tried to use speeches of many ordinary users as speech elements, it is difficult to record a large number of speeches. Even in such a case, that is, even in the case where the number of speech elements stored in the element storing unit 102 is small, if the number of transformation functions stored in the function storing unit 104 is sufficient enough as in the present embodiment, both of the characteristic of the synthesized speech corresponding to text data and the characteristic of transformation to the voice characteristic designated by the voice characteristic designating unit 107 can be optimized at the same time.

Further, compared to the case where a speech element and a transformation function are selected at the same time, the amount of calculations can be reduced.

Note that, in the present embodiment, the function selecting unit 401 selects a speech element based on the result of the integration cost, a transformation function whose static degree of adaptability calculated by the adaptability judging unit 402 and a dynamic degree of adaptability or a degree of adaptability of a combination thereof that exceeds a predetermined threshold.

Fourth Embodiment

Hereafter, the fourth embodiment of the present invention is explained in detail with reference to the diagrams.

Figure 23:
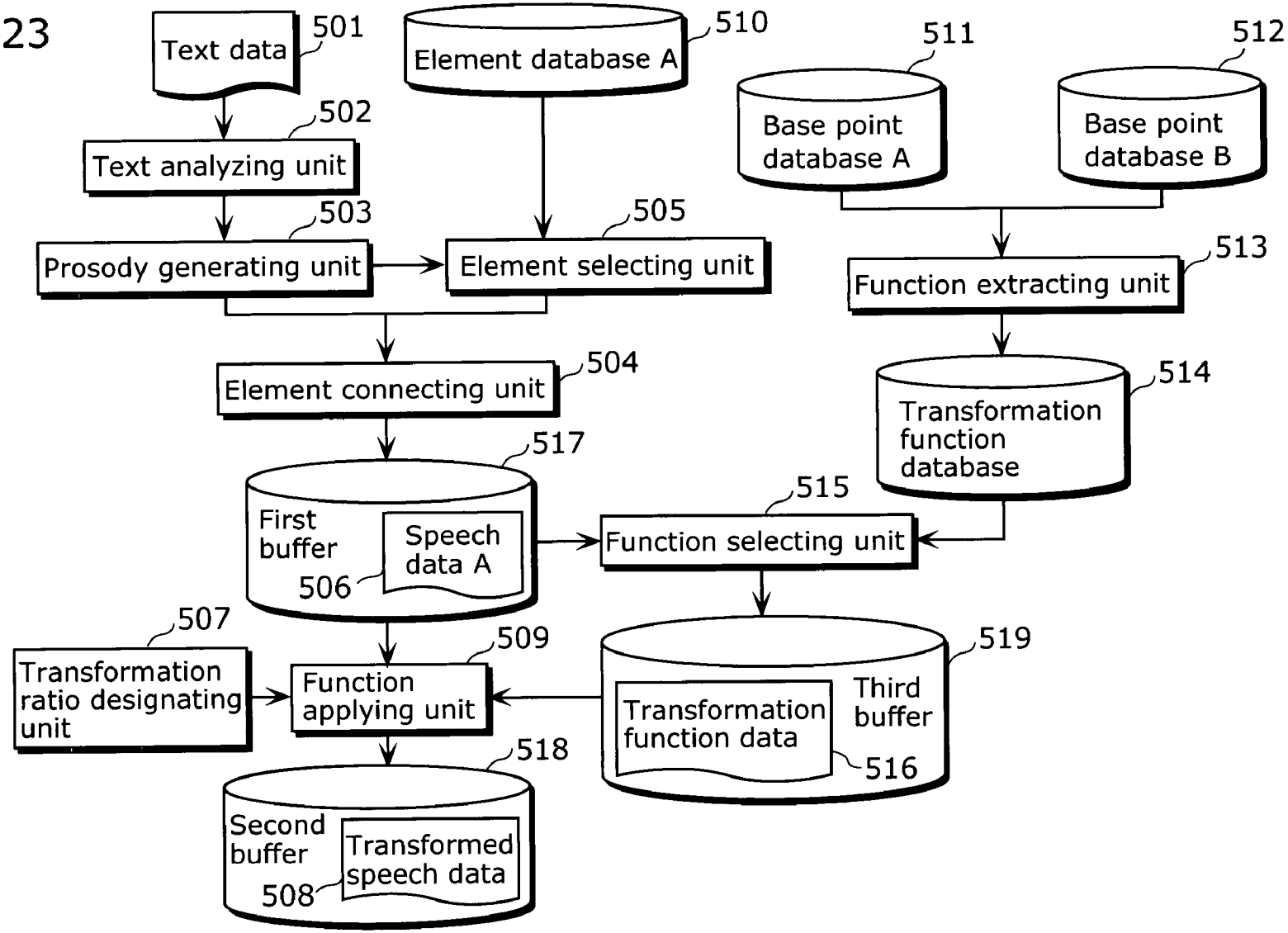
FIG. 23 is a block diagram showing a structure of a voice characteristic transformation apparatus (speech synthesis apparatus) according to a fourth embodiment of the present invention.

FIG. 23 is a block diagram showing a structure of a voice characteristic transformation apparatus (speech synthesis apparatus) according to the present embodiment of the present invention.

The voice transformation apparatus of the present invention generates speech data A 506 showing a speech with a voice characteristic A from text data 501, and appropriately transforms the voice characteristic A into a voice characteristic B. It includes a text analyzing unit 502, a prosody generating unit 503, an element connecting unit 504, an element selecting unit 505, a transformation ratio designating unit 507, a function applying unit 509, an element database A 510, an base point database A 511, a base point database B 512, a function extracting unit 513, a transformation function database 514, a function selecting unit 515, a first buffer 517, a second buffer 518, and a third buffer 519.

Note that, in the present embodiment, the transformation function database 514 is configured as a function storing unit. The function selecting unit 515 is configured as a similarity deriving unit, a representative value specifying unit and a selecting unit. Also, the function applying unit 509 is configured as a function applying unit. In other words, in the present embodiment, a transforming unit is configured with a function of the function selecting unit 515 as a selecting unit and a function of the function applying unit 509 as a function applying unit. Further, the text analyzing unit 502 is configured as an analyzing unit; the element database A 510 is configured as an element representative value storing unit; and the element selecting unit 505 is configured as a selection storing unit. That is, the text analyzing unit 502, the element selecting unit 505 and the element database A 510 make up a speech synthesis unit. Furthermore, the base point database A 511 is configured as a standard representative value storing unit; the base point database B 512 is configured as a target representative value storing unit; and a function extracting unit 513 is configured as a transformation function generating unit. In addition, the first buffer 506 is configured as an element storing unit.

The text analyzing unit 502 obtains text data 501 to be read, performs linguistic analysis of the text data 501, and performs transformation on a sentence mixed with Japanese phonetic alphabets and Chinese characters into an element sequence (phoneme sequence), extraction of morpheme information and the like.

The prosody generating unit 503 generates prosody information including an accent to be attached to a speech, and a duration length of each element (phoneme) based on the analysis result.

The element database A 510 holds elements corresponding to a speech of the voice characteristic A and information indicating acoustic characteristics attached to the respective elements. Hereafter, this information is referred to as base point information.

The element selecting unit 505 selects, from the element database A 510, an optimum element corresponding to the generated linguistic analysis result and the prosody information.

The element connecting unit 504 generates speech data A 506 which shows the details of the text data 501 as a speech of the voice characteristic A by connecting the selected elements. The element connecting unit 504 then stores the speech data A 506 into the first buffer 517.

In addition to the waveform data, the speech data A 506 includes base point information of the elements used and label information of the waveform data. The base point information included in the speech data A 506 has been attached to each element selected by the element selecting unit 505. The label information has been generated by the element connecting unit 504 based on the duration length of each element generated by the prosody generating unit 503.

The base point database A 511 holds, for each element included in the speech of the voice characteristic A, label information and base point information of the element.

The base point database B 512 holds, for each element included in the speech of the voice characteristic B, label information and base point information of the element corresponding to each element included in the speech of the voice characteristic A in the base point database A 511. For example, when the base point database A 511 holds label information and base point information of each element included in the speech "omedetou" of the voice characteristic A, the base point database B 512 holds label information and base point information of each element included in the speech "omedetou" of the voice characteristic B.

The function extracting unit 513 generates a difference between the label information and the base point information between the elements corresponding respectively to the base point database A 511 and the base point database B 512 as transformation functions for transforming voice characteristics of respective elements from the voice characteristic A to the voice characteristic B. The function extracting unit 513 then stores the label information and base point information for respective elements in the base point database A 511 and the transformation functions for respective elements generated as described above into the transformation function database 514 by associating them with each other.

The function selecting unit 515 selects, for each element portion included in the speech data A 506, from the transformation function database 514, a transformation function associated with the base point information that is most approximate to the base point information of the element portion. Accordingly, a transformation function that is most appropriate for the transformation of the element portion can be efficiently and automatically selected for each element portion included in the speech data A 506. The function selecting unit 515 then generates all transformation functions that are sequentially selected as transformation function data 516 and stores them into the third buffer 519.

The transformation ratio designating unit 507 designates, for the function applying unit 509, a transformation ratio showing a ratio of approaching the speech of the voice characteristic A to the speech of the voice characteristic B.

The function applying unit 509 transforms the speech data A 506 to the transformed speech data 508 using the transformation function data 516 so that the speech of the voice characteristic A shown by the speech data A 506 approaches to the speech of the voice characteristic B as much as the transformation ratio designated by the transformation ratio designating unit 507. The function applying unit 509 then stores the transformed speech data 508 into the second buffer 518. The transformed speech data 508 stored as described above is passed onto a device for speech output, a device for recording, a device for communication and the like.

Note that, while, in the present embodiment, a phoneme is described as an element (a speech element) as a constituent of a speech, the element may be a constituent of another.

Figure 24A:
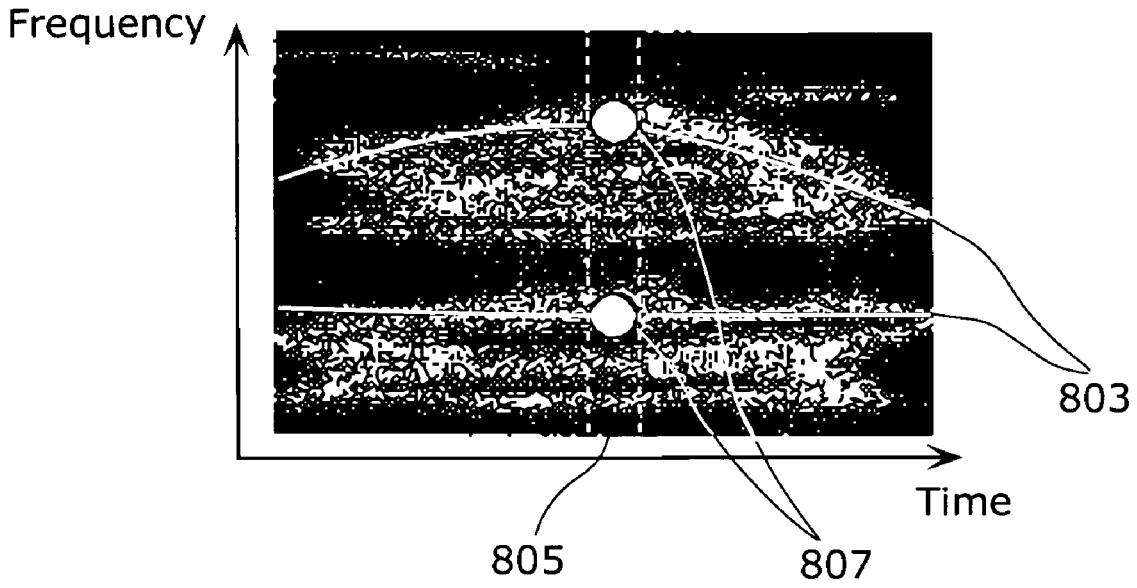
FIG. 24A is a schematic diagram showing an example of base point information of a voice characteristic A according to the fourth embodiment of the present invention.
Figure 24B:
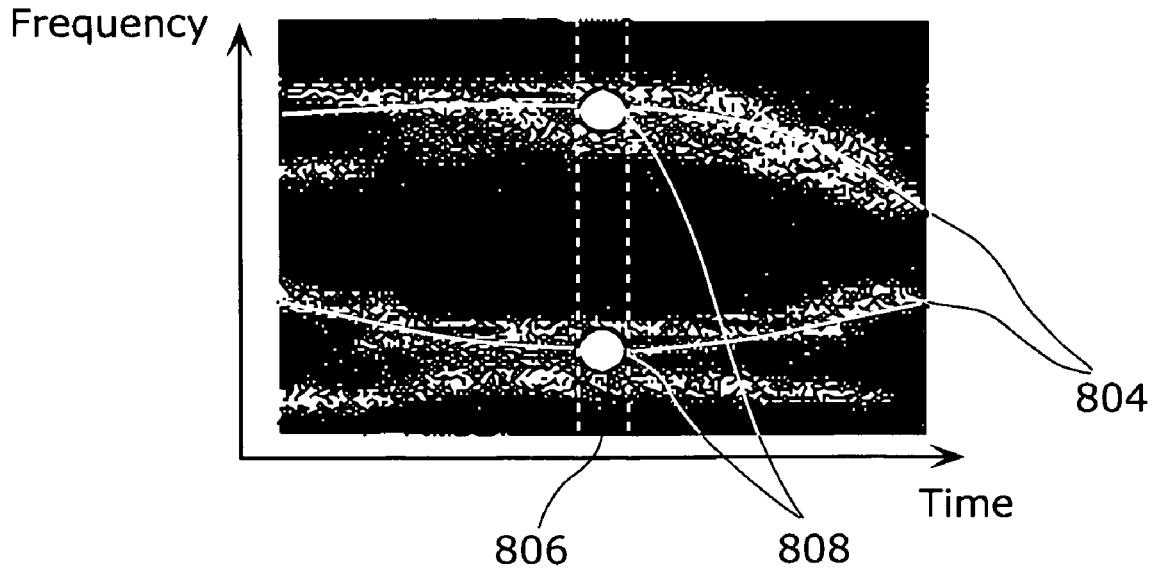
FIG. 24B is a schematic diagram showing an example of base point information of a voice characteristic B according to the fourth embodiment of the present invention.

FIG. 24A and FIG. 24B are schematic diagrams, each of which shows an example of base point information according to the present embodiment.

The base point information is information indicating base points of a phoneme. Hereafter, the base point is explained.

As shown in FIG. 24A, a spectrum of a predetermined phoneme portion included in the speech of the voice characteristic A shows two formant paths 803 which characterize the voice characteristics of the speech. For example, the base points 807 for this phoneme are defined, in the frequencies shown as the two formant paths 803, as frequencies corresponding to a center 805 of the duration length of the phoneme.

Similar to the description above, as shown in FIG. 24B, a spectrum of a predetermined phoneme portion included in the speech of the voice characteristic B shows two formant paths 804 which characterize the voice characteristics of the speech. For example, the base points 808 for this phoneme are defined, in the frequencies shown as the two formant paths 804, as frequencies corresponding to a center 806 of the duration length of the phoneme.

For example, in the case where the speech of the voice characteristic A is semantically (contextually) the same as the speech of the voice characteristic B and where the phoneme shown in FIG. 24A corresponds to the phoneme shown in FIG. 24B, the voice characteristic transformation apparatus of the present embodiment transforms the voice characteristic of the phoneme using the base points 807 and 808. In other words, the voice characteristic transformation apparatus of the present embodiment i) expands or compresses, on the frequency axis, the speech spectrum of the phoneme of the voice characteristic A so that the formant positions of the speech spectrum of the voice characteristic B shown as the base point 808 adjusted to the speech spectrum of the phoneme of the voice characteristic A; and ii) further expands or compresses, on the time axis, the speech spectrum of the phoneme of the voice characteristic A so that the formant positions of the speech spectrum of the voice characteristic B adjusted to the duration length of the phoneme. Accordingly, the speech of the voice characteristic A can be approximated to the speech of the voice characteristic B.

Note that, in the present embodiment, the reason why the formant frequencies in the center position of the phoneme are defined as base points is that a speech spectrum of a vowel is most stable near the center of the phoneme.

FIG. 25A and FIG. 25B are explanatory diagrams for explaining information stored respectively in the base point database A 511 and the base point database B 512.

As shown in FIG. 25A, the base point database A 511 holds a phoneme sequence included in the speech of the voice characteristic A, and label information and base point information corresponding to each phoneme in the phoneme sequence. As shown in FIG. 25B, the base point database B 512 holds a phoneme sequence included in the speech of the voice characteristic B, and label information and base point information corresponding to each phoneme in the phoneme sequence. The label information is information showing a timing of utterance of each phoneme included in the speech, and is indicated by a duration length of each phoneme. That is, the timing of the utterance of a predetermined phoneme is indicated as a sum of duration lengths of all phonemes up to the phoneme that is immediately before the predetermined phoneme. Also, the base point information is indicated by the two base points (a base point 1 and a base point 2) shown in the spectrum of each phoneme.

For example, as shown in FIG. 25A, the base point database A 511 holds a phoneme sequence "ome" and holds, for the phoneme "o", a duration length (80 ms), a base point 1 (3000 Hz) and a base point 2 (4300 Hz). Also, for the phoneme "m", a duration length (50 ms), a base point 1 (2500 Hz) and a base point 2 (4250 Hz) are stored. Note that, in the case where the utterance is started from the phoneme "o", a timing of utterance of the phoneme "m" is the timing that has passed 80 ms from the start.

On the other hand, as shown in FIG. 25B, the base point database B 512 holds a phoneme sequence "ome" corresponding to the base point database A 511, and holds, for the phoneme "o", a duration length (70 ms), a base point 1 (3100 Hz) and a base point 2 (4400 Hz). Also, it holds, for the phoneme "m", a duration length (40 ms), a base point 1 (2400 Hz) and a base point 2 (4200 Hz).

The function extracting unit 513 calculates, from the information included in the base point database A 511 and the base point database B 512, a ratio of base points and duration lengths of corresponding phoneme portion. The function extracting unit 513 stores, defining the ratio that is the calculation result as a transformation function, the transformation function and the base point and duration length of the voice characteristic A as a set into the transformation function database 514.

Figure 26:
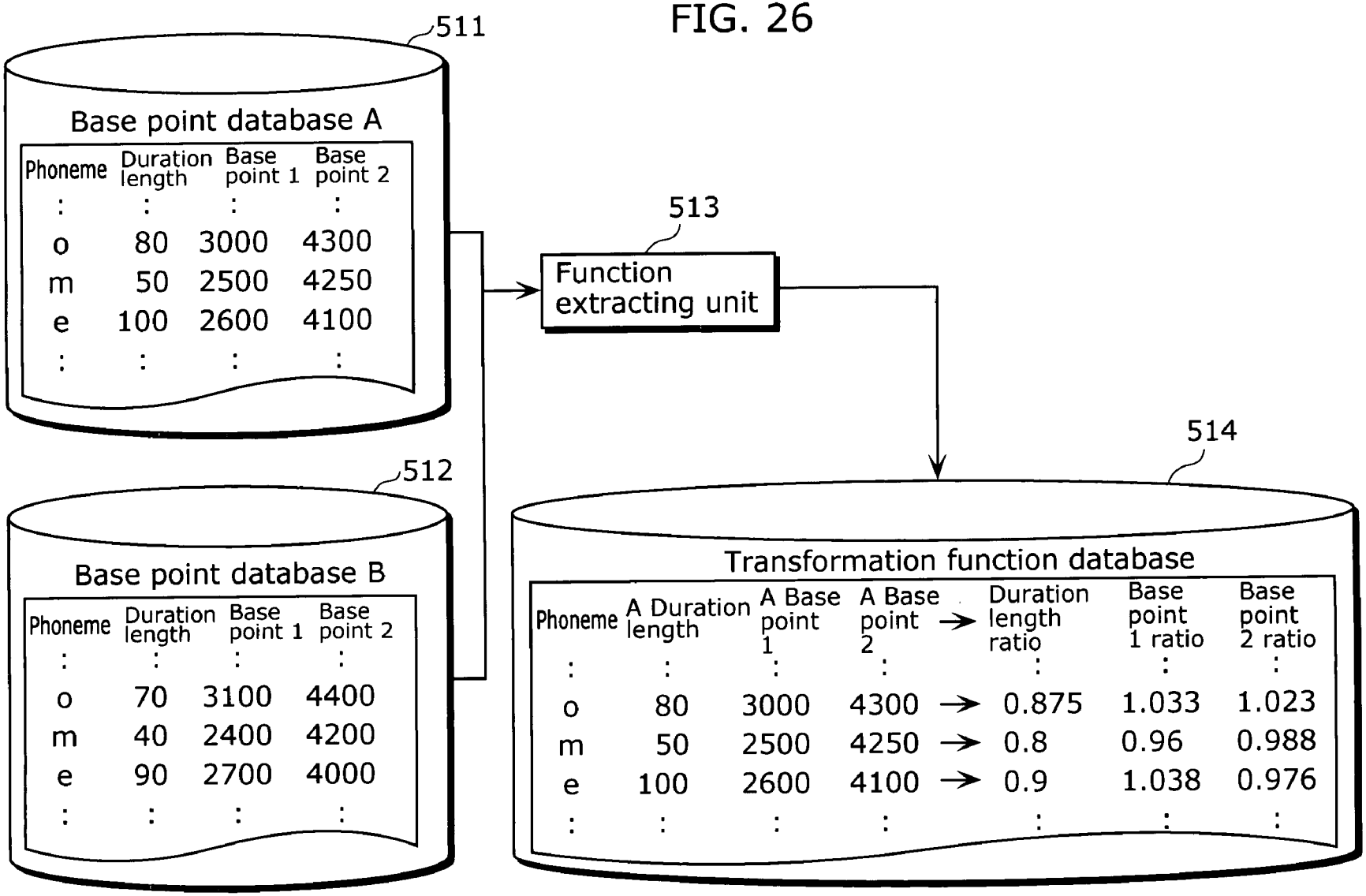
FIG. 26 is a schematic diagram showing a processing example of a function extracting unit according to the fourth embodiment of the present invention.

FIG. 26 is a schematic diagram showing an example of processing performed by the function extracting unit 513 according to the present embodiment.

The function extracting unit 513 obtains, respectively from the base point database A 511 and the base point database B 512, a base point and a duration length of each phoneme corresponding to the respective database. The function extracting unit 513 then calculates a ratio of the voice characteristic B to the voice characteristic A for each phoneme.

For example, the function extracting unit 513 obtains, from the base point database A 511, a duration length (50 ms), a base point 1 (2500 Hz), and a base point 2 (4250 Hz) of a phoneme "m", and obtains, from the base point database B 512, a duration length (40 ms), a base point 1 (2400 Hz), and a base point 2 (4200 Hz) of a phoneme "m". The function extracting unit 513 then calculates: a ratio of the duration lengths (duration length ratio) between the voice characteristic B and the voice characteristic A as 40/50=0.8; a ratio of the base points 1 (base point 1 ratio) between the voice characteristic B and the voice characteristic A as 2400/2500=0.96; and a ratio of the base points 2 between the voice characteristic B and the voice characteristic A as 4200/4250=0.988.

After calculating the ratios as described, the function extracting unit 513 stores, for each phoneme, a set of i) a duration length (A duration length), a base point 1 (A base point 1) and a base point 2 (A base point 2) of the voice characteristic A and ii) the calculated duration length, base point 1 and base point 2, into the transformation function database 514.

Figure 27:
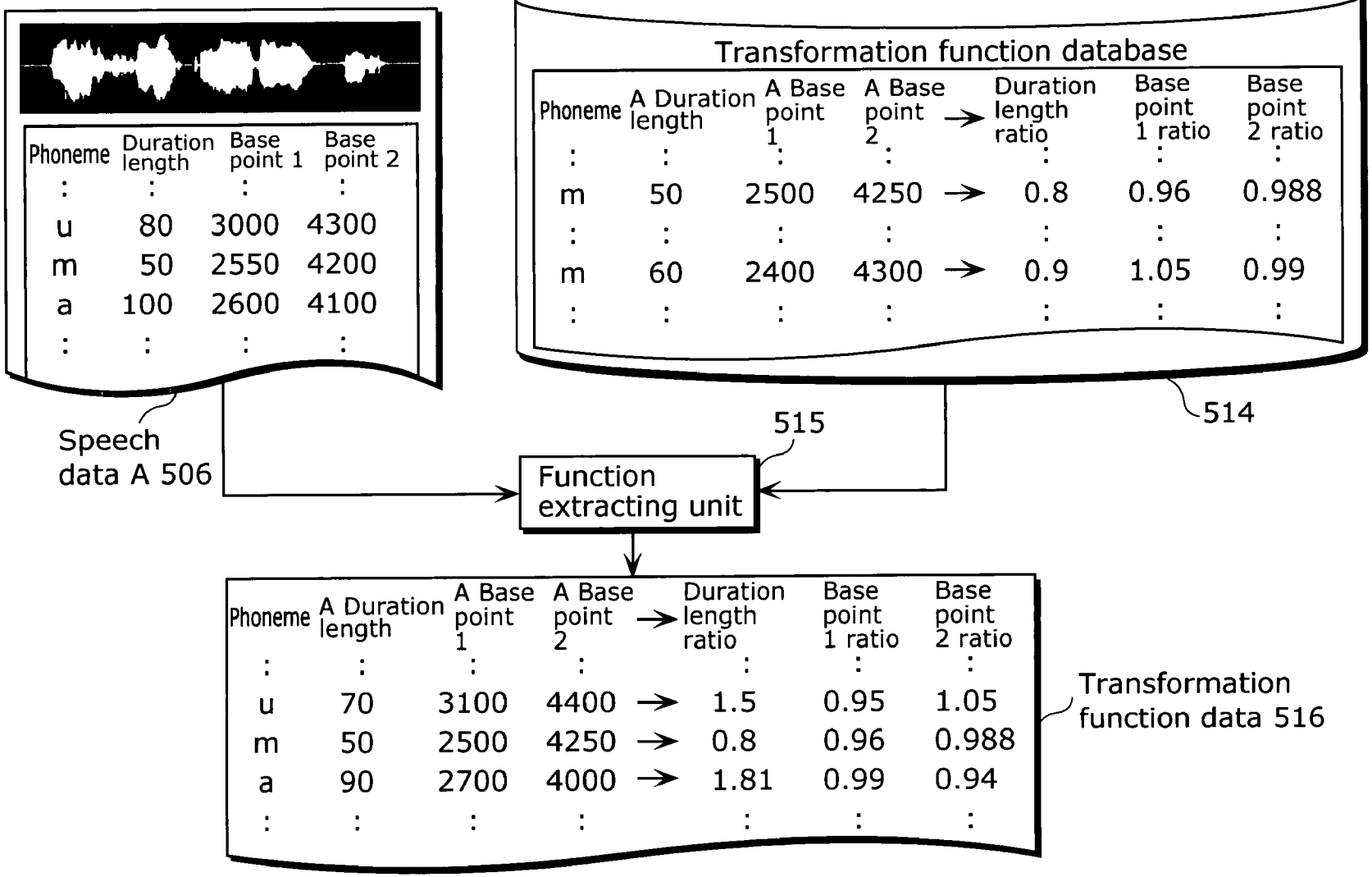
FIG. 27 is a schematic diagram showing a processing example of a function selecting unit according to the fourth embodiment of the present invention.

FIG. 27 is a schematic diagram showing an example of processing performed by the function selecting unit 515 according to the present embodiment.

The function selecting unit 515 searches, for each phoneme indicated in the speech data A 506, a set of A base points 1 and 2 which indicates the closest frequency to the set of base point 1 and base point 2 of the phoneme, from the transformation function database 514. When finding the set, the function selecting unit 515 selects, as a transformation function for the phoneme, a duration length ratio, a base point 1 ratio and a base point 2 ratio that are associated with the set in the transformation function database 514.

For example, when selecting an optimum transformation function for a transformation of the phoneme "m" indicated in the speech data A 506 from the transformation function database 514, the function selecting unit 515 searches, from the transformation function database 514, a set of A base points 1 and 2 which indicates the closest frequency to the base point 1 (2550 Hz) and base point 2 (4200 Hz) of the phoneme "m". In other words, in the case where there are two transformation functions for the phoneme "m" in the transformation function database 514, the function selecting unit 515 calculates a distance (a degree of similarity) between i) the base points 1 and 2 (2550 Hz, 4200 Hz) of the phoneme "m" in the speech data A 506 and ii) the A base points 1 and 2 (2400 Hz, 43000 Hz) of the phoneme "m" in the transformation function database 514. As the result, the function selecting unit 515 selects, as the transformation functions for the phoneme "m" of the speech data A 506, the duration length ratio (0.8), base point 1 ratio (0.96) and base point 2 ratio (0.988) that are associated with the A base points 1 and 2 (2500 Hz, 4250 Hz) which have the shortest distance, that is, the highest degree of similarity.

Such function selecting unit 515 thus selects, for each phoneme shown in the speech data A 506, an optimum transformation function for the phoneme. Specifically, the function selecting unit 515 includes a similarity deriving unit, and derives a degree of similarity for each phoneme included in the speech data A 506 in the first buffer 517 that is an element storing unit, by comparing between the phonetic characteristics (base point 1 and base point 2) of the phoneme and the phonetic characteristics (base point 1 and base point 2) of a phoneme used for generating a transformation function stored in the transformation function database 514 that is a function storing unit. The function selecting unit 515 selects, for each phoneme included in the speech data A 506, a transformation function generated by using a phoneme having the highest degree of similarity with the phoneme. The function selecting unit 515 generates transformation function data 516 including the selected transformation function and the A duration length, A base point 1 and A base point 2 that are associated with the selected transformation function in the transformation function database 514.

Note that, by assigning weights to the distance depending on a type of a base point, a calculation may be performed so that the closeness of a position of a specified type base point is preferentially considered. For example, the risk of causing a degradation of the phonemic characteristic due to the voice characteristic transformation can be reduced by assigning more weights to the lower order formant which affects the phonemic characteristic.

Figure 28:
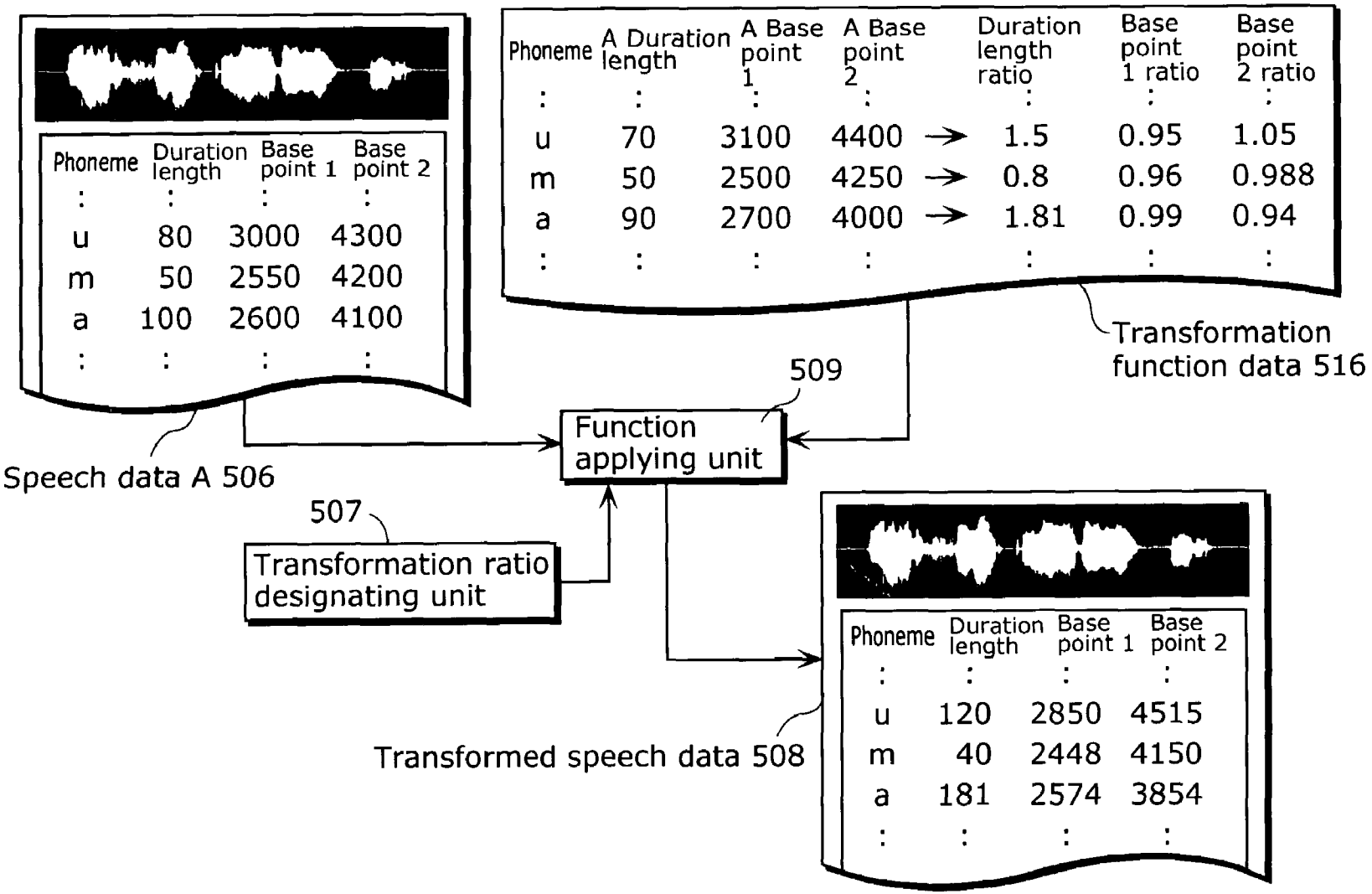
FIG. 28 is a schematic diagram showing a processing example of a function applying unit according to the fourth embodiment of the present invention.

FIG. 28 is a schematic diagram showing an example of processing performed by the function applying unit 509 according to the present embodiment.

The function applying unit 509 multiplies, for the duration length, base point 1 and base point 2 indicated by each phoneme in the speech data A 506, a duration length ratio, base point 1 ratio, base point 2 ratio that are shown by the transformation function data 516 and a transformation ratio designated by the transformation ratio designating unit 507, and corrects the duration length and base points 1 and 2 shown by each phoneme of the speech data A 506. The function applying unit 509 modifies waveform data shown by the speech data A 506 so as to be the corrected duration length and the base points 1 and 2. In other words, the function applying unit 509 according to the present embodiment applies, for each phoneme included in the speech data A 506, the transformation function selected by the function selecting unit 115, and transforms a voice characteristic of the phoneme.

For example, the function applying unit 509 multiples, for the duration length (80 ms), base point 1 (3000 Hz) and base point 2 (4300 Hz) shown by the phoneme "u" of the speech data A 506, the duration length ratio (1.5), base point 1 ratio (0.95) and base point 2 ratio (1.05) that are shown in the transformation function data 516 and the transformation ratio (100%) designated by the transformation ratio designating unit 507. Accordingly, the duration length (80 ms), base point 1 (3000 Hz) and base point 2 (4300 Hz) that are shown by the phoneme "u" of the speech data A 506 are corrected respectively to the duration length (120 ms), the base point 1 (2850 Hz) and the base point 2 (4515 Hz). The function applying unit 509 then modifies the waveform data so that the duration length, base point 1 and base point 2 for the phoneme "u" portion of the waveform data of the speech data A 506 respectively become the corrected duration length (120 ms), the base point 1 (2850 Hz) and the base point 2 (4514 Hz).

Figure 29:
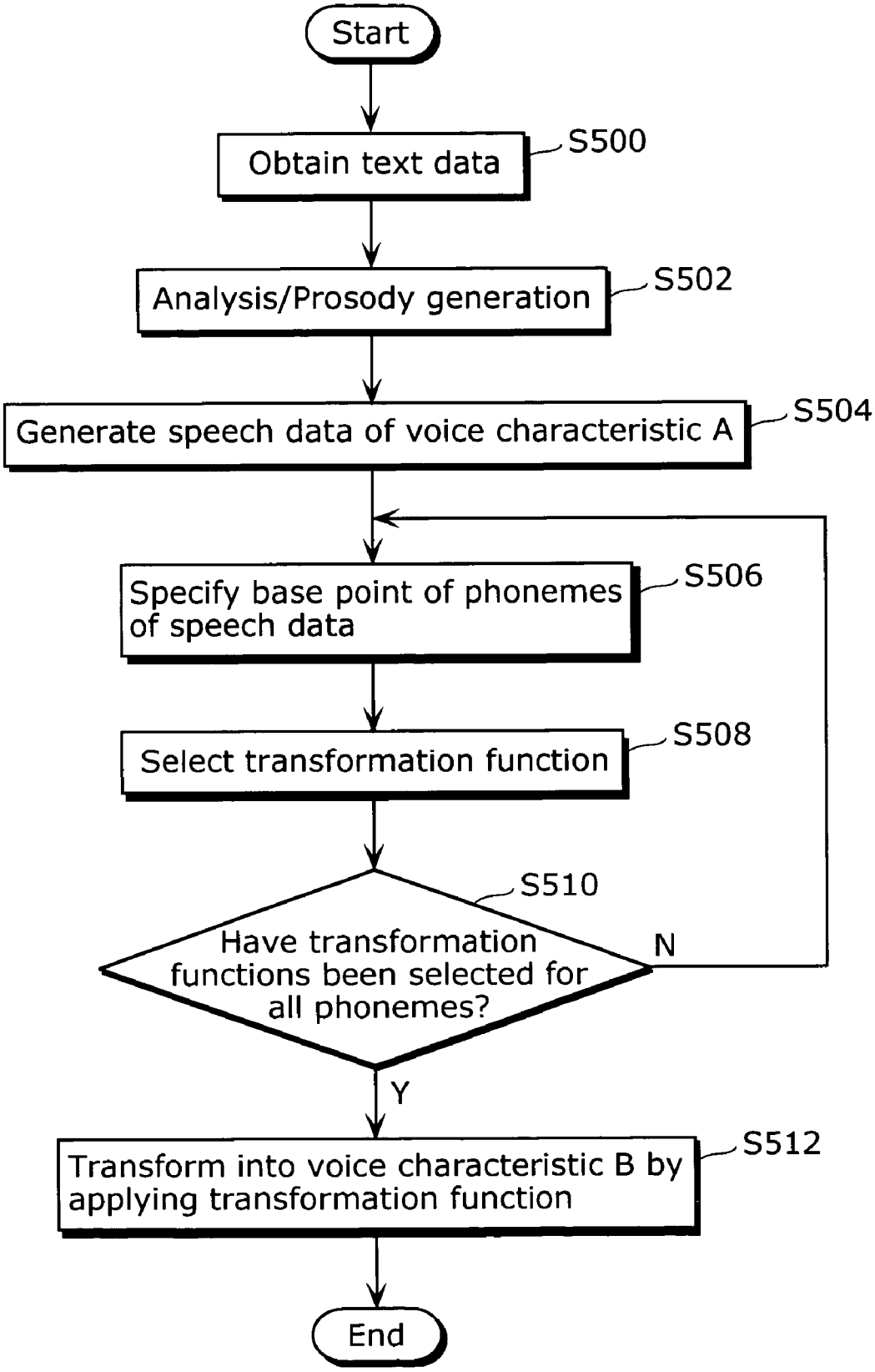
FIG. 29 is a flowchart showing an operation of the voice characteristic transformation apparatus according to the fourth embodiment of the present invention.

FIG. 29 is a flowchart showing an operation of the voice characteristic transformation apparatus according to the present embodiment.

First, the voice characteristic transformation apparatus obtains text data 501 (Step S500). The voice characteristic transformation apparatus performs language analysis and morpheme analysis on the obtained text data 501, and generates a prosody based on the analysis result (Step S502).

When the prosody is generated, the voice characteristic transformation apparatus selects and connects phonemes from the element database A 510 based on the prosody, and generates the speech data A 506 which indicates a speech of the voice characteristic A (Step S504).

The voice transformation apparatus specifies a base point of the first phoneme included in the speech data A (Step S506), and selects, from the transformation function database 514, a transformation function generated based on the base point most approximate to the specified base point as an optimum transformation function for the specified phoneme (Step S508).

Here, the voice characteristic transformation apparatus judges whether or not the transformation functions are selected respectively for all phonemes included in the speech data A 506 generated in Step S504 (Step S510). When judging that they are not selected for all phonemes (N in Step S510), the voice characteristic transformation apparatus repeatedly executes processing starting from Step S506 on the next phoneme included in the speech data A 506. On the other hand, when judging that they are selected (Y in Step S510), the voice characteristic transformation apparatus applies the selected transformation function to the speech data A 506, and transforms the speech data A into the transformed speech data 508 which indicates a speech of the voice characteristic B (Step S512).

Thus, in the present embodiment, the transformation function generated based on the base point that is most approximate to the base point of the phoneme is applied to the phoneme of the speech data A 506, and the voice characteristic of the speech indicated by the speech data A 506 is transformed from the voice characteristic A to the voice characteristic B. Accordingly, in the present embodiment, for example, in the case where there are the same phonemes in the speech data A 506, but each phoneme has a different acoustic characteristic, a transformation function corresponding to the acoustic characteristic is applied and the voice characteristic of the speech shown in the speech data A 506 can be appropriately transformed without applying, as in the conventional example, a same transformation function to the same phonemes despite the differences of the acoustic characteristics.

Also, in the present embodiment, the acoustic characteristic is indicated as a compact representative value that is a base point. Therefore, when a transformation function is selected from the transformation function database 514, an appropriate transformation function can be selected easily and quickly without performing complicated operational processing.

Note that, while, in the above method, a position of each base point in each phoneme and a magnification of the each base point position in each phoneme are defined as fixed values, they may be defined so as to smoothly interpolate between phonemes. For example, in FIG. 28, while the position of the base point 1 in the center position of the phoneme "u" is 3000 Hz and 2550 Hz in the center position of the phoneme "m", considering that the position of the base point 1 at the intermediate position of the phoneme "u" as (3000+2550)/2=2775 Hz and further the magnification of the position of the base point 1 in the transformation function as (0.95+0.96)/2=0.995, the modification may be performed so that, at a current point, a short time spectrum of the speech near 2775 Hz is adjusted to 2775×0.955=2650.125 Hz.

Note that, in the above mentioned method, a voice characteristic transformation is performed by modifying a spectrum shape of speech. However, the voice characteristic transformation can be performed by transforming model parameter values of a model base speech synthesis method. In this case, instead of applying a position of a base point to a speech spectrum, it may be applied to a time series variation graph of each model parameter.

Also, while, in the above mentioned method, it is presumed that a common type of base point is used for all phonemes, a type of a base point may be changed depending on a type of a phoneme. For example, it is effective to define base point information based on a formant frequency in the case of a vowel. However, it is considered effective for a voiceless consonant to extract a characteristic point (such as a peak) on a spectrum separately from the formant analysis applied to the vowel and to define the characteristic point as base point information, since physical meaning is very small in the definition of formant for the voiceless consonant. In this case, the number (dimensions) of fundamental information to be set for the vowel portion and for the voiceless consonant portion is different from each other.

(Variation 1)

While, in the method of the aforementioned embodiments, voice characteristic transformation is performed for each phoneme as a unit, longer units such as a word and an accent phrase may be used as a unit for performing the transformation. In particular, since it is difficult to complete the processing of the information of fundamental frequency and duration length which determine a prosody only by a modification of the phoneme unit, the modification may be performed by determining prosody information about an overall sentence based on a voice characteristic that is a transformation target to be achieved and performing replacement and morphing to and of the prosody information with the transformed voice characteristic.

In other words, the voice characteristic transformation apparatus according to the present variation generates prosody information (intermediate prosody information) corresponding to an intermediate voice characteristic obtained by approximating the voice characteristic A to the voice characteristic B by analyzing the text data 501, selects phonemes corresponding to the intermediate prosody information from the element database A 510, and generates speech data A 506.

Figure 30:
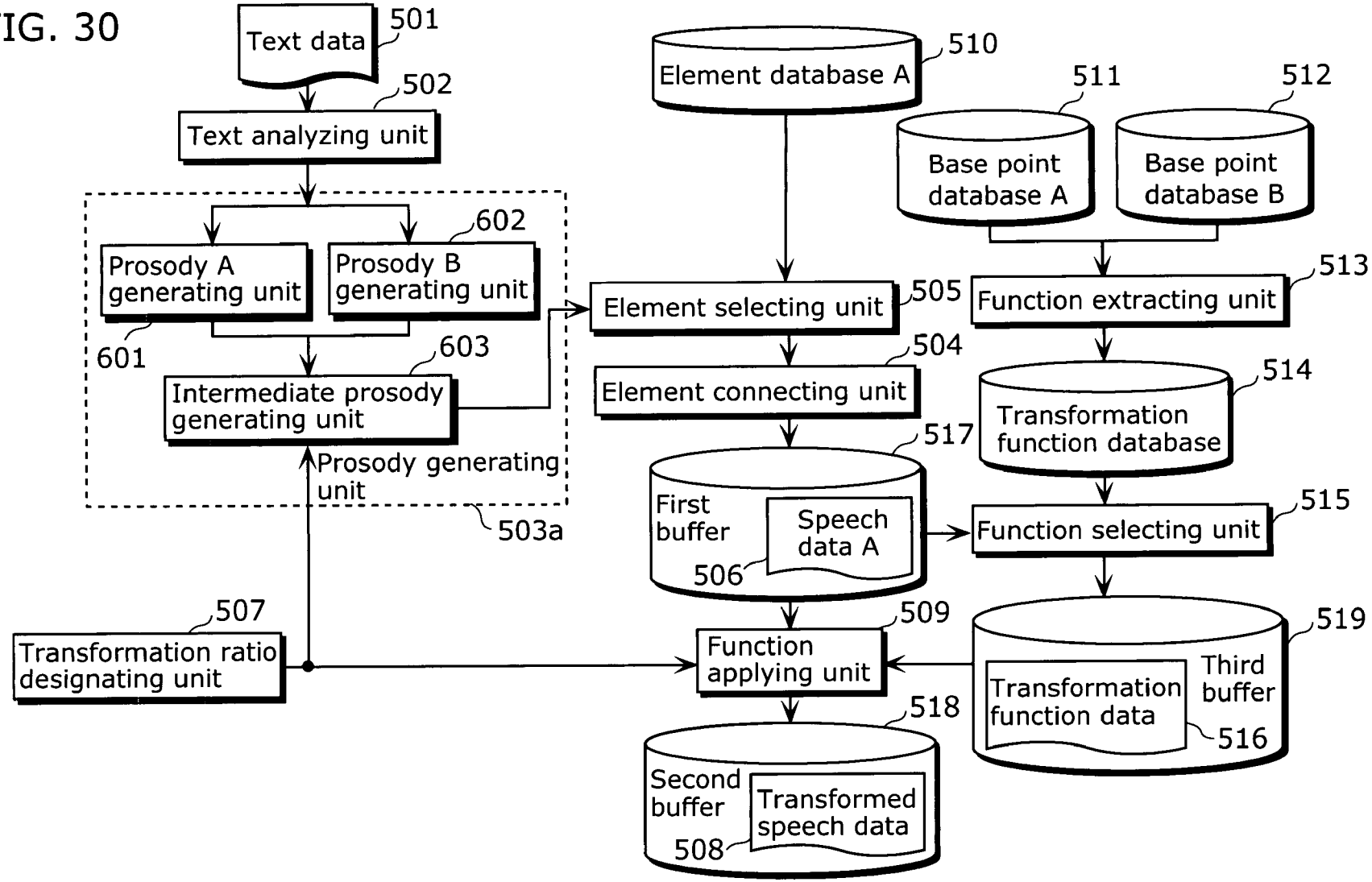
FIG. 30 is a block diagram showing a structure of a voice characteristic transformation apparatus according to a first variation of the fourth embodiment of the present invention.

FIG. 30 is a block diagram showing a structure of the voice characteristic transformation apparatus according to the present variation.

The voice characteristic transformation apparatus according to the present variation includes a prosody generating unit 503*a* which generates intermediate prosody information corresponding to the voice characteristic obtained by approximating the voice characteristic A to the voice characteristic B instead of the prosody generating unit 503 of the voice characteristic transformation apparatus according to the aforementioned embodiment.

The prosody generating unit 503*a* includes an prosody A generating unit 601, a prosody B generating unit 602 and an intermediate prosody generating unit 603.

The prosody A generating unit 601 generates prosody information A including an accent attached to the speech of the voice characteristic A and a duration of each phoneme.

The prosody B generating unit 602 generates prosody information B including an accent attached to a speech of the voice characteristic B and a duration of each phoneme.

The intermediate prosody generating unit 603 performs calculation based on the prosody information A and the prosody information B respectively generated by the prosody A generating unit 601 and the prosody B generating unit 602, and a transformation ratio designated by the transformation ratio designating unit 507, and generates intermediate prosody information corresponding to a voice characteristic obtained by approximating the voice characteristic A to the voice characteristic B as much as the transformation ratio. Note that, the transformation ratio designating unit 507 designates, to the intermediate prosody generating unit 603, a transformation ratio that is same as the transformation ratio designated to the function applying unit 509.

Specifically, the intermediate prosody generating unit 603 calculates, in accordance with the transformation ratio designated by the transformation ratio designating unit 507, an intermediate value of the duration length and an intermediate value of a fundamental frequency at each time, for phonemes respectively corresponding to the prosody information A and the prosody information B, and generates intermediate prosody information indicating the calculation result. The intermediate prosody generating unit 603 then outputs the generated intermediate prosody information to the element selecting unit 505.

With the aforementioned structure, voice characteristic transformation processing which combines a modification of the formant frequency and the like which can be modified for each phoneme and a modification of the prosody information which can be modified for each sentence can be realized.

Also, in the present variation, the speech data A 506 is generated by selecting phonemes based on the intermediate prosody information, so that the degradation of voice characteristic due to forcible voice characteristic transformation can be prevented when the function applying unit 509 transforms the speech data A 506 into the transformed speech data 508.

(Variation 2)

The aforementioned method tries to represent the acoustic characteristic of each phoneme to be stabilized by defining a base point at a center position of each phoneme. However, the base point may be defined as an average value of each formant frequency in the phoneme, an average value of spectrum intensity for each frequency band in the phoneme, a deviation value of these values and the like. In other words, an optimum function may be selected by defining a base point in a form of the HMM acoustic model that is generally used for a speech recognition technology, and calculating a distance between each state variable of a model on an element side and each state variable of a model on a transformation function.

Compared to the aforementioned embodiments, this method has an advantage that a more appropriate function can be selected because the base point information includes more information. However, it has a disadvantage that the loads for the selection processing is increased as the size of the base point information becomes larger, so that the size of each database which holds the base point information becomes bloated. It should be noted that, in the HMM speech synthesis apparatus which generates a speech from the HMM acoustic model, there is a great effect that the element data and the base point information can be shared. In other words, an optimum transformation function may be selected by comparing each state variable of the HMM indicating a characteristic of an original pre-generated speech of each transformation function with each state variable of the HMM acoustic model to be used. Each state variable of the HMM indicating a characteristic of an original pre-generated speech of each transformation function may be calculated by recognizing an original pre-generated speech by the HMM acoustic model to be used for synthesis and calculating an average and a deviation value of the acoustic characteristic amount at a portion which is applied to each HMM state in each phoneme.

(Variation 3)

In the present embodiment, a voice characteristic transformation function is added to a speech synthesis apparatus which receives text data 501 as an input, and outputs speech. However, the speech synthesis apparatus may receive speech as an input, generate label information by automatic labeling of the input speech, and automatically generate base point information by extracting a spectrum peak point in each phoneme center. Accordingly, the technology of the present invention can be used as a voice changer.

Figure 31:
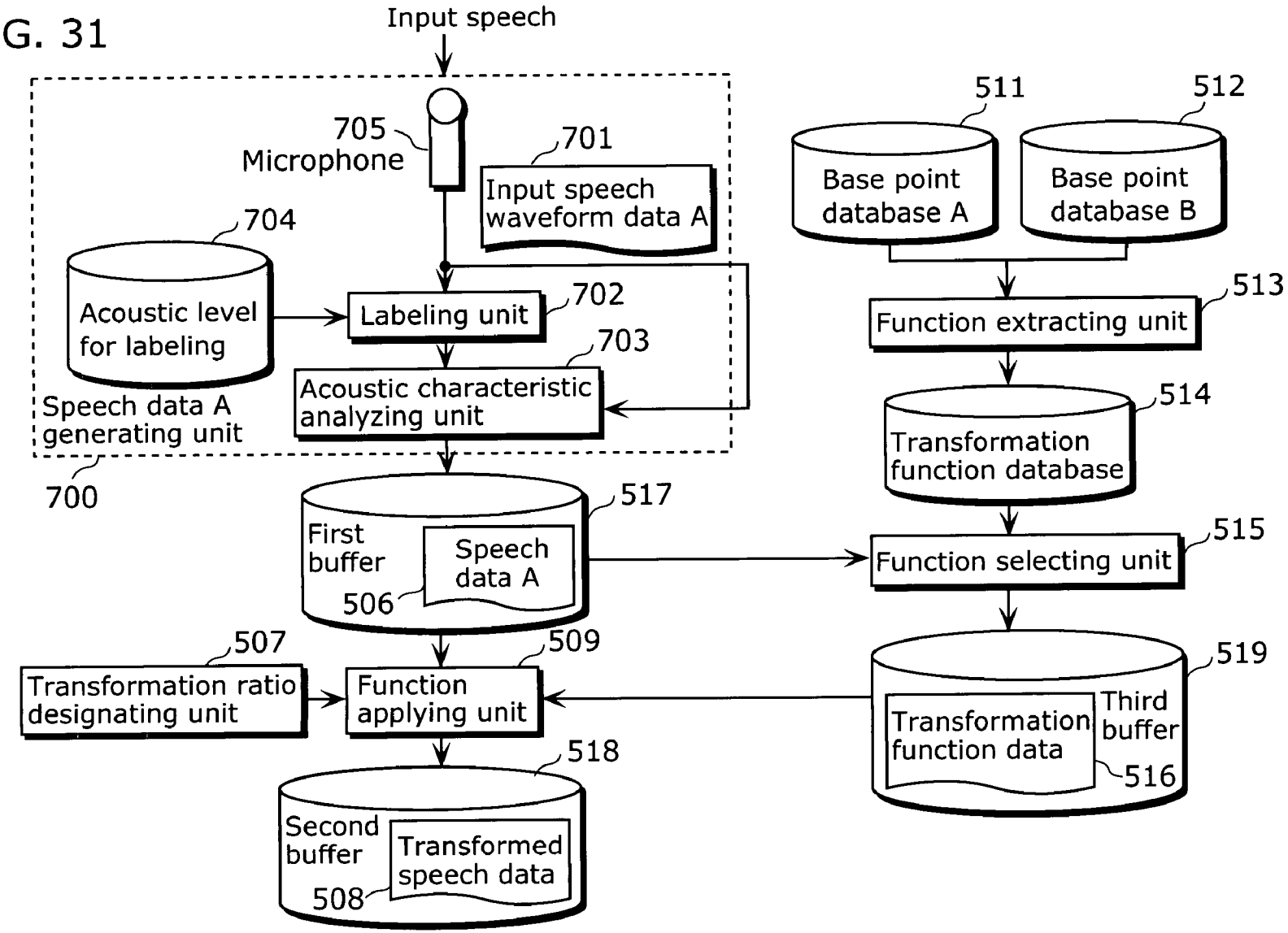
FIG. 31 is a block diagram showing a structure of a voice characteristic transformation apparatus according to a third variation of the fourth embodiment of the present invention.

FIG. 31 is a block diagram showing a structure of a voice characteristic transformation apparatus according to the present variation.

The voice characteristic transformation apparatus of the present variation includes an speech data A generating unit 700 which obtains a speech of a voice characteristic A as input speech and generates speech data A 506 corresponding to the input speech, instead of the text analyzing unit 502, prosody generating unit 503, element connecting unit 504, element selecting unit 505 and element database A 510 that are shown in FIG. 23 in the aforementioned embodiment. That is, in the present variation, the speech data A generating unit 700 is configured as a generating unit which generates the speech data A 506.

The speech data A generating unit 700 includes a microphone 705, a labeling unit 702, an acoustic characteristic analyzing unit 703 and an acoustic model for labeling 704.

The microphone 705 generates input speech waveform data A 701 showing a waveform of the input speech by collecting the input speech.

The labeling unit 702 labels a phoneme to the input speech waveform data A 701 with reference to the acoustic model for labeling 704. Accordingly, the label information for the phoneme included in the input speech waveform data A 701 is generated.

The acoustic characteristic analyzing unit 703 generates base point information by extracting a spectrum peak point (a formant frequency) at a center point (a time axis center) of each phoneme labeled by the labeling unit 702. The acoustic characteristic analyzing unit 703 then generates speech data A 506 including the generated base point information, the label information generated by the labeling unit 702 and the input speech waveform data A 701, and stores the generated speech data A 506 into the first buffer 517.

Accordingly, in the present variation, the voice characteristic of the input speech can be transformed.

Note that, while the present invention is described in the embodiments and the variations, the present invention is not limited to those descriptions.

For example, in the present embodiment and its variations, the number of base points is defined as two of a base point 1 and a base point 2, and the number of the base points in a transformation function is defined as a base point 1 ratio and a base point 2 ratio. The number of the base points and base point ratios may be defined respectively as one or three or more. By increasing the number of base points and base point ratios, a more appropriate transformation function can be selected for a phoneme.

Although only some exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention.

INDUSTRIAL APPLICABILITY

The speech synthesis apparatus of the present invention has an effect of appropriately transforming a voice characteristic. For example, it can be used as a car navigation system, a speech interface with high entertainment quality such as a home electric appliance; an apparatus which provides information through synthesized speech by separately using various voice characteristics; and an application program. In particular, it is useful for reading a sentence in an e-mail which requires emotional expressions in voice, and for using an agent application program which requires an expression of a speaker quality. Also, the present invention is applicable as a karaoke machine by which a user can sing with a voice characteristic of a desired singer and as a voice changer which aims for protecting privacy and the like, by being combined with a speech automatic labeling technique.

What is claimed is:

1. A speech synthesis apparatus for synthesizing speech using speech elements so as to transform a voice characteristic of the speech, said speech synthesis apparatus comprising:

an element storing unit operable to store speech elements;

a function storing unit operable to store transformation functions for respectively transforming voice characteristics of the speech elements;

a voice characteristic designating unit operable to receive a voice characteristic designated by a user;

a prosody generating unit operable to obtain text data, estimate a prosody from a phoneme included in the text data, and generate prosody information which indicates the phoneme and the prosody;

a similarity deriving unit operable to derive a degree of similarity by comparing an acoustic characteristic of one of the speech elements stored in said element storing unit with an acoustic characteristic of a speech element which is used for generating one of the transformation functions stored in said function storing unit and which is specific to the transformation function;

a selecting unit operable to select, from said element storing unit, a speech element corresponding to the phoneme and the prosody indicated in the prosody information, and select, from said function storing unit, a transformation function for transforming a voice characteristic of the selected speech element into the voice characteristic received by said voice characteristic designation unit, based on the degree of similarity derived for the selected speech element by said similarity deriving unit and the voice characteristic received by said voice characteristic designation unit; and a transforming unit operable to apply the transformation function selected by said selecting unit to the selected speech element, and to transform the voice characteristic of the selected speech element into the voice characteristic received by said voice characteristic designation unit.

2. The speech synthesis apparatus according to claim 1, wherein said similarity deriving unit is operable to derive a degree of similarity that is higher the more the acoustic characteristic of the speech element stored in said element storing unit resembles the acoustic characteristic of the speech element used for generating the transformation function, and said selecting unit is operable to apply, to the selected speech element, a transformation function generated using a speech element having a highest degree of similarity.

3. The speech synthesis apparatus according to claim 2, wherein said similarity deriving unit is operable to derive a dynamic degree of similarity based on a degree of similarity between (a) an acoustic characteristic of a series that is made up of the speech element stored in said element storing unit and speech elements before and after the speech element, and (b) an acoustic characteristic of a series that is made up of the speech element used for generating the transformation function and speech elements before and after the speech element.

4. The speech synthesis apparatus according to claim 2, wherein said similarity deriving unit is operable to derive a static degree of similarity based on the degree of similarity between the acoustic characteristic of the speech element stored in said element storing unit and the acoustic characteristic of the speech element used for generating the transformation function.

5. The speech synthesis apparatus according to claim 1, wherein said selecting unit is operable to select, for the selected speech element, a transformation function generated using a speech element so that the degree of similarity is at or exceeds a predetermined threshold.

6. The speech synthesis apparatus according to claim 1, wherein said element storing unit is operable to store speech elements which make up speech of a first voice characteristic, said function storing unit is operable to store, in association with one another for each speech element of the speech of the first voice characteristic, (a) the speech element, (b) a standard representative value indicating an acoustic characteristic of the speech element, and (c) a transformation function for the standard representative value, said speech synthesis apparatus further comprises:

a representative value specifying unit operable to specify, for each speech element of the speech of the first voice characteristic stored in said element storing unit, a representative value indicating an acoustic characteristic of the speech element, said similarity deriving unit is operable to derive a degree of similarity by comparing the representative value indicated by the speech element stored in said element storing unit with the standard representative value of the speech element used for generating the transformation function stored in said function storing unit, said selecting unit is operable to select, for the selected speech element, from among the transformation functions stored in said function storing unit associated with a speech element that is the same as the selected speech element, a transformation function that is associated with a standard representative value having a highest degree of similarity with the representative value of the selected speech element, and said transforming unit is operable to apply the selected transformation function to the speech element selected by said selecting unit, and to transform the speech of the first voice characteristic into speech of a second voice characteristic.

7. The speech synthesis apparatus according to claim 6, further comprising a speech synthesizing unit operable to obtain the text data, generate the speech elements indicating the same details as the text data, and store the speech elements in said element storing unit.

8. The speech synthesis apparatus according to claim 7, wherein said speech synthesizing unit includes:

an element representative value storing unit in which each speech element which makes up the speech of the first voice characteristic and a representative value of the acoustic characteristic of the speech element are stored in association with one another;

an analyzing unit operable to obtain and analyze the text data; and a selection storing unit operable to select, based on an analysis result of said analyzing unit, the speech element corresponding to the text data from said element representative value storing unit, and to store, into said element storing unit, the selected speech element and the representative value of the selected speech element associated with one another, and said representative value specifying unit is operable to specify, for each speech element stored in said element storing unit, a representative value stored in association with the speech element.

9. The speech synthesis apparatus according to claim 8, further comprising:

a standard representative value storing unit operable to store, for each speech element of the speech of the first voice characteristic, (a) the speech element, and (b) a standard representative value indicating an acoustic characteristic of the speech element;

a target representative value storing unit operable to store, for each speech element of the speech of the second voice characteristic, (a) the speech element, and (b) a target representative value showing an acoustic characteristic of the speech element; and a transformation function generating unit operable to generate, the transformation function corresponding to the standard representative value, based on the standard representative value and the target representative value corresponding to the same speech element that are respectively stored in said standard representative value storing unit and said target representative value storing unit.

10. The speech synthesis apparatus according to claim 9, wherein the speech element is a phoneme, and the representative value and the standard representative value indicating the acoustic characteristics are values of formant frequencies at a time center of the phoneme.

11. The speech synthesis apparatus according to claim 9, wherein the speech element is a phoneme, and the representative value and the standard representative value indicating the acoustic characteristics are respectively average values of the formant frequencies of the phoneme.

12. A speech synthesizing method for synthesizing speech using speech elements so as to transform a voice characteristic of the speech, wherein an element storing unit is operable to store speech elements, and a function storing unit is operable to store transformation functions for transforming voice characteristics of the respective speech elements, said speech synthesizing method comprising:

receiving a voice characteristic designated by a user;

obtaining text data, estimating a prosody from a phoneme included in the text data, and generating prosody information which indicates the prosody and the phoneme;

deriving a degree of similarity by comparing an acoustic characteristic of one of the speech elements stored in the element storing unit with an acoustic characteristic of a speech element which is used for generating one of the transformation functions stored in the function storing unit and which is specific to the transformation function;

selecting, from the element storing unit, a speech element corresponding to the phoneme and the prosody indicated in the prosody information, and selecting, from the function storing unit, a transformation function for transforming a voice characteristic of the selected speech element into the voice characteristic received in said receiving, based on the degree of similarity derived for the selected speech element in said deriving and the received voice characteristic; and applying the transformation function selected in said selecting to the selected speech element, and transforming the voice characteristic of the selected speech element into the voice characteristic received in said receiving.

13. A program stored on a computer-readable medium for synthesizing a speech using speech elements so as to transform a voice characteristic of the speech, wherein an element storing unit is operable to store speech elements, and a function storing unit is operable to store transformation functions for transforming voice characteristics of the respective speech elements, said program comprising program code for causing a computer to execute:

receiving a voice characteristic designated by a user;

obtaining text data, estimating a prosody from a phoneme included in the text data, and generating prosody information which indicates the prosody and the phoneme;

deriving a degree of similarity by comparing an acoustic characteristic of one of the speech elements stored in said element storing unit with an acoustic characteristic of a speech element which is used for generating one of the transformation functions stored in said function storing unit and which is specific to the transformation function;

selecting, from the element storing unit, a speech element corresponding to the phoneme and the prosody indicated in the prosody information, and selecting, from the function storing unit, a transformation function for transforming a voice characteristic of the selected speech element into the voice characteristic received in said receiving, based on the degree of similarity derived for the selected speech element in said deriving and the received voice characteristic; and applying the transformation function selected in said selecting to the selected speech element, and transforming the voice characteristic of the selected speech element into the voice characteristic received in said receiving.

* * * * *